US006152118A

United States Patent [19]

Sasaki et al.

[11] Patent Number: 6,152,118

[45] Date of Patent: Nov. 28, 2000

[54] INTERNAL COMBUSTION ENGINE

[75] Inventors: Shizuo Sasaki, Numazu; Masato Gotoh, Susono; Takekazu Ito, Shizuoka-ken; Kouji Yoshizaki, Numazu; Hiroki Murata; Tsukasa Abe, both of Susono, all of Japan

[73] Assignee: Toyota Jidosha Kabushiki Kaisha, Toyota, Japan

[21] Appl. No.: 09/330,100

[22] Filed: Jun. 11, 1999

[30] Foreign Application Priority Data

| | | | |
|---|---|---|---|
| Jun. 22, 1998 | [JP] | Japan | 10-174914 |
| Jun. 22, 1998 | [JP] | Japan | 10-174916 |
| Sep. 14, 1998 | [JP] | Japan | 10-260365 |
| Oct. 6, 1998 | [JP] | Japan | 10-284326 |
| Oct. 29, 1998 | [JP] | Japan | 10-308483 |
| Nov. 6, 1998 | [JP] | Japan | 10-316477 |

[51] Int. Cl.[7] ..... F02M 25/07; F01N 3/20

[52] U.S. Cl. ..... 123/568.21; 60/274; 60/276; 60/299; 60/278

[58] Field of Search ..... 123/568.11, 568.21, 123/568.26, 568.27; 60/274, 276, 278, 279, 285, 298, 299, 301

[56] References Cited

U.S. PATENT DOCUMENTS

| | | | |
|---|---|---|---|
| 4,142,493 | 3/1979 | Schira et al. | 123/568.21 |
| 4,416,056 | 11/1983 | Takahashi | 29/603.24 |
| 4,454,854 | 6/1984 | Gotoh et al. | 123/568.27 |
| 4,519,366 | 5/1985 | May | 123/568.21 |
| 5,065,270 | 11/1991 | Koyanagi et al. | 360/123 |
| 5,172,550 | 12/1992 | Takeshima | 60/278 |
| 5,172,674 | 12/1992 | Horie et al. | 123/568.27 |
| 5,482,020 | 1/1996 | Shimizu et al. | 123/406.47 |
| 5,551,408 | 9/1996 | Shimitzu et al. | 123/568.27 |
| 5,632,144 | 5/1997 | Isobe | 60/277 |
| 5,732,554 | 3/1998 | Sasaki et al. | 60/278 |
| 5,768,887 | 6/1998 | Nakamura et al. | 60/274 |
| 5,797,370 | 8/1998 | Kimura et al. | 123/568.21 |
| 5,826,427 | 10/1998 | Yanagihara et al. | 123/568.26 |
| 5,890,359 | 4/1999 | Enander | 123/568.21 |
| 5,890,360 | 4/1999 | Sasaki et al. | 60/276 |
| 5,937,639 | 8/1999 | Sasaki et al. | 60/276 |
| 6,055,968 | 5/2000 | Sasaki et al. | 123/568.21 |

FOREIGN PATENT DOCUMENTS

| | | |
|---|---|---|
| B2-55-41012 | 10/1980 | Japan . |
| 62-18326 | 1/1987 | Japan . |
| 63-204504 | 8/1988 | Japan . |
| 2-14417 | 1/1990 | Japan . |
| 2-27508 | 1/1990 | Japan . |
| 2-302920 | 12/1990 | Japan . |
| 4-334750 | 11/1992 | Japan . |
| 5-182135 | 7/1993 | Japan . |
| 5-242430 | 9/1993 | Japan . |
| 6-346763 | 12/1994 | Japan . |
| 7-4287 | 1/1995 | Japan . |
| WO 93/07363 | 4/1993 | WIPO . |

*Primary Examiner*—Willis R. Wolfe
*Attorney, Agent, or Firm*—Oliff & Berridge, PLC

[57] ABSTRACT

An internal combustion engine that selectively switches from a first combustion in which an amount of an exhaust gas recirculation gas within a combustion chamber is more than the amount of the exhaust gas recirculation gas when an amount of soot generated reaches a peak amount to generate substantially no soot, that is, a low temperature combustion, and a second combustion in which the amount of the exhaust gas recirculation gas within the combustion chamber is less than the amount of the exhaust gas recirculation gas when the amount of soot generated reaches the peak amount. The switching is selectively performed, such that, a stable low temperature combustion corresponding to the air fuel ratio is performed by shifting the area for performing the low temperature combustion to the high load side as the air fuel ratio is reduced.

10 Claims, 39 Drawing Sheets

FIG. 13A

TQ

| | | |
|---|---|---|
| $AFKT1_{11}$ | $AFKT1_{12}$ ---- | $AFKT1_{1n}$ |
| $AFKT1_{21}$ | | |
| ⋮ | | ⋮ |
| $AFKT1_{n1}$ | ---------- | $AFKT1_{mn}$ |

N

FIG. 13B

TQ

| | | |
|---|---|---|
| $AFKT2_{11}$ | $AFKT2_{12}$ --- | $AFKT2_{1n}$ |
| $AFKT2_{21}$ | | |
| ⋮ | | ⋮ |
| $AFKT2_{m1}$ | ---------- | $AFKT2_{mn}$ |

N

FIG. 13C

TQ

| | | |
|---|---|---|
| $AFKT3_{11}$ | $AFKT3_{12}$ --- | $AFKT3_{1n}$ |
| $AFKT3_{21}$ | | |
| ⋮ | | ⋮ |
| $AFKT3_{m1}$ | ---------- | $AFKT3_{mn}$ |

N

FIG. 13D

TQ

| | | |
|---|---|---|
| $AFKT4_{11}$ | $AFKT4_{12}$ --- | $AFKT4_{1n}$ |
| $AFKT4_{21}$ | | |
| ⋮ | | ⋮ |
| $AFKT4_{m1}$ | ---------- | $AFKT4_{mn}$ |

N

FIG. 39

| TQ | | | | |
|---|---|---|---|---|
| | $\theta min_{11}$ | $\theta min_{12}$ | ----- | $\theta min_{1n}$ |
| | $\theta min_{21}$ | | | ⋮ |
| | ⋮ | | | |
| | $\theta min_{m1}$ | ---------- | | $\theta min_{mn}$ |

N

INTERNAL COMBUSTION ENGINE

INCORPORATION BY REFERENCE

The disclosures of Japanese Patent Application Nos. HEI 10-284326 filed on Oct. 6, 1998; HEI 10-174914 filed on Jun. 22, 1998; HEI 10-174916 filed on Jun. 22, 1998; HEI 10-260365 filed on Sep. 14, 1998; HEI 10-308483 filed on Oct. 29, 1998; and HEI 10-316477 filed on Nov. 6, 1998, including the specification, drawings and abstract, are incorporated herein by reference in their entirety.

BACKGROUND OF THE INVENTION

1. Field of the Invention

The invention relates to an internal combustion engine that performs combustion by introducing an inert gas into a combustion chamber.

2. Description of the Related Art

Conventionally, in an internal combustion engine, such as, for example, a diesel engine, an engine exhaust passage and an engine intake passage are connected by an exhaust gas recirculation (hereinafter referred to as EGR) passage so as to recirculate an exhaust gas, that is, an EGR gas into the engine intake passage via the EGR passage such that generation of nitrogen oxides NOx is prevented. In this case, the EGR gas has a relatively high specific heat and accordingly can absorb a large amount of heat. Hence, the combustion temperature within the combustion chamber decreases as the amount of the EGR gas is increased. In other words, the EGR rate (the EGR gas amount)/(EGR gas amount+intake air amount) is increased. When the combustion temperature is lowered, the amount of nitrogen oxides NOx generated is lowered. Therefore, the higher the EGR rate, the lower the amount of nitrogen oxides NOx that is generated.

As mentioned above, it has been conventionally known that the amount of nitrogen oxides NOx generated can be lowered by increasing the EGR rate. However, in the case where the EGR rate is increased, an amount of soot generated, i.e., smoke, suddenly starts increasing when the EGR rate exceeds a certain limit. In this respect, it has been conventionally considered that the smoke is unlimitedly increased when the EGR rate is further increased. In other words, the EGR rate at which the smoke suddenly starts increasing is regarded as the maximum allowable limit of the EGR rate.

Accordingly, the EGR rate has been conventionally defined to be within a range which does not deviate from the maximum allowable limit. The maximum allowable limit of the EGR rate differs significantly depending on the type of engine and fuel, however, is typically within a range of about 30% to 50%. Therefore, in the conventional diesel engine, the EGR rate is restricted to the range of about 30% to 50% at most.

As mentioned above, since it has been conventionally considered that the EGR rate has the maximum allowable limit, the EGR rate has been defined to be within the range which does not deviate from the maximum allowable limit, such that the amount of smoke generated becomes as least as possible. However, even if the EGR rate is determined so as to reduce the generated amount of nitrogen oxides NOx and smoke to be as least as possible, the reduction of the generation amount of nitrogen oxides NOx and the smoke is limited because a significant amount of nitrogen oxides NOx and smoke are still generated.

SUMMARY OF THE INVENTION

However, in the course of researching combustion in the diesel engine, it has been found that if the EGR rate is greater than the maximum allowable limit, the amount of smoke generated increasing sharply. As the amount of smoke generated reaches a peak amount, if the EGR rate is further increased to exceed the peak amount, the amount of smoke generated decreasing sharply. When setting the EGR rate to 70% or greater during idling operation, or setting the EGR rate to about 55% or greater during strong cooling of the EGR gas, the amount of smoke generated becomes substantially 0. In other words, substantially no soot is generated. Furthermore, it has been found that the amount of nitrogen oxides NOx generated also assumes a very small value at this time.

Thereafter, based on this fact, further studies have been conducted focusing on the reason why soot is barely generated. As a result, a novel combustion system capable of reducing the soot and nitrogen oxides NOx simultaneously has been constructed. This novel combustion system will be explained later in detail. In short, this combustion system is based on the idea to prevent hydrocarbon HC from growing to soot.

In other words, it has been determined by repeated experiments and studies that if the temperature of fuel and ambient gas in the combustion chamber during combustion is equal to or lower than a certain temperature, hydrocarbon HC stops growing before it becomes soot, and if the temperature of fuel and ambient or surrounding gas increases to be higher than the aforementioned certain temperature, the hydrocarbon HC grows fast to become soot. In this case, the temperature of the fuel and the surrounding gas is greatly influenced by an endothermic effect of the gas surrounding the fuel during fuel combustion. Therefore, the temperature of the fuel and the ambient gas can be controlled by adjusting the endothermic value of the gas surrounding the fuel in accordance with an exothermic value during the fuel combustion.

Accordingly, generation of soot can be prevented by restricting the temperature of the fuel and the surrounding gas during combustion within the combustion chamber to be equal to or less than the temperature at which hydrocarbon HC stops growing on the way. Thus, it is possible to restrict the temperature of the fuel and the surrounding gas during combustion within the combustion chamber to a level equal to or less than the temperature at which the hydrocarbon HC stops growing on the way by adjusting the amount of the heat absorbed by the gas surrounding the fuel. Meanwhile, the hydrocarbon HC that has stopped growing before transforming to the soot can be easily purified by a post-treatment using an oxidation catalyst or the like. This is the basic concept of the novel combustion system.

Here, the novel combustion system requires the EGR rate to be set to about 55% or greater. However, this setting can be realized only when the intake air amount is relatively small. That is, when the intake air amount exceeds a predetermined amount, the new combustion cannot be performed and the combustion has to be switched to the one that has been conventionally performed. Under the new combustion, as substantially no nitrogen oxides NOx nor soot is generated under the new combustion, it is preferable to perform the new combustion in the wider operation area.

If the air fuel ratio increases during new combustion, that is, an amount of the air around the fuel increases, the combustion is activated, thus increasing the combustion temperature. On the other hand, if the air fuel ratio decreases, that is, the amount of the air around the fuel decreases, the combustion is not activated, thus decreasing the combustion temperature. Accordingly, in the case where the fuel injection amount is increased as the air fuel ratio is reduced, the new combustion can be performed to generate substantially no nitrogen oxides NOx or soot. In other words, the less the air fuel ratio becomes, the wider the operation area can be expanded at the high load side where the new combustion can be performed.

An object of the invention is to realize a new combustion in a stable state in accordance with an air fuel ratio to generate substantially no nitrogen oxides NOx or soot.

In order to achieve the above object, in accordance with the invention, there is an internal combustion engine in which an amount of a soot generated is gradually increased to a peak amount when increasing an amount of an inert gas within a combustion chamber. When further increasing the amount of the inert gas within the combustion chamber, a temperature of a fuel and a surrounding gas during combustion within the combustion chamber becomes lower than a generation temperature of the soot to generate substantially no soot. The internal combustion engine includes switching means for selectively switching a first combustion in which the amount of the inert gas within the combustion chamber is more than the amount of the inert gas when the generation amount of the soot reaches the peak amount to generate substantially no soot, and a second combustion in which the amount of the inert gas within the combustion chamber is less than the amount of the inert gas when the amount of soot generated reaches the peak amount, in which an operation area of the engine is separated into a first operation area in a low load side at which the first combustion can be performed and a second operation area in a high load side at which the second combustion can be performed. The first operation area is shifted to the high load side as the air fuel ratio becomes smaller.

In accordance with the present invention, the structure can be made such that a limit in the high load side and a limit in the low load side of the first operation area may be shifted toward the high load side as the air fuel ratio becomes smaller.

Furthermore, the low load side limit of the first operation area is only provided when the air fuel ratio is rich.

Still further, in accordance with the invention, the structure can be made such that there is provided control means for controlling the first operation area, which controls the first operation area in accordance with a target air fuel ratio.

Furthermore, in accordance with the invention, the structure can be made such that the first operation area is shifted to the high load side as the temperature of the fuel and the surrounding gas decrease during the first combustion.

Moreover, the structure can be made such that the high load side limit and the low load side limit of the first operation area are shifted toward the high load side as the decrease in the temperature of the fuel and the surrounding gas while the first combustion is performed at rich air fuel ratio.

Furthermore, it is desirable to design the engine such that there is provided an exhaust gas recirculating apparatus for recirculating an exhaust gas discharged from the combustion chamber into the engine intake passage where the inert gas is formed of a recirculated exhaust gas. An exhaust gas recirculation rate during the first combustion is substantially equal to or greater than 55%.

BRIEF DESCRIPTION OF THE DRAWINGS

FIGS. 13A–D are maps of various values of target air fuel ratios;

FIG. 39 is a view showing a map of the allowable maximum retard angle timing as a function of the required torque and engine speed;

DESCRIPTION OF THE PREFERRED EMBODIMENTS

Figure 1:
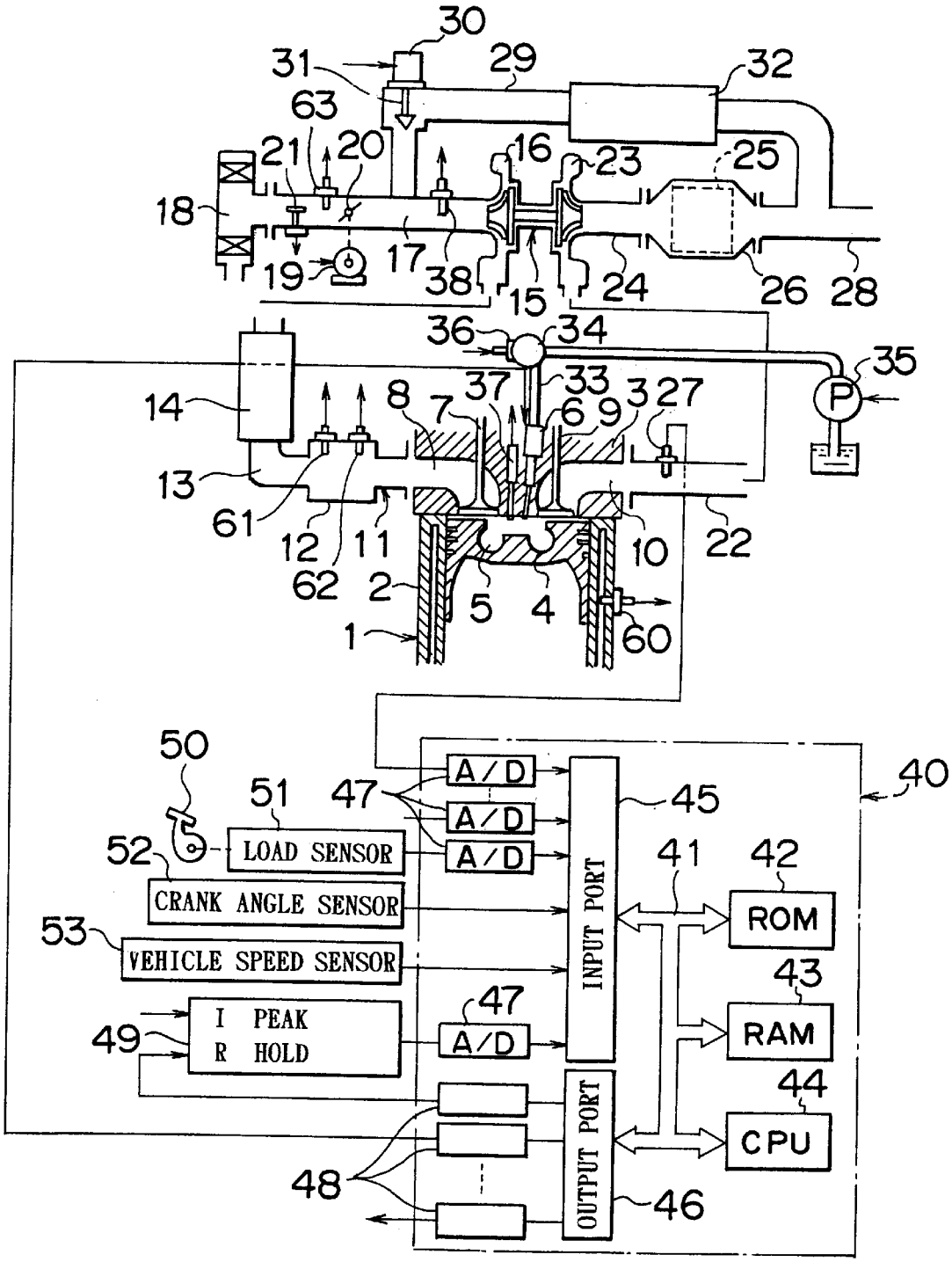
FIG. 1 is a schematic diagram of a four-stroke compression ignition type internal combustion engine according to a first embodiment of the invention.

FIG. 1 shows a 4-stroke compression ignition type internal combustion engine to which the invention has been applied.

Referring to FIG. 1, reference numeral 1 denotes an engine body, reference numeral 2 denotes a cylinder block, reference numeral 3 denotes a cylinder head, reference numeral 4 denotes a piston, reference numeral 5 denotes a combustion chamber, reference numeral 6 denotes an electrically controlled type fuel injection valve, reference numeral 7 denotes an intake valve, reference numeral 8 denotes an intake port, reference numeral 9 denotes an exhaust valve, and reference numeral 10 denotes an exhaust port, respectively. The intake port 8 is connected to a surge tank 12 via a corresponding intake branch pipe 11, and the surge tank 12 is connected to a supercharger, for example, an outlet portion of a compressor 16 of an exhaust turbo charger 15 via an intake duct 13 and an inter-cooler 14. An inlet portion of the compressor 16 is connected to an air cleaner 18 via an air intake pipe 17, and a throttle valve 20 driven by a stepper motor 19 is disposed within the air intake pipe 17. Also, a mass flow rate detecting device 21 for detecting a mass flow rate of the intake air is disposed within the air intake pipe 17 located upstream the throttle valve 20.

Meanwhile, the exhaust port 10 is connected to an inlet portion of an exhaust turbine 23 of the exhaust turbo charger 15 via an exhaust manifold 22, and an outlet portion of the exhaust turbine 23 is connected to a catalytic converter 26 containing a catalyst 25 having an oxidation function there within via an exhaust pipe 24. An air fuel ratio sensor 27 is disposed within the exhaust manifold 22.

An exhaust pipe 28 connected to an outlet portion of the catalytic converter 26 and the air intake pipe 17 disposed downstream the throttle valve 20 are connected to each other via an EGR passage 29, and an EGR control valve 31 driven by a stepper motor 30 is arranged within the EGR passage 29. Furthermore, an inter-cooler 32 for cooling an EGR gas flowing within the EGR passage 29 is arranged within the EGR passage 29. In the embodiment shown in FIG. 1, an engine cooling water is introduced into the inter cooler 32, and the EGR gas is cooled by the engine cooling water.

Furthermore, it should be noted that the structure of the engine can be modified such that the exhaust pipe 28 connected to the outlet portion of the catalytic converter 26 and the air intake pipe 17 disposed downstream the throttle valve 20 are not connected to each other via the EGR passage 29, and a catalytic converter containing a catalyst having an oxidation function, such as an oxidation catalyst, a three way catalyst or an nitrogen oxides NOx absorbing agent there within is provided in the EGR passage 29 so as to connect to the exhaust manifold 22 disposed upstream the exhaust turbine 23. Accordingly, a part of the exhaust gas discharged within the exhaust manifold 22 is supplied to the air intake pipe 17 via the EGR passage 29 and the remaining exhaust gas is supplied to the exhaust turbine 23. Therefore, in this case, a pressure of the EGR gas becomes higher than that of the embodiment shown in FIG. 1, however, a capacity for supercharging becomes low. Even in this case, an unburned hydrocarbon HC and soluble organic fractions SOF are purified by the catalyst, so that the EGR gas hardly containing the unburned hydrocarbon HC and the soluble organic fractions SOF is supplied into the air intake pipe 17.

Additionally, it should be noted that the structure of the engine can be modified such that a water cooling type EGR cooler and an air cooling type EGR cooler are arranged within the EGR passage 29. Accordingly, the EGR gas flowing within the EGR passage 29 from the side of the engine exhaust passage to the side of the engine intake passage is cooled to a predetermined temperature and net can then be cooled by the water cooling type EGR cooler.

Returning to FIG. 1, it can be seen that the fuel injection valve 6 is connected to a fuel reservoir, known as a common rail 34, via a fuel supply pipe 33. Fuel is supplied into the common rail 34 from an electrically controlled fuel pump 35 in which a discharge amount is variable, and the fuel supplied into the common rail 34 is supplied to the fuel injection valve 6 via the fuel supply pipe 33. As a fuel pressure sensor 36 for detecting a fuel pressure within the common rail 34 is mounted thereto, a discharge amount of the fuel pump 35 can be controlled such that the fuel pressure within the common rail 34 reaches a target fuel pressure on the basis of an output signal of the fuel pressure sensor 36.

An electronic control unit 40 is constituted by a digital computer and is provided with a read only memory (ROM) 42, a random access memory (RAM) 43, a microprocessor (CPU) 44, an input port 45 and an output port 46 mutually connected by a two way bus 41. A water temperature sensor 60 for detecting a temperature of an engine cooling water is arranged in the engine main body 1, and an output signal of the water temperature sensor 60 is input to the input port 45 via a corresponding A/D converter 47. A combustion pressure sensor 37 for detecting a pressure within the combustion chamber 5 is arranged within the combustion chamber 5, and an output signal of the combustion pressure sensor 37 is connected to an input terminal I of a peak hold circuit 49. An output terminal O of the peak hold circuit 49 is input to the input port 45 via the corresponding AID converter 47. Further, a pressure sensor 38 for detecting an absolute pressure within the air intake pipe 17 is mounted within the air intake pipe 17 disposed downstream the throttle valve 20, and an output signal of the pressure sensor 38 is input to the input port 45 via the corresponding A/D converter 47. A pressure sensor 61 for detecting an absolute pressure within the surge tank 12 and a temperature sensor 62 for detecting a temperature of a mixed gas between the intake air and the EGR gas are arranged in the surge tank 12, and output signals of the pressure sensor 61 and the temperature sensor 62 are respectively input to the input port 45 via the corresponding A/D converters 47.

A humidity sensor 63 for detecting a humidity of the intake air is disposed within the air intake pipe 17 located upstream the throttle valve 20, and an output signal of the humidity sensor 63 is input to the input port 45 via the corresponding A/D converter 47. An output signal of the fuel pressure sensor 36 is input to the input port 45 via the corresponding A/D converter 47. A load sensor 51 for generating an output voltage in proportion to a depression amount L of an accelerator pedal 50 is connected to the accelerator pedal 50, and an output voltage of the load sensor 51 is input to the input port 45 via the corresponding A/D converter 47. Further, a crank angle sensor 52 for generating an output pulse at every rotation of the crank shaft, for example, at 30 degrees, is connected to the input port 45. Meanwhile, the output port 46 is connected to the fuel injection valve 6, the throttle valve controlling stepper motor 19, the EGR control valve controlling stepper motor 30, the fuel pump 35 and a reset input terminal R of the peak hold circuit 49 via the corresponding drive circuit 48.

Figure 2:
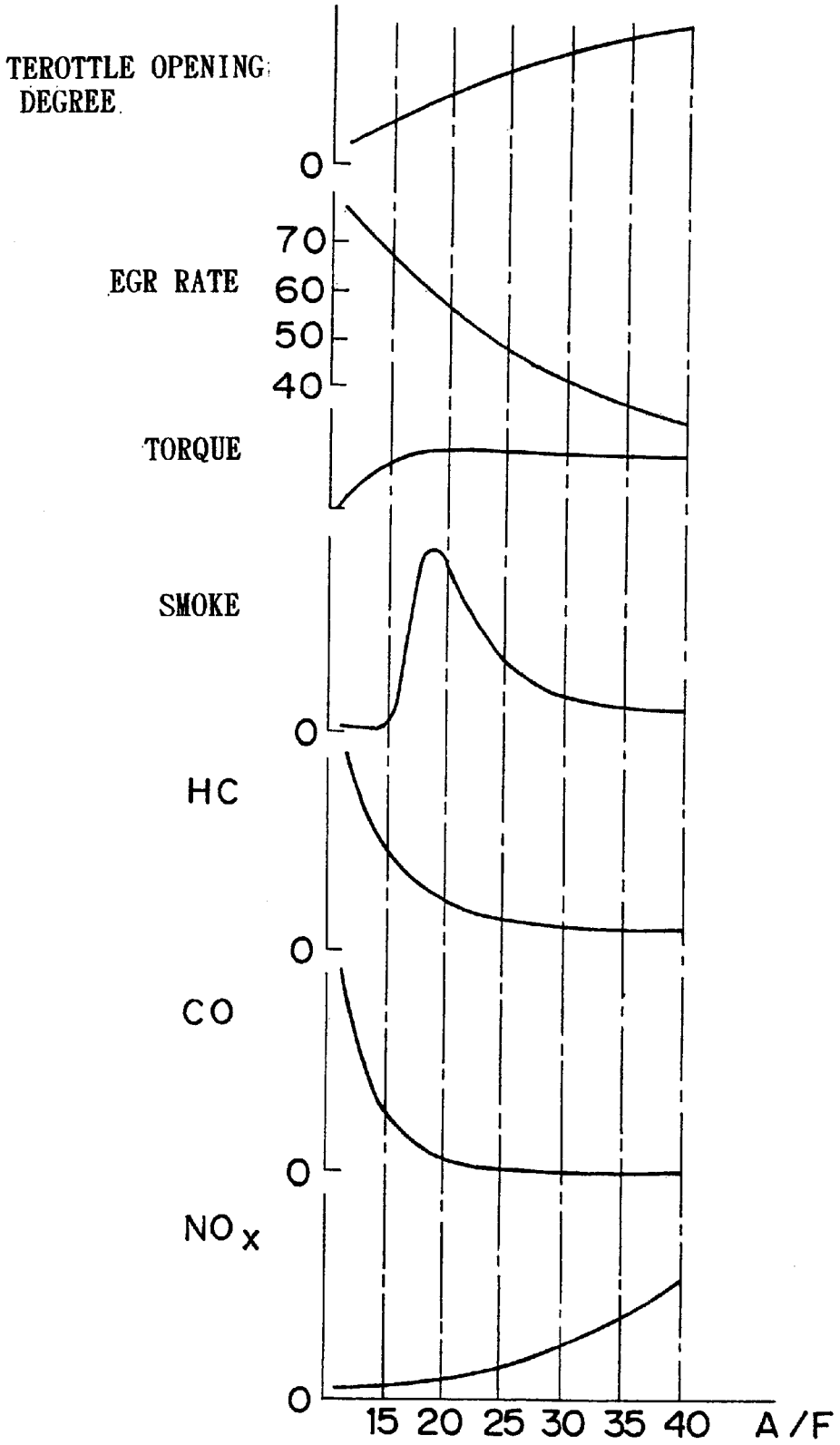
FIG. 2 is a graph showing experimental results of the engine in FIG. 1 relative to an air fuel ratio.

FIG. 2 is a graph showing an experimental result of the change in an output torque, discharge amount of smoke, hydrocarbon HC, carbon monoxide CO and nitrogen oxides NOx with respect to an air fuel ratio A/F that varies by changing an opening degree of the throttle valve 20 and the EGR rate during operation of the engine in FIG. 1 at a low load. As can be understood from the graph of FIG. 2, the smaller the air fuel ratio A/F, the greater the EGR rate. In particular, when the EGR rate is equal to or greater than 65%, the air fuel ratio A/F is equal to or less than a stoichiometric air fuel ratio of approximately 14.6.

As stated above, the air fuel ratio A/F is reduced when the EGR rate is increased. When the air fuel ratio A/F reaches about 30 and the EGR rate is approximately 40%, the amount of smoke generated starts increasing. When the EGR rate is further increased such that the air fuel ratio A/F is reduced, the amount of smoke generated sharply increases to a peak amount after which, when further increasing the EGR rate to reduce the air fuel ratio A/F even further, the amount of smoke generated is suddenly reduced. As such, when the air fuel ratio A/F reaches approximately 15 and the EGR rate is approximately 65% or greater, the amount of smoke generated is substantially 0. In other words, hardly any soot is generated. Simultaneously, when the output torque of the engine is slightly reduced, the amount of nitrogen oxides NOx generated is significantly reduced. Contrarily, the amount of hydrocarbon HC and carbon monoxide CO generated starts to increase at the same time.

Figure 3A:
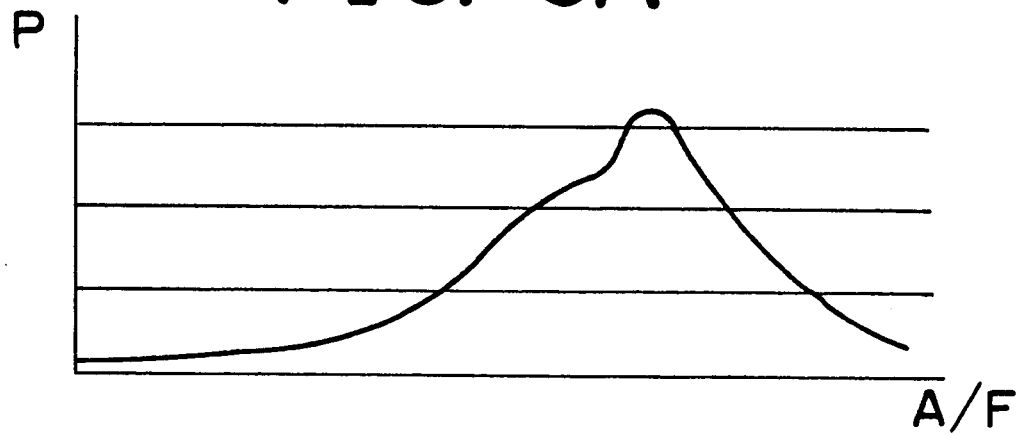
FIG. 3A is a graph showing the change of the pressure within the combustion chamber when the air fuel ratio reaches a point where the largest amount of smoke is generated.
Figure 3B:
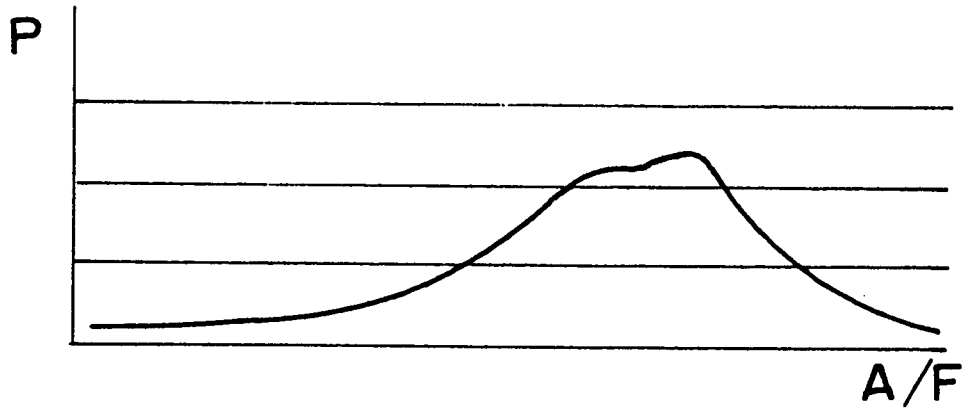
FIG. 3B is a graph showing the change of the pressure within the combustion chamber when the air fuel ratio reaches a point where the least amount of smoke is generated.

FIG. 3A shows the change in the combustion pressure P within the combustion chamber 5 when the air fuel ratio A/F reaches approximately 21 where the largest amount of smoke is generated. FIG. 3B shows the change in the combustion pressure P within the combustion chamber 5 when the air fuel ratio A/F reaches approximately 18 where the amount of smoke generated is substantially 0. As can be understood by comparing FIGS. 3A and 3B, the combustion pressure P in FIG. 3B where the amount of smoke generated is substantially 0 is lower than the combustion pressure P in FIG. 3A where the amount of smoke generated is large.

The following can also be understood from the experimental results shown in FIGS. 2 and 3. First, when the air fuel ratio A/F is approximately equal to or less than 15 and the amount of smoke generated is substantially 0, the amount of nitrogen oxides NOx generated is significantly low, as shown in FIG. 2. The low amount of nitrogen oxides NOx generated indicates the decrease in a combustion temperature within the combustion chamber 5. Therefore, substantially no soot is generated as long as the combustion temperature within the combustion chamber 5 is kept low. The above fact can be applied to the case depicted in FIG. 3B showing a state where soot is hardly generated. That is, the combustion pressure P is low in the above state and the combustion temperature within the combustion chamber 5 is also low.

Figure 4:
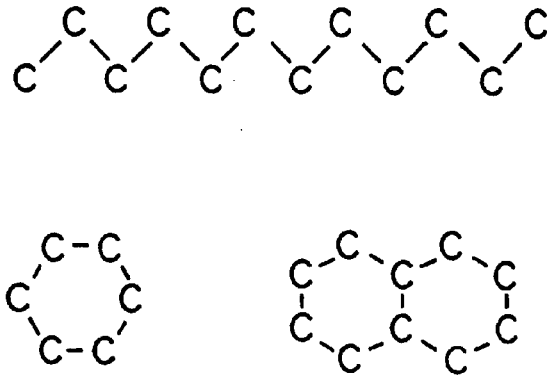
FIG. 4 shows examples of a molecule of a fuel.

Secondly, when the amount of smoke or soot generated is substantially 0, the amount of hydrocarbon HC and carbon monoxide CO discharged increases, as shown in FIG. 2. In other words, the hydrocarbon HC is discharged without evolving into soot. That is, a straight chain hydrocarbon or an aromatic hydrocarbon contained in the fuel, as shown in FIG. 4, will thermally decompose when the temperature is increased in a poor oxygen state, thus taking the form of a precursor of the soot. Thus, the solid soot is produced mainly in the form of an aggregation of carbon atoms. In this case, the actual process of producing the soot is complex and the exact form assumed by the precursor of the soot cannot be clarified. In any event, the hydrocarbons HC shown in FIG. 4 is assumed to generate the precursor and then transform into the soot. Accordingly, as mentioned above, when the amount of soot generated becomes substantially 0, the amounts of hydrocarbon HC and carbon monoxide CO being discharged are increased, as shown in FIG. 2. The hydrocarbon HC at this time is formed as the precursor of the soot or the hydrocarbon HC in the state preceding the precursor.

The following can also be understood from the experimental results shown in FIGS. 2 and 3. That is, when the combustion temperature within the combustion chamber 5 is low, the amount of soot generated becomes substantially 0. Therefore, the precursor of the soot or the hydrocarbon HC in the preceding state is discharged from the combustion chamber 5. As a result of further performing the experiments and research, it becomes clear that the process of generating soot is interrupted. In other words, no soot is generated as long as the temperature of the fuel and the surrounding gas within the combustion chamber 5 is equal to or less than a predetermined temperature. Once the temperature of the fuel and the surrounding gas within the combustion chamber 5 becomes equal to or greater than the predetermined temperature, the soot is generated.

Since the temperature of the fuel and the surrounding gas during the generating process of the hydrocarbon HC is interrupted in a state of the precursor of the soot, that is, the aforementioned predetermined temperature is defined by various factors, e.g., kind of the fuel in use, compression ratio, or the air fuel ratio, the predetermined temperature cannot be specified to an exact value. However, the predetermined temperature is related to the amount of nitrogen oxides NOx generated, and can be derived from the amount of nitrogen oxides NOx generated to a predetermined degree. That is, as the EGR rate is increased, the temperature of the fuel and the surrounding gas at a time of combustion is decreased, thus reducing the amount of nitrogen oxides NOx generated. The soot is barely generated when the amount of nitrogen oxides NOx generated becomes approximately 10 p.p.m. or less. Accordingly, the aforementioned predetermined temperature substantially coincides with the temperature when the amount of nitrogen oxides NOx generated becomes approximately 10 p.p.m. or less.

Once generated, the soot cannot be purified by post-treatment using the catalyst having an oxidation function. Contrarily, the precursor of the soot or the hydrocarbon HC in the preceding state can easily be purified by post-treatment using the catalyst having an oxidation function. In view of the post-treatment by the catalyst having an oxidation function, there is a substantial difference between discharging the hydrocarbon HC from the combustion chamber 5 as the precursor of the soot or the preceding state and discharging the hydrocarbon HC from the combustion chamber 5 as the soot. The structure of the combustion system used in the invention basically focuses on discharging the hydrocarbon HC from the combustion chamber 5 as the precursor of the soot or the preceding state without generating the soot within the combustion chamber 5 and then oxidizing the hydrocarbon HC using the catalyst having the oxidation function.

Further, in order to interrupt the generation of the hydrocarbon HC before generating the soot, to the temperature of the fuel and the surrounding gas during combustion within the combustion chamber 5 must be restricted to a temperature lower than the temperature at which the soot is generated. In this case, it is clearly understood that the endothermic effect of the gas around the fuel during combustion thereof affects the temperature restriction to a substantial degree.

That is, if only air exists around the fuel, the evaporated fuel immediately reacts with the oxygen in the air and is burned. In this case, the temperature of the air apart from the fuel is not increased, rather only the temperature around the fuel is substantially increased. In other words, at this time, the air apart from the fuel hardly perform an endothermic activity with respect to the combustion heat in the fuel. In this case, as the combustion temperature is locally increased to a substantially high value, an unburned hydrocarbon HC subjected to the combustion heat produces the soot.

Contrarily, if the fuel is present in the gas mixture containing a large amount of inert gas and a small amount of air, the condition differs from the above case. In this case, the evaporated fuel diffuses and reacts with the oxygen contained in the inert gas of the mixture and is burned. Since the combustion heat is absorbed into the peripheral inert gas, the combustion temperature is not increased, thus keeping the combustion temperature at a relatively low level. Accordingly, the inert gas plays an important role in restricting the combustion temperature. The endothermic function of the inert gas, thus, makes it possible to keep the combustion temperature relatively low.

In this case, a sufficient amount of the inert gas to absorb the heat is required to restrict the temperature of the fuel and the surrounding gas to the value lower than the temperature at which the soot is generated. Accordingly, the required amount of the inert gas increases as the fuel amount increases. Here, the greater the specific heat of the inert gas becomes, the more the endothermic effect is intensified. It is preferable to use an inert gas exhibiting high specific heat. In view of the above point, carbon dioxide carbon monoxide $CO_2$ or the EGR gas is a preferable choice as the inert gas because of their relatively high specific heat.

Figure 5:
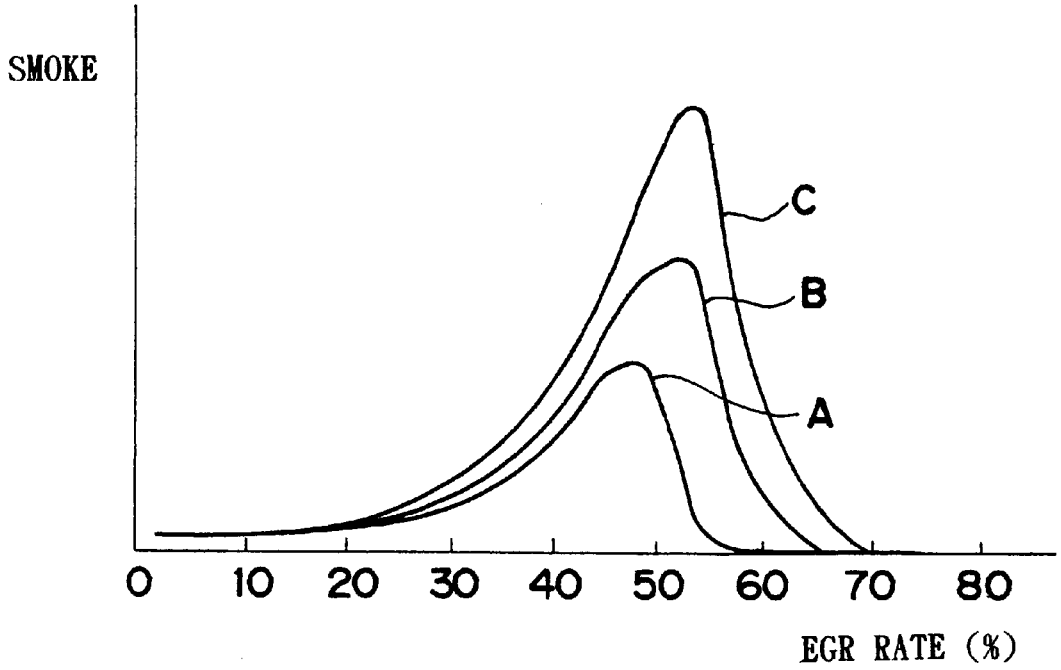
FIG. 5 is a graph showing a relationship between an amount of smoke generated and an EGR rate when the cooling degree of the EGR gas is changed.

FIG. 5 is a graph which shows a relationship between the EGR rate and the amount of smoke generated when changing the cooling degree of the EGR gas as the inert gas. That is, a curve A is derived from keeping the EGR gas temperature to approximately 90° C. by forcibly cooling the EGR gas, a curve B is derived from cooling the EGR gas by a compact cooling apparatus, and a curve C is derived when the EGR gas is not forcibly cooled.

As shown by the curve A, the amount of soot generated reaches a peak amount when the EGR rate is slightly less than 50%. As such, substantially no soot is generated if the EGR rate is set to approximately 55% or greater. Contrarily, as shown by the curve B, the amount of soot generated reaches a peak when the EGR rate is slightly higher than 50%. In this case, substantially no soot is generated if the EGR rate is set to approximately 65% or greater.

Further, as shown by the curve C, the amount of soot generated reaches a peak when the EGR rate is approximately 55%. In this case, substantially no soot is generated if the EGR rate is set to approximately 70% or greater. In essence, FIG. 5 shows the amount of smoke generated at a relatively high engine load. When the engine load becomes small, the EGR rate at which the amount of soot generated reaches its peak is slightly reduced, and a lower limit of the EGR rate at which substantially no soot is generated is slightly reduced as well. As mentioned above, the lower limit of the EGR rate at which substantially no soot is generated may vary depending on the cooling degree of the EGR gas or the engine load, for example.

Figure 6:
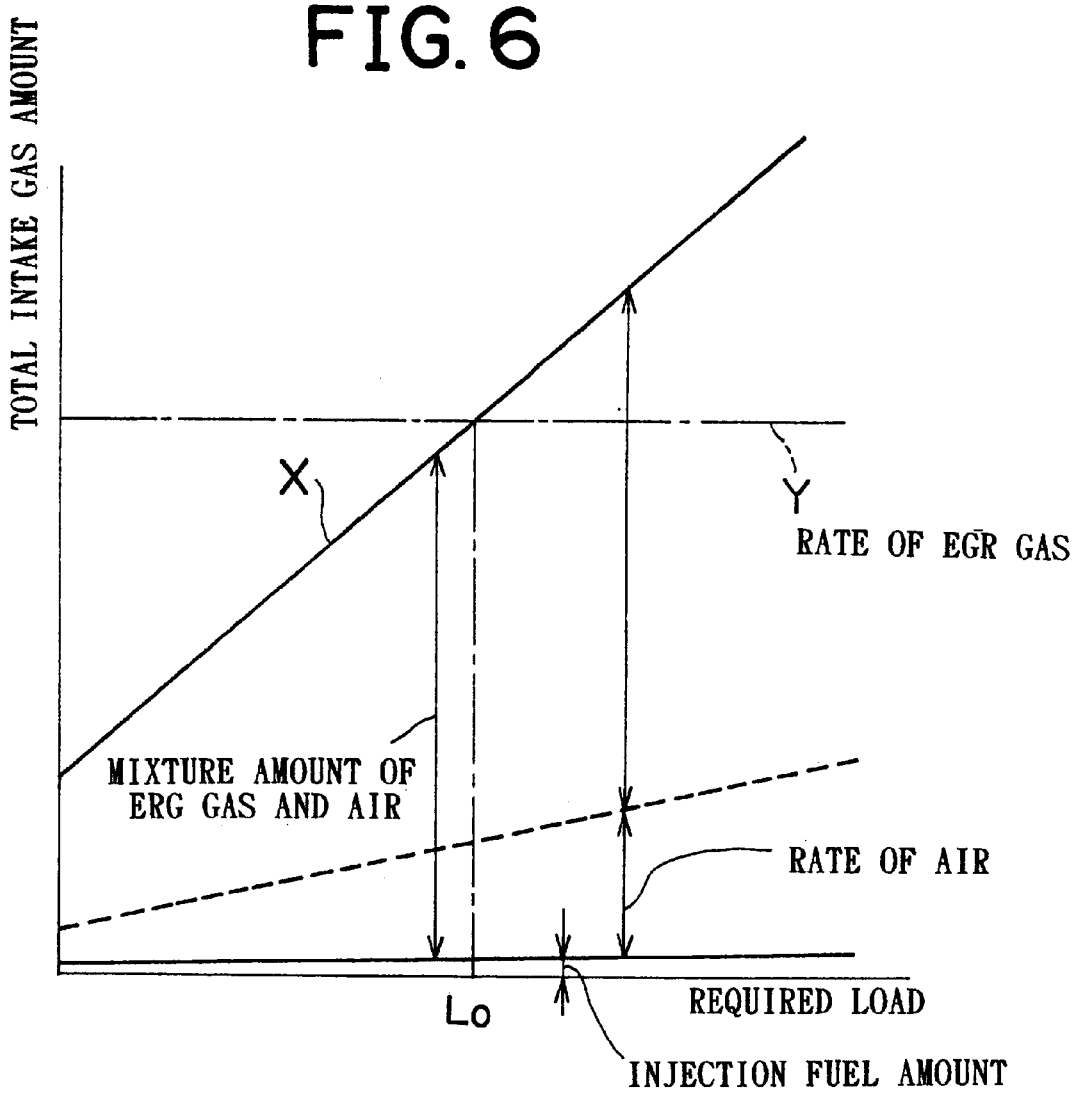
FIG. 6 is a graph showing a relationship between an amount of injected fuel and an amount of a gas mixture.

FIG. 6 is a graph showing the relationship between an amount of injected fuel and an amount of a gas mixture. In particular, the graph in FIG. 6 shows the relationship of the mixture of air and EGR gas as the inert gas required to decrease the temperature of the fuel and surrounding gas during combustion to lower the temperature at which the soot is generated, a rate of the air to the mixture, and a rate of the EGR gas to the mixture gas. In FIG. 6, an ordinate represents a total amount of intake gas introduced into the combustion chamber 5, while a chain line Y shows a total amount of intake gas capable of being introduced within the combustion chamber 5 when supercharging is not performed. Furthermore, the other ordinate of FIG. 6 represents a required load.

Looking at FIG. 6, the rate of the air, that is, the air content in the mixture represents the amount of air required to completely burn the injected fuel. That is, the ratio between the amount of air and the amount of injection fuel corresponds to the stoichiometric air fuel ratio. On the contrary, the rate of the EGR gas, that is, the amount of EGR gas in the mixture gas represents the minimum amount of EGR gas required to establish the temperature of the fuel and the surrounding gas during burning of the injected fuel to be lower than the temperature at which the soot is generated. The amount of EGR gas is substantially equal to or greater than 55% relative to the EGR rate. The amount of EGR gas shown in FIG. 6 is equal to or greater than 70%. Assuming that the total amount of intake gas introduced into the combustion chamber 5 is represented by the solid line X in FIG. 6, and the rate between the amount of air and the amount of EGR gas among the total intake gas amount X is set to the level shown in FIG. 6, the temperature of the fuel and the surrounding gas becomes lower than the temperature at which the soot is generated, thus generating substantially no soot. Further, the amount of nitrogen oxides NOx generated at this time results in a significantly small amount of soot, i.e., approximately 10 p.p.m. or less.

Since the amount of heat generated when the fuel is burned is increased as the amount of fuel injection is increased, the amount of heat absorbed by the EGR gas has to be increased so as to maintain the temperature of the fuel and the surrounding gas to be lower than the temperature at which the soot is generated. Accordingly, as shown in FIG. 6, the amount of EGR gas should be increased along with the increase in the injection fuel amount. That is, the amount of EGR gas should be increased as the required load is increased.

Here, in the case where no supercharging is performed, the upper limit of the total amount of intake gas X is defined by the chain line Y. Therefore, as shown in FIG. 6, when the required load is larger than $L_0$ the air fuel ratio cannot be maintained to the stoichiometric air fuel ratio as the required load becomes higher unless the EGR gas rate is reduced. In other words, when trying to maintain the air fuel ratio to the stoichiometric value in the region where the desired load is larger than $L_0$ when no supercharging is performed, the EGR rate is reduced as the required load becomes high, and accordingly, in the area at the desired load larger than $L_0$, it is impossible to maintain the temperature of the fuel and the surrounding gas to be lower than the temperature at which the soot is generated.

However, as shown in FIG. 1, when recirculating the EGR gas into the inlet side of the supercharger, that is, the air intake pipe 17 of the exhaust turbo charger 15 via the EGR passage 29, in the region where the required load is larger than $L_0$, it is possible to maintain the EGR rate at a level substantially equal to or more than 55%, such as, for example, 70%. Therefore, it is possible to maintain the temperature of the fuel and the surrounding gas to be lower than the temperature at which the soot is generated. That is, when recirculating the EGR gas such that the EGR rate within the air intake pipe 17 becomes, for example, 70%, the EGR rate of the intake gas at the pressure increased by the compressor 16 of the exhaust turbo charger 15 also becomes 70%. Accordingly the temperature of the fuel and the surrounding gas can be maintained to be lower than the temperature at which the soot is generated such that the compressor 16 is allowed to increase the pressure. Accordingly, it is possible to expand an operation range of the engine to produce the low combustion temperature.

As such, when setting the EGR rate to a level substantially equal to or more than 55% in the region where the required load is higher than $L_0$, the EGR control valve 31 is fully opened and the throttle valve 20 is slightly closed.

As mentioned above, FIG. 6 shows the case where the fuel is burned at the stoichiometric air fuel ratio. However, even when setting the air amount to be less than the value shown in FIG. 6, that is, setting the air fuel ratio to a rich state, it is possible to restrict the amount of nitrogen oxides NOx generated to approximately 10 p.p.m. or less while preventing generation of the soot. Meanwhile, even when setting the amount of air to be more than the value shown in FIG. 6, that is, setting an average value of the air fuel ratio to be in the lean state from 17 to 18, it is possible to restrict the amount of nitrogen oxides NOx generated to approximately 10 p.p.m. or less while preventing generation of the soot.

That is, when the air fuel ratio is set to the rich state, the amount of fuel becomes excessive. However, since the combustion temperature is restricted to be low, the excessive fuel does not generate soot, resulting in no generation of soot. At the same time, only a small amount of nitrogen oxides NOx is generated. Meanwhile, when the average air fuel ratio is in a lean state, or even when the air fuel ratio is stoichiometric, a high combustion temperature may lead to production of a small amount of soot. However, in accordance with the invention, as the combustion temperature is kept low, no soot is generated. Additionally the amount of nitrogen oxides NOx is substantially small.

As mentioned above, as long as the combustion temperature is low, substantially no soot is generated irrespective of the air fuel ratio, which may be rich, lean, or stoichiometric. Accordingly, it is preferable to set the average air fuel ratio to a lean value for improving fuel consumption.

The temperature of the fuel and the surrounding gas during combustion in the combustion chamber can be restricted to be lower than the temperature at which the hydrocarbon HC growth is interrupted only when the engine is operated at a middle or low load where the amount of heat generated by the combustion is relatively small. Accordingly, in the first embodiment of the invention, during the middle or low load engine operation, the temperature of the fuel and the surrounding gas during combustion is limited to be substantially equal to or less than the temperature at which the growth of the hydrocarbon HC is interrupted such that the first combustion, that is, the low temperature combustion is conducted. Meanwhile, during the high load engine operation, the second combustion, that is, the conventional combustion is conducted. In this case, the first combustion, that is, the low temperature combustion means a combustion in which the amount of the inert gas within the combustion chamber is greater than that of the inert gas at a time when the amount of soot generated reaches the peak, thus generating substantially no soot, as is apparent from the above explanation. The second combustion, that is, the conventional combustion means a combustion in which the amount of the inert gas within the combustion chamber is smaller than the amount of the inert gas at a time when the amount of soot generated reaches the peak amount.

Next, the description will be given with respect to the operation area of the engine which can perform the first combustion, that is, the low temperature combustion, with reference to FIGS. 7A and 7B. In this case, in FIGS. 7A and 7B, the ordinate TQ indicates a required torque and the abscissas N indicates an engine speed.

Figure 7A:
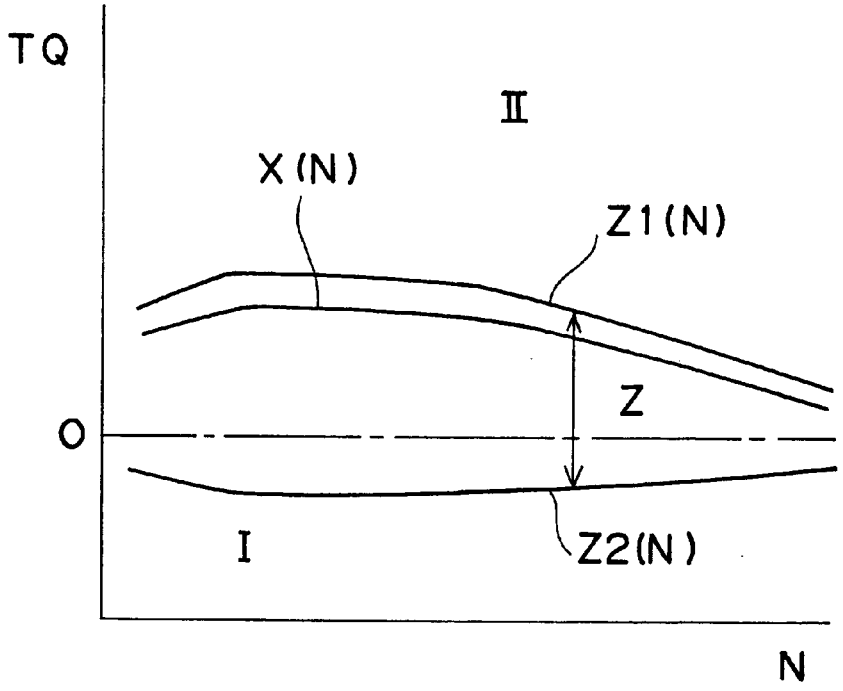
FIG. 7A is a graph showing the relationship between the required torque and engine speed during the first combustion and the operation areas therein.
Figure 7B:
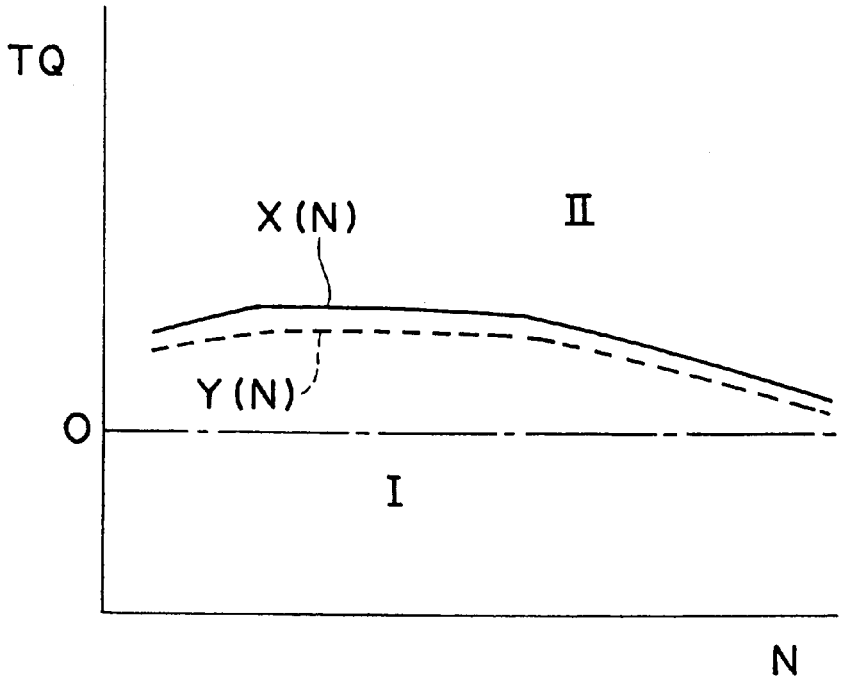
FIG. 7B is a graph showing the relationship between the required torque and engine speed during the first combustion and the operation areas therein.

FIG. 7B depicts a first operation area I where the low temperature combustion is performed at a substantially stoichiometric or lean air fuel ratio, and a second operation area II where the conventional combustion has to be conducted because the low temperature combustion cannot be accomplished at the substantially stoichiometric or lean air fuel ratio.

In FIG. 7B, X(N) represents a first boundary between the first operation area I where the low temperature combustion is performed and the second operation area II and Y(N) represents a second boundary between the first operation area I and the second operation area II. The transition of the operation area from the first operation area I to the second operation area II is determined on the basis of the first boundary X(N), and the transition of the operation area from the second operation area II to the first operation area I is determined on the basis of the second boundary Y(N).

That is, in accordance with the first embodiment of the present invention, when the operation state of the engine is in the first operation area I shown in FIG. 7B, low temperature combustion is performed. At this time, when the required torque TQ exceeds the first boundary X(N), which corresponds to a function of the engine speed N, the operation state of the engine goes to the second operation area II, and performs the conventional combustion. Next, when the required torque TQ becomes lower than the second boundary Y(N), which corresponds to a function of the engine speed N, the operation state of the engine goes to the first operation area I, and performs the low temperature combustion again.

As mentioned above, two boundaries including the first boundary X(N) and the second boundary Y(N), which is closer to the lower load compared with the first boundary X(N), are provided for the following two reasons. First, because of the combustion temperature on the higher torque side in the second operation area II, the low temperature combustion cannot immediately be performed, even when the required torque TQ becomes lower than the first boundary X(N). In other words, the low temperature combustion cannot start immediately because the low temperature combustion starts only when the required torque TQ becomes significantly low, that is, lower than the second boundary Y(N). Second, a hysteresis is provided with respect to the change of the operation area between the first operation area I and the second operation area II.

In addition to the first boundary X(N) shown in FIGS. 7A and 7B, there is a third or load limit operation area Z where low temperature combustion can be performed when the air fuel ratio is made significantly rich, such as, for example, when the air fuel ratio is made smaller than 13.5%. In particular, there is a high load side limit Z1(N) and a low load side limit Z2(N) in the third operation area Z. As is understood from FIG. 7A, the high and low load limits Z1(N) and Z2(N) are functions of the engine speed N.

Looking back to FIG. 7B, it can be seen that there is no limit close to the low load side in the first operation area I in which the low temperature combustion can be performed when the air fuel ratio is substantially equal to the theoretical air fuel ratio or in the lean state. Contrarily, the low load side limit Z2(N) of the third operation area Z in which the low temperature combustion can be performed when the air fuel ratio is significantly rich is present in a region where the required torque TQ is negative. Accordingly, it is understood that the low load side limit Z2(N) of the third operation area Z in which the low temperature combustion can be performed goes to the high load side as the air fuel ratio becomes smaller.

Further, as shown in FIG. 7A, the high load side limit Z1(N) of the third operation area Z where the low temperature combustion can be performed at substantially rich air fuel ratio is at the high load side in comparison with the high load side limit X(N) of the first operation area I where the low temperature combustion can be performed at substantially the stoichioimetric or lean air fuel ratio. Accordingly, it is understood that the third operation area Z where the low temperature combustion can be performed goes to the high load side as the air fuel ratio becomes smaller.

That is, the low temperature combustion can be performed irrespective of whether the air fuel ratio is in a rich state or a lean state, as mentioned above. However, when the amount of fuel injection is significantly small and the air fuel ratio is set to a significantly rich state, a misfire is generated. As a result, effective low temperature combustion cannot be performed. That is, even when the fuel injection amount is significantly small, the fuel is positively burned in the presence of a sufficient amount of air around the fuel particles as long as the air fuel ratio is set to the lean state. Contrarily, when the air fuel ratio is set to a significantly rich state, a sufficient amount of air does not exist around the fuel particles, thus failing to burn the fuel positively. Therefore, when the fuel injection amount is significantly small, the temperature and pressure during combustion are not sufficiently increased, resulting in the misfire.

In FIG. 7A, the area where the required torque TQ is negative indicates the deceleration operation time, wherein the amount of fuel injection is extremely small. Accordingly, the low load side limit Z2(N) of the third operation area Z is in the region where the required torque TQ is negative.

Meanwhile, in a state where the low temperature combustion is performed near the first boundary X(N), when the air fuel ratio is set to a rich state, the torque is increased by an amount corresponding to the increased amount of the fuel. Accordingly, the high side load limit Z1(N) approaches the high load side closer than the first boundary X(N).

In a state where the engine operation is in the first operation area I or the third operation area Z and the low temperature combustion is performed, substantially no soot is generated, but unburned hydrocarbon HC is discharged from the combustion chamber 5 as the precursor of the soot or the form preceding thereto. The unburned hydrocarbon HC discharged from the combustion chamber 5 is well oxidized by the catalyst 25 having an oxidization function.

An oxidation catalyst, a three-way catalyst or an nitrogen oxides NOx absorbent can be used as the catalyst 25. The nitrogen oxides NOx absorbent absorbs nitrogen oxides NOx when the average air fuel ratio within the combustion chamber 5 is in the lean state, and desorbs nitrogen oxides NOx when the average air fuel ratio within the combustion chamber 5 is in the rich state.

The nitrogen oxides NOx absorbent is formed of a carrier, such as, for example, an alumina on which a noble metal such as platinum Pt and at least one element selected from an alkaline metal (potassium K, sodium Na, lithium Li, cesium Cs or the like), an alkaline earth metal (barium Ba, calcium Ca, or the like), and a rare earth metal (lanthanum La, yttrium Y, or the like) are carried.

Besides the oxidation catalyst, the three-way catalyst and the nitrogen oxides NOx absorbent have the oxidation function. Therefore, the three-way catalyst and the nitrogen oxides NOx absorbent can also be used as the catalyst 25.

Next, referring to FIG. 8, the description will be given with respect to the operation control in the first operation area I and the second operation area II when performing the low temperature combustion at the substantially stoichiometric or lean air fuel ratio.

Figure 8:
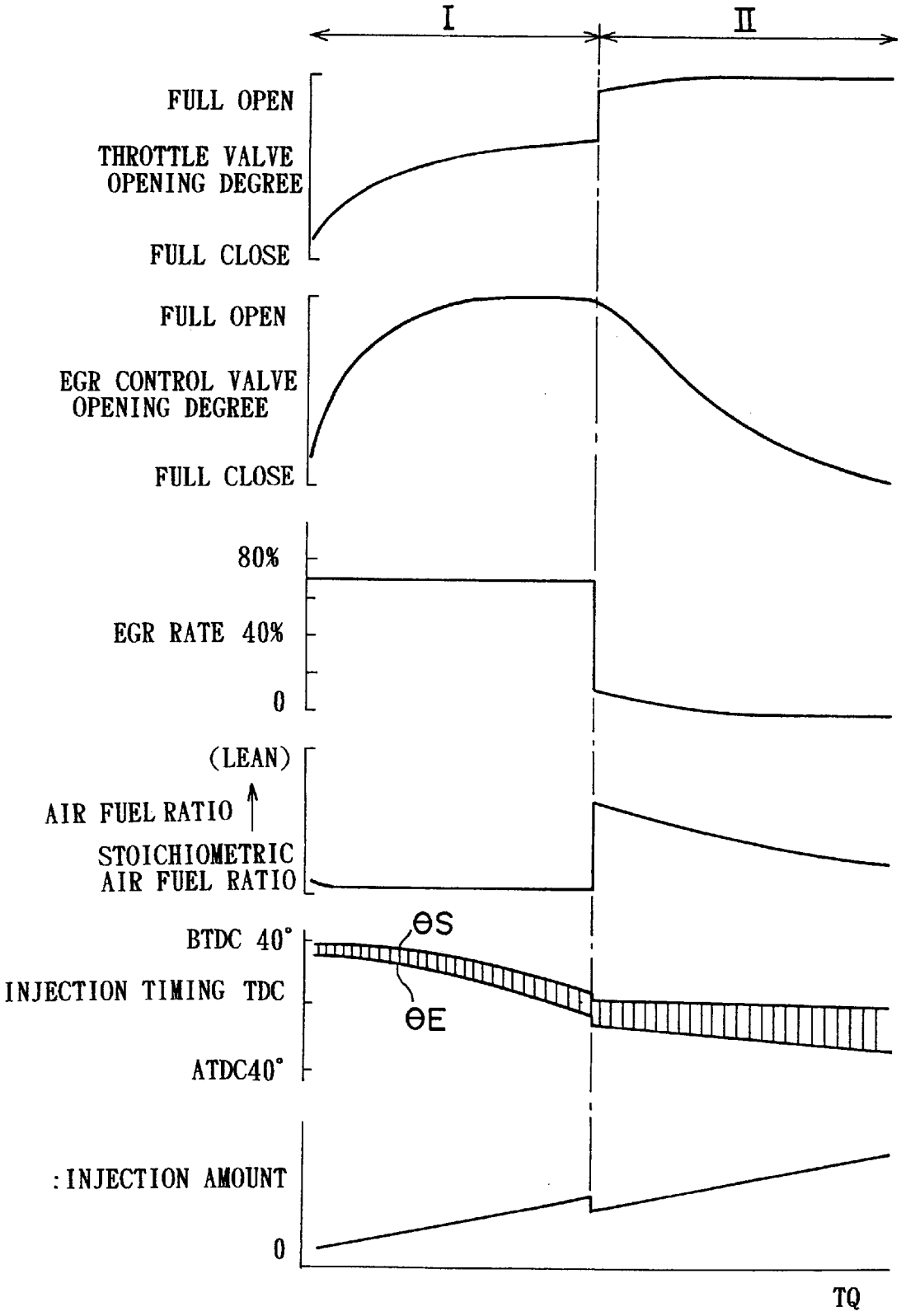
FIG. 8 is a graph showing experimental results of the engine in FIG. 1 relative to a required torque.

FIG. 8 shows a relation among an opening degree of the throttle valve 20 with respect to the required torque TQ, an opening degree of the EGR control valve 31, an EGR rate, an air fuel ratio, an injection timing, and an injection amount. In the first operation area I, the opening degree of the throttle valve 20 is gradually increased from a nearly full close state to about ⅔ of the opening degree as the required torque TQ is increased. Likewise, the opening degree of the EGR control valve 31 is gradually increased from a nearly full close state to a full open state as the required torque TQ is increased. Furthermore, the EGR rate is set to substantially 70% in the first operation area I, while the air fuel ratio is set to a slight lean state.

That is, in the first operation area I, the opening degree of the throttle valve 20 and the opening degree of the EGR control valve 31 are controlled such that the EGR rate becomes approximately 70% and the air fuel ratio is in the slight lean state. In the first operation area I, fuel injection is performed prior to compression at a top dead center TDC. In this case, an injection start timing θS is delayed as the required load L becomes high, and an injection end timing θE is also delayed as the injection start timing θS is delayed.

Further, during idling operation, the throttle valve 20 and EGR control valve 31 are simultaneously nearly in the full close state. When closing the throttle valve 20 to the nearly a full close state, a pressure within the combustion chamber 5 at the beginning of the compression becomes low, thus reducing the compression pressure. When the compression pressure is lowered, compression work executed by the piston 4 is reduced to decrease vibration of the engine main body 1. That is, during idling operation, in order to restrict the vibration of the engine main body 1, the throttle valve 20 is closed nearly to the full close state.

Contrarily, the operation area of the engine shifts from the first operation area I to the second operation area II, and the throttle valve 20 is increased stepwise from about ⅔ of the opening degree to the full open state. At this time, the EGR rate is decreased stepwise from approximately 70% to 40% or less, thereby increasing the air fuel ratio. That is, as the EGR rate skips over the EGR rate range (FIG. 5) where a large amount of smoke is generated, the generation of such smoke can be prevented when the operation area of the engine shifts from the first operation area I to the second operation area II.

In the second operation area II, the second combustion, that is, the conventional combustion is performed. The aforementioned combustion generates small amounts of soot and nitrogen oxides NOx, however, the heat efficiency is higher than that of the low temperature combustion, or first combustion. When the operation area of the engine shifts from the first operation area I to the second operation area II, the injection amount is decreased stepwise. In the second operation area II, the throttle valve 20 is kept in the full open state with a few exceptions, and the opening degree of the EGR control valve 31 is gradually reduced as the required torque TQ becomes high. Furthermore, in the second operation area II, the EGR rate becomes low as the required torque TQ becomes high, and the air fuel ratio becomes small as the required torque TQ becomes high. However, the air fuel ratio is set to the lean air fuel ratio even when the required torque TQ becomes high. Further, in the second operation area II, the injection start timing θS is set near the compression top dead center TDC.

Figure 9A:
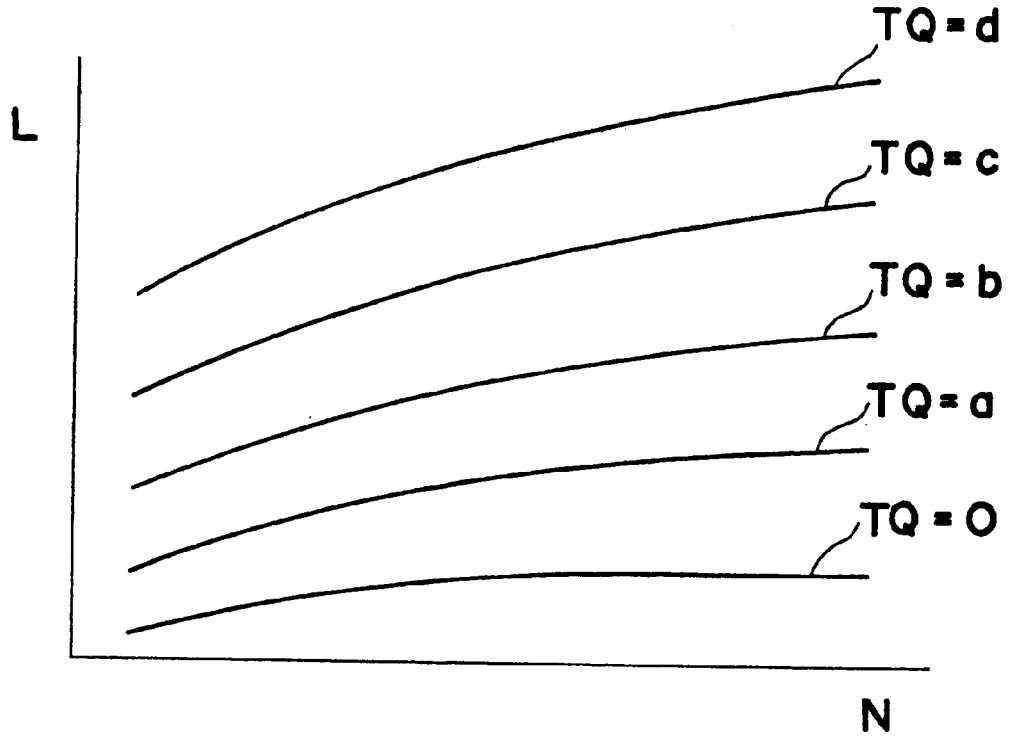
FIG. 9A is a graph showing a relationship between the required torque relative to the depression amount and engine speed
Figure 9B:
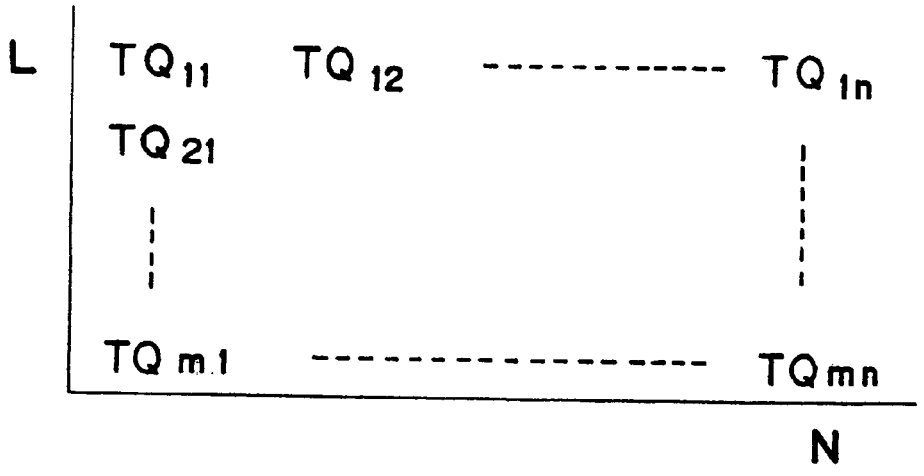
FIG. 9B is a map used to calculate the required torque relative to the depression amount and engine speed.

FIG. 9A is a graph showing a relationship between the required torque TQ relative to the depression amount L of the acceleration pedal 50 and the engine speed N. Each curve of FIG. 9A represents a uniform torque curve. The curve showing TQ=0 indicates that the torque is 0, and in the remaining curves, the required torque TQ is gradually increased in the order of TQ=a, TQ=b, TQ=c and TQ=d. Further, TQ=−f and TQ=−g indicate the case where the required torque is negative, that is, decelerating operation, and in this case, the required torque of TQ=−g is smaller than the torque of TQ=−f. The required torque TQ shown in FIG. 9A has been previously stored in the ROM 42 in the form of a map as a function between the depression amount L of the acceleration pedal 50 and the engine speed N, as shown in FIG. 9B. In the first embodiment of the invention, the required torque TQ corresponding to the depression amount L of the acceleration pedal 50 and the engine speed N is calculated first from the map shown in FIG. 9B, and the target air fuel ratio and the like can be calculated on the basis of the required torque TQ.

The high load side limit of the first operation area I where the low temperature combustion can be performed varies with the temperature of the gas within the combustion chamber 5, the temperature of the inner wall surface of the cylinder and the like at the beginning of compression. That is, when the required torque TQ becomes high and the heat generated by the combustion is increased, the temperature of the fuel and the surrounding gas thereof during combustion becomes high, thus failing to perform the low temperature combustion. Contrarily, when the gas temperature TG within the combustion chamber 5 at the beginning of the compression becomes low, the temperature of the gas within the combustion chamber 5 immediately before the start of combustion becomes low so that the temperature of the fuel and the surrounding gas during combustion also becomes low. Accordingly, if the gas temperature TG within the combustion chamber 5 at the beginning of the compression becomes low, the temperature of the fuel and the surrounding gas during combustion is not increased even when the heat generated by the combustion is increased, that is, the required torque TQ becomes high, performing the low temperature combustion. In other words, as the gas temperature TG within the combustion chamber 5 at the beginning of compression becomes lower, the first operation area I where the low temperature combustion can be performed is expanded toward the high load side.

Further, the smaller the temperature difference (TW−TG) between the cylinder inner wall temperature TW and the gas temperature TG within the combustion chamber 5 at the beginning of the compression becomes, the more the generated heat escapes via the inner wall surface of the cylinder as the compression stroke is increased. Accordingly, the smaller the temperature difference (TW−TG) becomes, the smaller the temperature increase amount of the gas within the combustion chamber 5 during the compression stroke becomes, so that the temperature of the fuel and the surrounding gas during combustion is lowered. Therefore, as the temperature difference (TW−TG) is smaller, the first operation area I where the low temperature combustion can be performed is expanded to the high load side.

On the contrary, as the pressure within the intake passage, such as, for example, the surge tank 12 becomes lower, the compression pressure within the combustion chamber 5 becomes low. Accordingly, the temperature of the fuel and the surrounding gas during combustion is lowered. As a result, as the pressure within the surge tank 12 is lowered, the first operation area I where the low temperature combustion can be performed is expanded toward the high load side. Furthermore, as the humidity of the intake air becomes higher, an endothermic amount of moisture contained in the intake air is increased. Thus, the temperature of the fuel and the surrounding gas during combustion is lowered. Accordingly, as the humidity in the intake air becomes higher, the first operation area I where the low temperature combustion can be performed is expanded toward the high load side.

Figure 10:
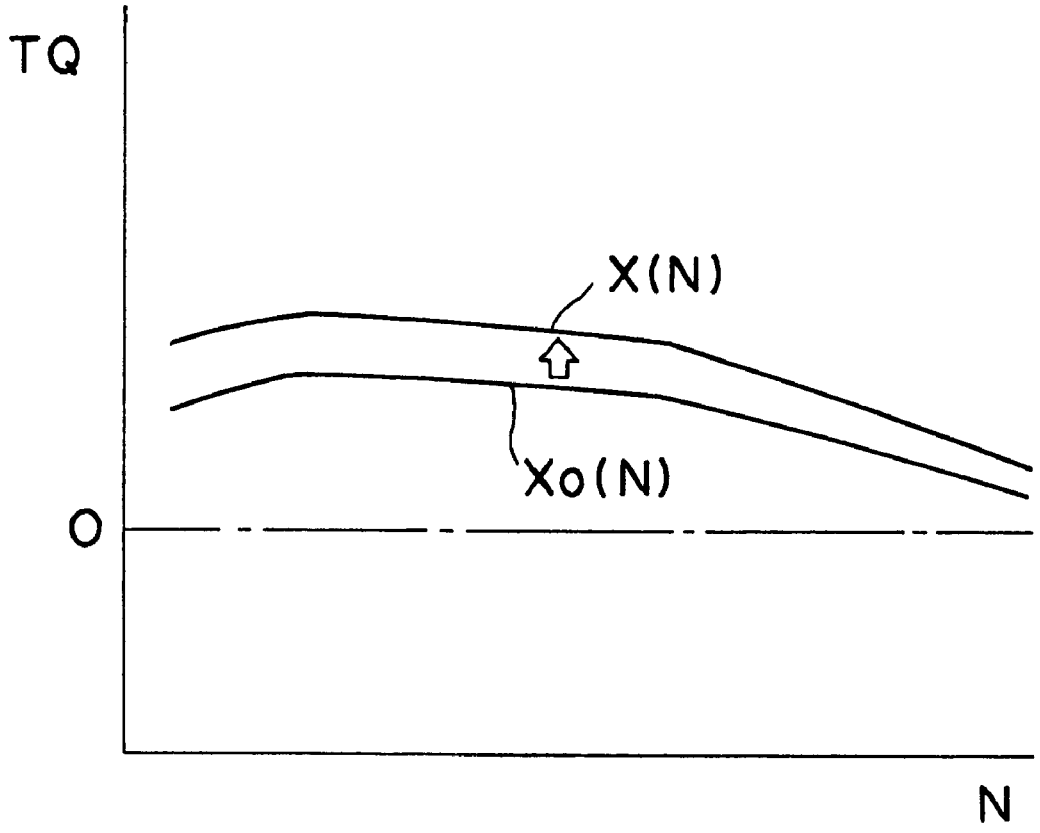
FIG. 10 is a graph showing a shifting of the first boundary relative to the required torque and engine speed.
Figure 11A:
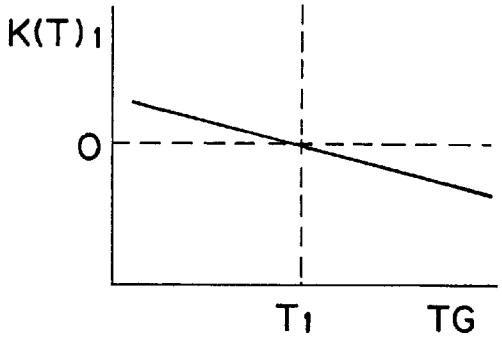
FIG. 11A is a graph showing a first value $K(T)_1$ as a function of a gas temperature with the combustion chamber.
Figure 11B:
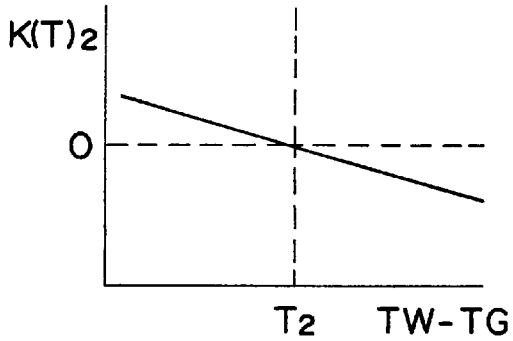
FIG. 11B is a graph showing a second value $K(T)_2$ as a function of a temperature difference.
Figure 11C:
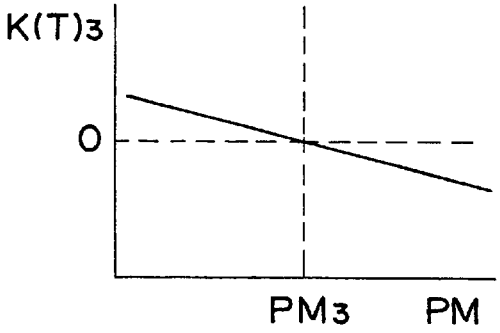
FIG. 11C is a graph showing a third value $K(T)_3$ as a function of a pressure within the surge tank.
Figure 11D:
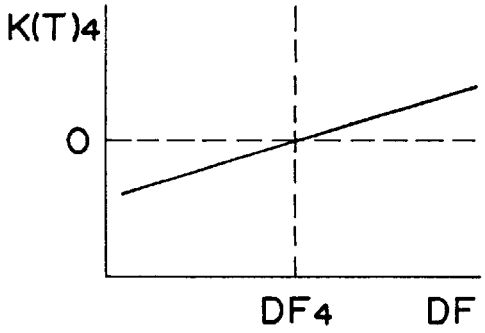
FIG. 11D is a graph showing a fourth value $K(T)_4$ as a function of a humidity.

In accordance with the first embodiment of the present invention, when the gas temperature TG within the combustion chamber 5 at the beginning of the compression becomes low, the first boundary is shifted from Xo(N) to X(N), as shown in FIG. 10. When the temperature difference (TW−TG) is reduced, the first boundary is shifted from Xo(N) to X(N). Furthermore, in the first embodiment in accordance with the invention, when the pressure PM within the surge tank 12 is reduced, the first boundary also shifts from Xo(N) to X(N), and when a humidity DF in the intake air becomes high, the first boundary also is shifted from Xo(N) to X(N). In this case, the Xo(N) indicates the reference first boundary. The reference first boundary Xo(N) is a function of the engine speed N, and the boundary X(N) is calculated on the basis of the following formula using the reference boundary Xo(N):

$$X(N)=Xo(N)+C1\cdot K(T)\cdot K(N)$$

$$K(T)=K(T)_1+K(T)_2+K(T)_3+K(T)_4$$

where C1 is a constant, $K(T)_1$ is a function of the gas temperature TG within the combustion chamber 5 at the beginning of the compression, as shown in FIG. 11A. A value of $K(T)_1$ becomes greater as the gas temperature TG within the combustion chamber 5 at the beginning of the compression becomes lower. Further, $K(T)_2$ is a function of the temperature difference (TW−TG), as shown in FIG. 11B. A value of $K(T)_2$ becomes greater as the temperature difference (TW−TG) becomes smaller. Still further, $K(T)_3$ is a function of a pressure PM within the surge tank 12, as shown in FIG. 11C. A value of $K(T)_3$ becomes greater as the pressure PM within the surge tank 12 becomes lower. $K(T)_4$ is a function of a humidity DF, as shown in FIG. 11D. A value of $K(T)_4$ becomes greater as the humidity DF becomes higher. Looking at FIGS. 11A to 11D, T1 is a reference temperature, T2 is a reference temperature difference, PM3 is a reference pressure, DF4 is a reference humidity, and the first boundary becomes Xo(N) in FIG. 10 when the relation TG=T1, (TW−TG)=T2, PM=PM3 and DF=DF4 is established.

Figure 11E:
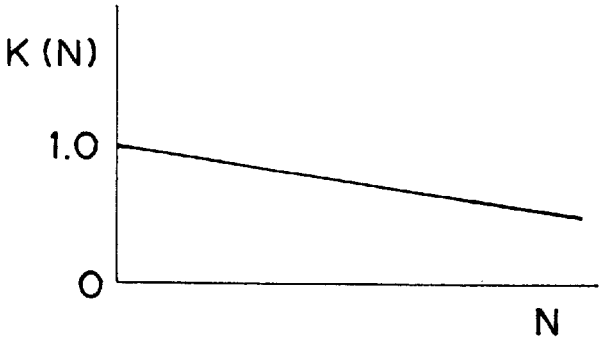
FIG. 11E is a graph showing a fifth value K(N) as a function of the engine speed.

Furthermore, K(N) is a function of the engine speed N, as shown in FIG. 11E. A value of K(N) becomes smaller as the engine speed N becomes higher. That is, when the gas temperature TG within the combustion chamber at the beginning of the compression becomes lower than the standard temperature T1, the first boundary X(N) shifts to the high load side with respect to Xo(N) as the gas temperature TG within the combustion chamber 5 at the beginning of the compression becomes lower. When the temperature difference (TW−TG) becomes lower than the standard temperature difference T2, the first boundary X(N) shifts to the high load side with respect to Xo(N) as the temperature difference (TW−TG) becomes smaller. Furthermore, when the pressure PM within the surge tank 12 becomes lower than the reference pressure PM3, the first boundary X(N) shifts to the high load side with respect to Xo(N) as the pressure within the surge tank 12 becomes lower. When the humidity DF becomes greater than the reference humidity DF4, the first boundary X(N) shifts to the high load side with respect to Xo(N) as the humidity DF becomes higher. Still further, a moving amount of X(N) with respect to Xo(N) becomes smaller as the engine speed N becomes higher.

Figure 12A:
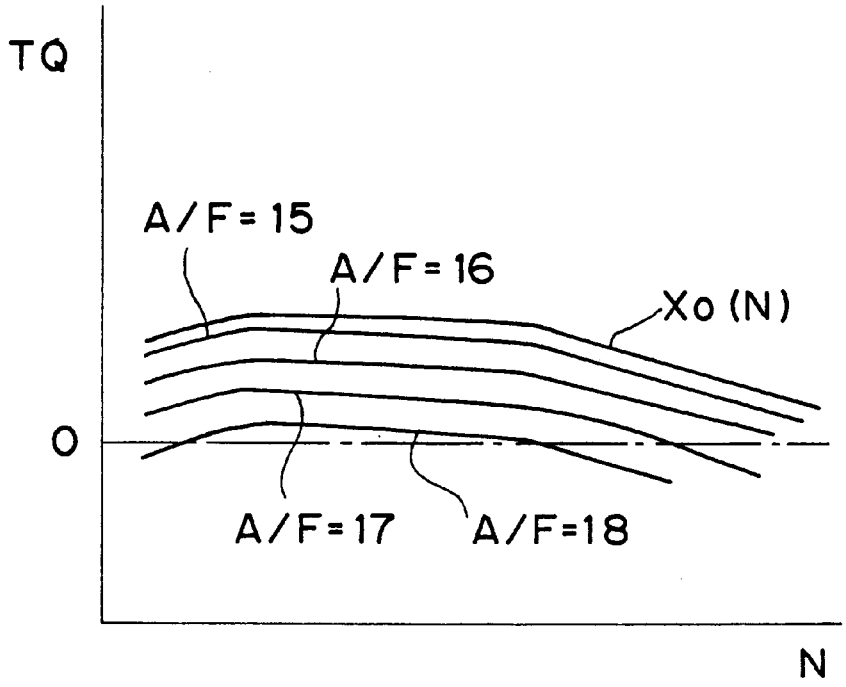
FIG. 12A is a graph showing a target air fuel ratio in the first operation area having a reference first boundary.

FIG. 12A shows an air fuel ratio A/F in the first operation area I where the first boundary is the reference first boundary Xo(N). In FIG. 12A, curves indicated by A/F=15, A/F=16, A/F=17 and A/F=18 show the states where the respective air fuel ratios assume the values of 15, 16, 17 and 18. Each of the air fuel ratios between those curves is prorated. As shown in FIG. 12A, the air fuel ratio becomes lean in the first operation area I, and further leaner as the required load L is lowered.

That is, the amount of heat generated by the combustion is reduced as the required load L is lowered. Accordingly, the low temperature combustion can be performed as the required load L is lowered, even if the EGR rate is reduced. When reducing the EGR rate, the air fuel ratio increases and, as shown in FIG. 12A, the air fuel ratio A/F is set to a greater value as the required load L becomes low. As the air fuel ratio A/F becomes greater, the fuel consumption is improved. Therefore in the first embodiment, the air fuel ratio A/F is set to a greater value as the required load L is lowered so as to make the air fuel ratio as lean as possible.

Figure 12B:
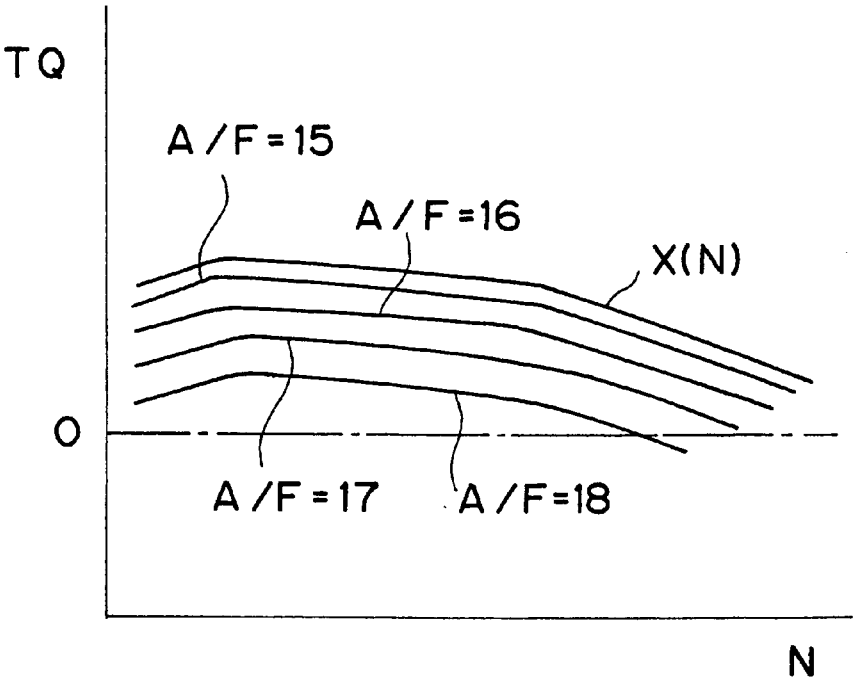
FIG. 12B is a graph showing a target air fuel ratio in the first operation area to when the first boundary shifts to the high load side relative to the reference first boundary.

FIG. 12B shows an air fuel ratio A/F in the first operation area I where the first boundary is X(N), as shown in FIG. 10. As is understood by comparing FIG. 12A with FIG. 12B, when the first boundary X(N) shifts to the high load side relative to Xo(N), the curves indicated by A/F=15, A/F=16, A/F=17 and A/F=18, respectively, showing the air fuel ratios thereof, shift to the high load side. Accordingly, it is understood that when the first boundary X(N) shifts to the high load side relative to Xo(N), the air fuel ratio A/F at the same required load L and the same engine speed N becomes greater. That is, when the first operation area I is expanded toward the high load side, the operation area for generating substantially no soot or nitrogen oxides NOx is expanded, and fuel consumption is improved as well.

In accordance with the first embodiment of the invention, the target air fuel ratio in the first operation area I when the first boundary X(N) changes is in a wide range. In other words, the target air fuel ratio in the first operation area I with respect to various values of K(T) has been previously stored within the ROM 42 in the form of a map as a function of the required torque TQ and the engine speed N, as shown in FIGS. 13A to 13D. That is, FIG. 13A shows a target air fuel ratio AFKT1 when a value of K(T) is KT1. FIG. 13B shows a target air fuel ratio AFKT2 when a value of K(T) is KT2. FIG. 13C shows a target air fuel ratio AFKT3 when a value of K(T) is KT3. FIG. 13D shows a target air fuel ratio AFKT4 when a value of K(T) is KT4.

The target opening degree of the throttle valve 20 necessary for setting the air fuel ratio to the target air fuel ratio has been previously stored within the ROM 42 in the form of a map as a function of the required torque TQ and the engine speed N as shown in FIGS. 14A to 14D. The target opening degree of the EGR control valve 31 necessary for setting the air fuel ratio to the target air fuel ratio has been previously stored within the ROM 42 in the form of a map as a function of the required torque TQ and the engine speed N, as shown in FIGS. 15A to 15D.

Figure 14A:
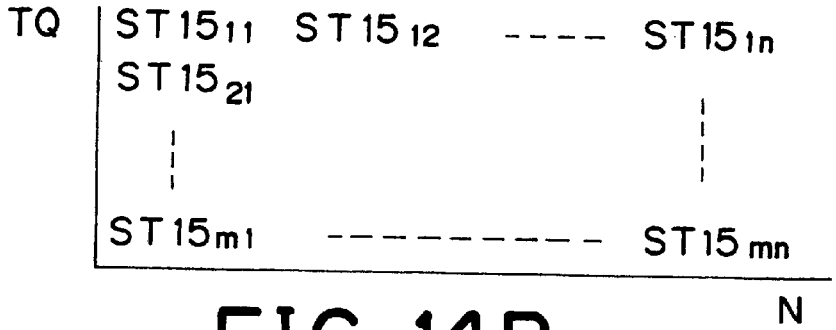
FIGS. 14A–D are maps of various values of target opening degrees of the throttle valve.
Figure 14B:
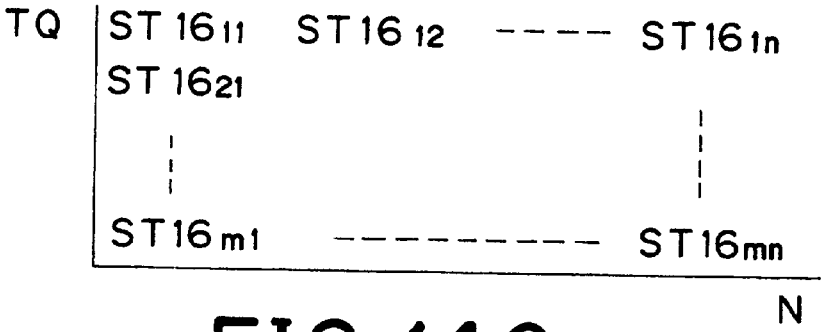
Figure 14C:
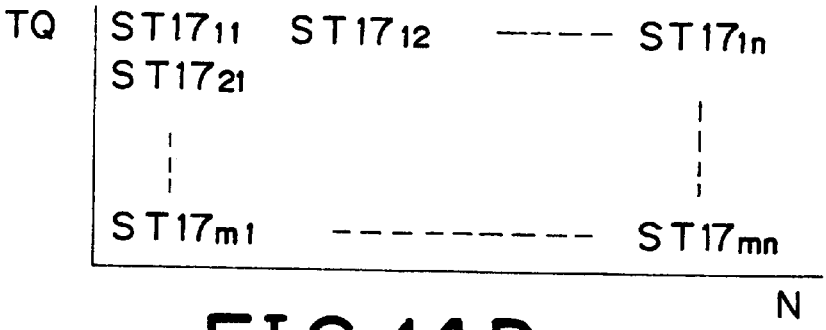
Figure 14D:
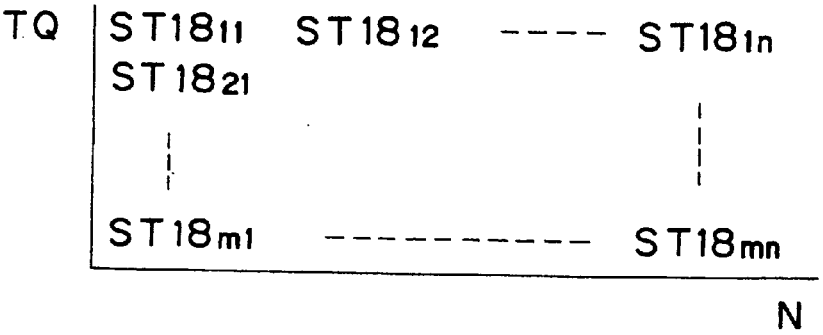
Figure 15A:
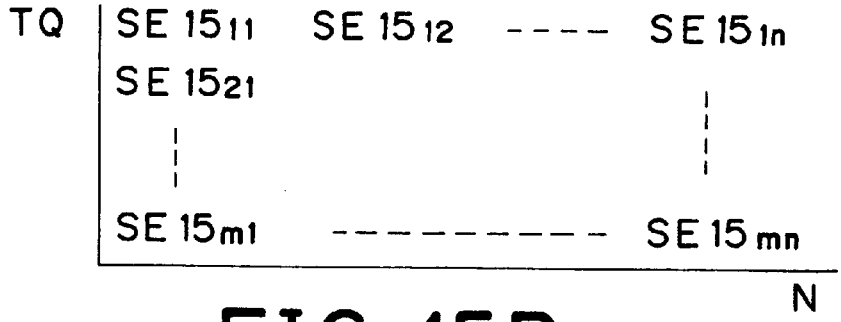
FIGS. 15A–D are maps of various values of target opening degrees of the EGR control valve.
Figure 15B:
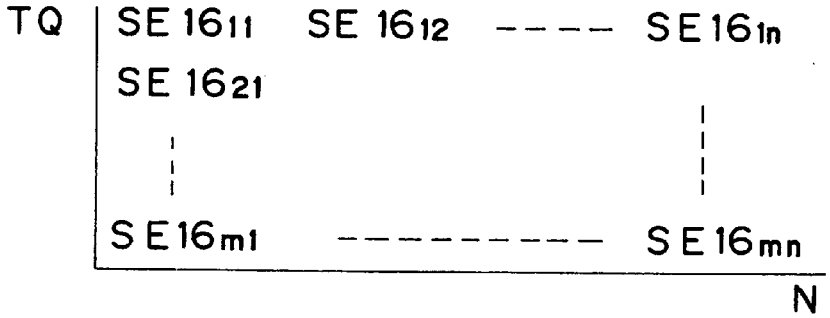
Figure 15C:
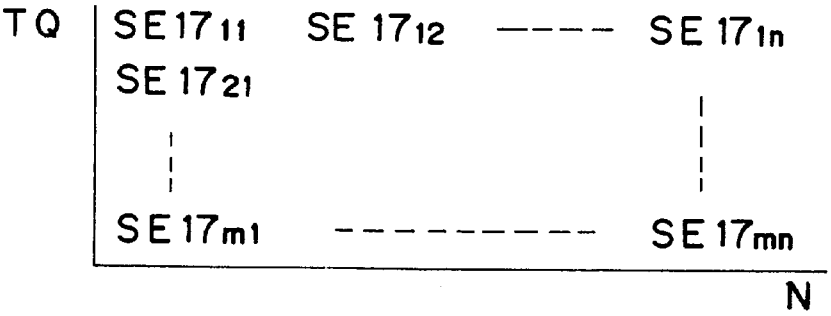
Figure 15D:
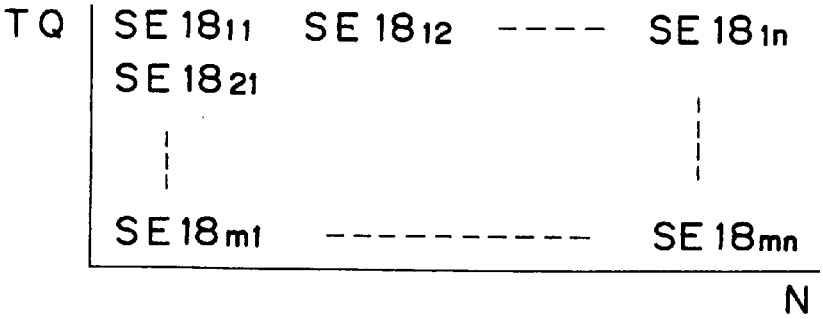

That is, FIG. 14A shows a target opening degree ST15 of the throttle valve 20 when the air fuel ratio is 15, and FIG. 15A shows a target opening degree SE15 of the EGR control valve 31 when the air fuel ratio is 15. Further, FIG. 14B shows a target opening degree ST16 of the throttle valve 20 when the air fuel ratio is 16, and FIG. 15B shows a target opening degree SE16 of the EGR control valve 31 when the air fuel ratio is 16. Still further, FIG. 14C shows a target opening degree ST17 of the throttle valve 20 when the air fuel ratio is 17, and FIG. 15C shows a target opening degree SE17 of the EGR control valve 31 when the air fuel ratio is 17. Furthermore, FIG. 14D shows a target opening degree ST18 of the throttle valve 20 when the air fuel ratio is 18, and FIG. 15D shows a target opening degree SE18 of the EGR control valve 31 when the air fuel ratio is 18.

Figure 16:
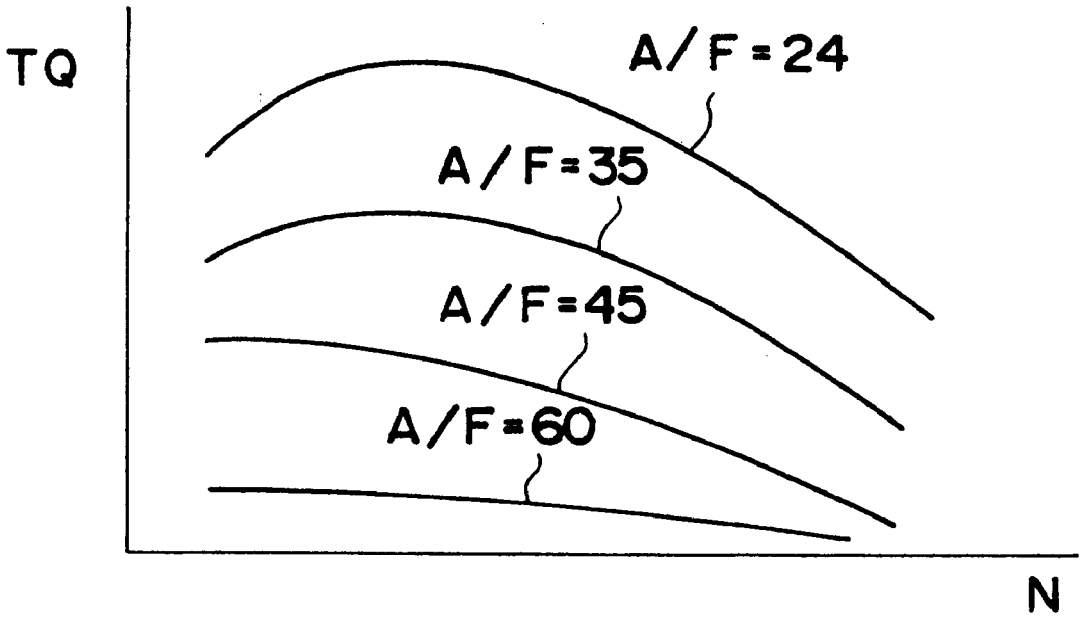
FIG. 16 is a graph showing an air fuel ratio in a second combustion.
Figure 17A:
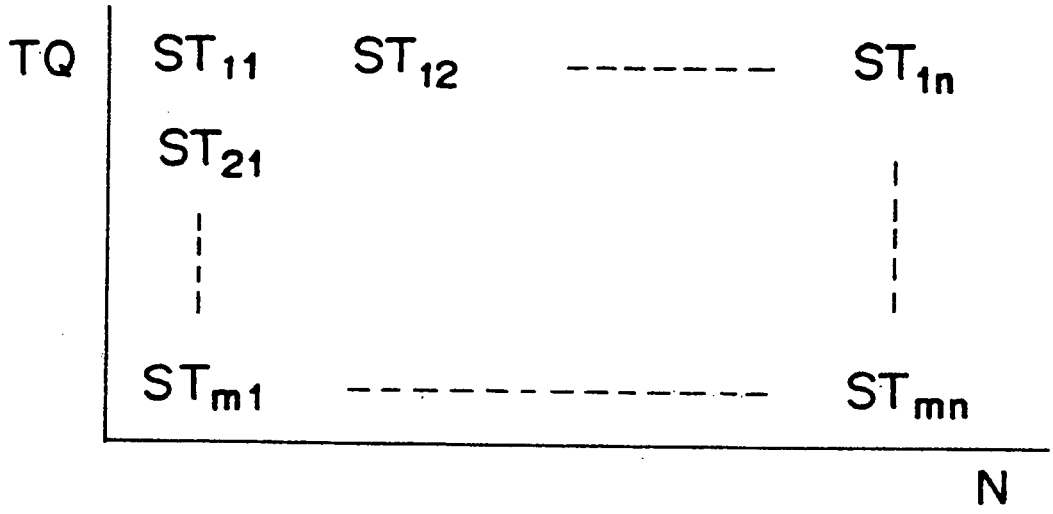
FIG. 17A is a map of the target opening degree of the throttle valve.
Figure 17B:
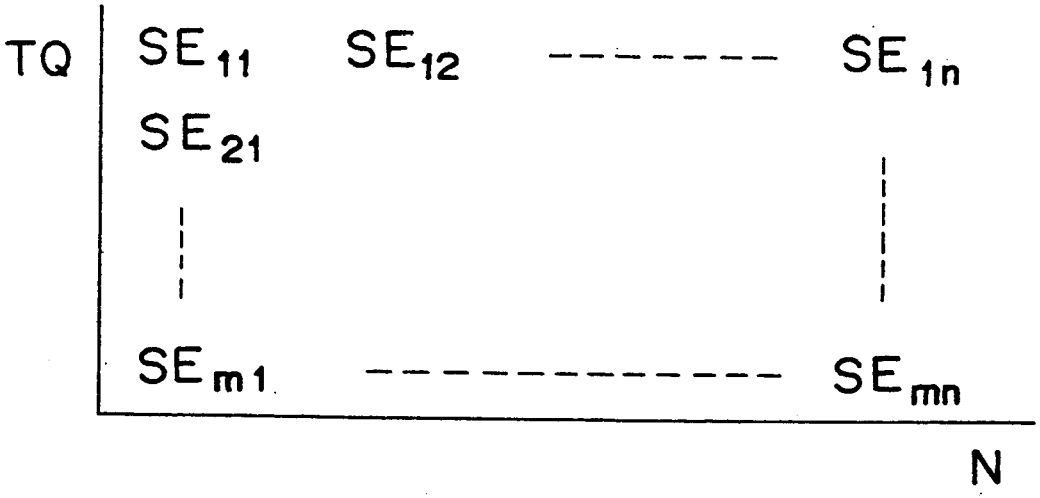
FIG. 17B is a map of the EGR control valve.

FIG. 16 is a graph showing a target air fuel ratio during the second combustion, that is, the combustion in accordance with the conventional combustion method is performed. Curves indicated by A/F=24, A/F=35, A/F=45 and A/F=60 show states at target air fuel ratios 24, 35, 45 and 60, respectively. A target opening degree ST of the throttle valve 20 necessary for setting the air fuel ratio to the target air fuel ratio has been previously stored within the ROM 42 as a function of the required torque TQ and the engine speed N in the form of a map as shown in FIG. 17A. A target opening degree SE of the EGR control valve 31 necessary for setting the air fuel ratio to the target air fuel ratio has been previously stored within the ROM 42 as a function of the required torque TQ and the engine speed N in the form of a map, as shown in FIG. 17B.

Contrarily, the third operation area Z where low temperature combustion can be performed at a substantially rich air fuel ratio varies with the gas temperature TG within the combustion chamber 5 at the beginning of the compression, the temperature difference (TW−TG) between the cylinder inner wall temperature TW and the gas temperature TG, the pressure PM within the surge tank 12 and the humidity DF in the suction air. In this case, the third operation area Z shifts toward the high load side, like the first operation area I, as the temperature of the fuel and the surrounding gas during the combustion is lowered.

Figure 18:
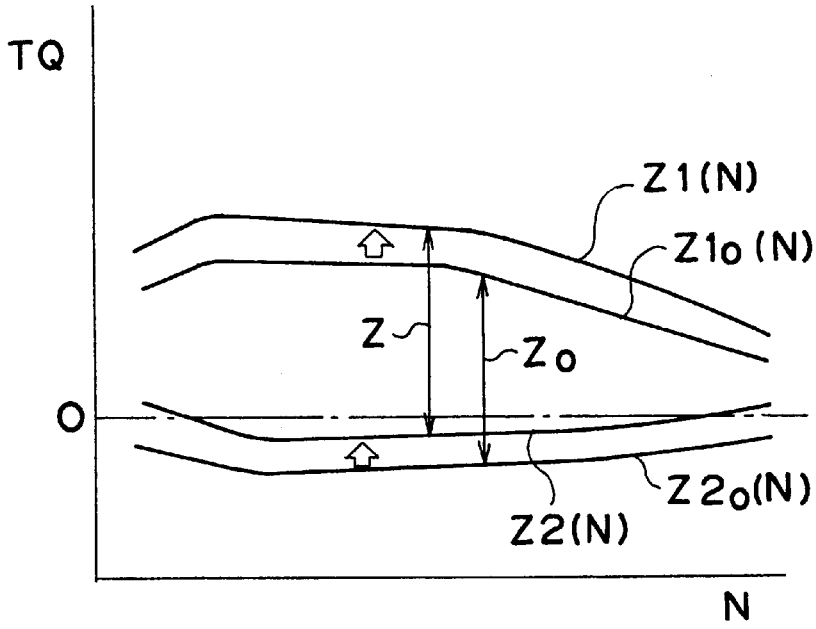
FIG. 18 is a graph showing the third operation area.

That is, in FIG. 18, assuming that $Z_0$ is set to a first operation area as a reference, $Z1_0(N)$ to a high load side limit as a reference, and $Z2_0(N)$ to a low load side limit as a reference, a high load side limit Z1(N) and a low load side limit Z2(N) are both shifted toward the high load side when the temperature of the fuel and the surrounding gas during combustion becomes lower than that of the reference cases. As a result, the third operation area Z is also shifted to the high load side.

The high load side limit Z1(N) and the low load side limit Z2(N) can be derived from the following equations using respective values $K(T)_1$, $K(T)_2$, $K(T)_3$, $K(T)_4$ and K(N).

$$Z1(N)=Z1_0(N)+C2\cdot K(T)\cdot K(N)$$

$$Z2(N)=Z2_0(N)+C3\cdot K(T)\cdot K(N)$$

$$K(T)=K(T)_1+K(T)_2+K(T)_3+K(T)_4$$

where C2 and C3 are constants.

Accordingly, when the gas temperature TG within the combustion chamber 5 at the beginning of combustion becomes lower than the reference temperature $T_1$ (FIG. 11), the high load side limit Z1(N) and the low load side limit Z2(N) respectively shift toward the high load side relative to $Z1_0(N)$ and $Z2_0(N)$ as the gas temperature TG within the combustion chamber 5 at the beginning of compression is lowered. When the temperature difference (TW−TG) becomes lower than the reference temperature difference $T_2$ (FIG. 11), the high load side limit Z1(N) and the low load side limit Z2(N) respectively shift toward the high load side relative to $Z1_0(N)$ and $Z2_0(N)$ as the temperature difference (TW−TG) becomes is lowered. Further, when the pressure PM within the surge tank 12 becomes lower than the reference pressure PM3 (FIG. 11), the high load side limit Z1(N) and the low load side limit Z2(N) respectively shift toward the high load side relative to $Z1_0(N)$ and $Z2_0(N)$ as the pressure PM within the surge tank 12 is lowered. When the humidity DF becomes larger than the reference humidity DF4 (FIG. 11), the high load side limit Z1(N) and the low load side limit Z2(N) respectively shift toward the high load side relative to $Z1_0(N)$ and $Z2_0(N)$ as the humidity DF becomes higher.

As mentioned above, an oxidation catalyst, a three-way catalyst and an nitrogen oxides NOx absorbent can be employed as the catalyst 25. However, hereinafter, the embodiment employing an nitrogen oxides NOx absorbent as the catalyst 25 will be described.

The ratio between an air and a fuel, such as a hydrocarbon HC, supplied to the engine intake passage, the combustion chamber 5 and the exhaust air passage disposed upstream the nitrogen oxides NOx absorbent is referred to as an air fuel ratio of an inflow exhaust gas to the nitrogen oxides NOx absorbent. The nitrogen oxides NOx absorbent absorbs an nitrogen oxides NOx when the air fuel ratio of the flowing exhaust gas is lean and desorbs the absorbed nitrogen oxides NOx when the air fuel ratio of the inflow exhaust gas becomes the stoichiometric or rich air fuel ratio.

When positioning the nitrogen oxides NOx absorbent within the engine exhaust passage, the nitrogen oxides NOx absorbent 25 actually performs absorbing and desorbing the nitrogen oxides NOx. The absorbing and desorbing operation is performed by the mechanism shown in FIGS. l9A and B. Next, an explanation will be given with respect to an example in which a platinum Pt and a barium Ba are carried on the carrier. However, the same mechanism can be obtained when using other noble metals, such as alkaline metal, alkaline earth metal, and rare earth metal.

Figure 19A:
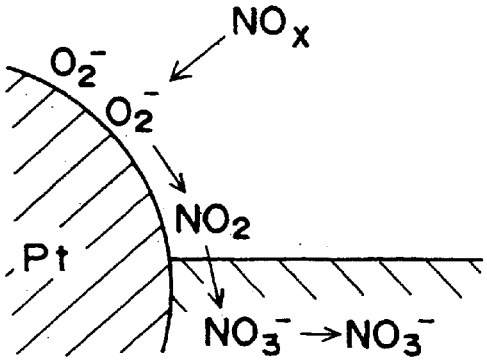
FIG. 19A is a schematic diagram illustrating the absorption of nitrogen oxides.

In the compression ignition type internal combustion engine shown in FIG. 1, combustion is normally performed in a state where the air fuel ratio in the combustion chamber 5 is lean. In the case where the combustion is performed at the lean air fuel ratio, a concentration of oxygen $O_z$ in the exhaust gas is high, and at this time, the oxygen $O_2$ is attached to a surface of the platinum Pt in the form of $O_2^-$ or $O^{2-}$, as shown in FIG. 19A. On the contrary, NOx contained in the inlet exhaust gas reacts with $O_2^-$ or $O^{2-}$ on the platinum Pt to produce $NO_2$ ($2NO+O_2 2NO_2$). Then, a part of the generated $NO_2$ is absorbed into the absorbent while being oxidized on the platinum Pt so as to diffuse within the absorbent in the form of nitric acid ion $NO_{3-}$, as shown in FIG. 19A, while combining with a barium oxide BaO. In this way, nitrogen oxides NOx is absorbed into the nitrogen oxides NOx absorbent. As long as the concentration of the oxygen in the inflow exhaust gas is high, $NO_2$ is generated on the surface of the platinum Pt, and as long as the nitrogen oxides NOx absorbing capacity of the absorbent is not saturated, $NO_2$ is absorbed within the absorbent, so that the nitric acid ion $NO_3$ is produced.

Figure 19B:
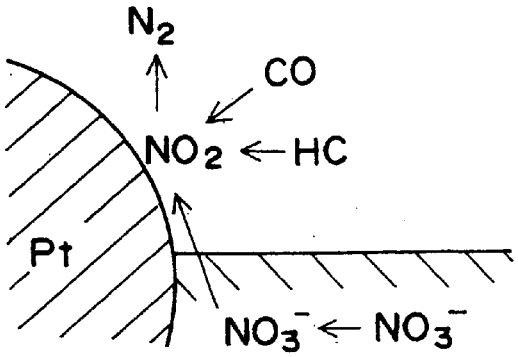
FIG. 19B is a schematic diagram illustrating the desorbtion of nitrogen oxides.

On the contrary, when the air fuel ratio of the inflow exhaust gas is set to rich, the concentration of the oxygen in the inlet exhaust gas is lowered, thus reducing the generation amount of $NO_2$ on the platinum Pt. When the generation amount of $NO_2$ is lowered, the reaction proceeds reversely ($NO_3^- NO_2$), and the nitric acid ion $NO_3^-$ within the absorbent is desorbed therefrom in the form of $NO_2$. At this time, nitrogen oxides NOx desorbed from the nitrogen oxides NOx absorbent reacts with a large amount of unburned hydrocarbon HC and carbon monoxide CO contained in the inflow exhaust gas, as shown in FIG. 19B, so as to be reduced. In the manner mentioned above, when there is no $NO_2$ on the surface of the platinum Pt, $NO_2$ is desorbed from the absorbent one after another. Accordingly, when the air fuel ratio of the inlet exhaust gas is set to rich, nitrogen oxides NOx is desorbed from the nitrogen oxides NOx absorbent for a short time, and the desorbed nitrogen oxides NOx is reduced. Therefore the desorbed nitrogen oxides NOx is not discharged to the open air.

As such, even when setting the air fuel ratio of the inflow exhaust gas to the stoichiometric air fuel ratio, nitrogen oxides NOx is desorbed from the nitrogen oxides NOx absorbent. However, in the case of setting the air fuel ratio of the inflow exhaust gas to the stoichiometric air fuel ratio, nitrogen oxides NOx is gradually desorbed from the nitrogen oxides NOx absorbent, requiring a longer time to have all the nitrogen oxides NOx absorbed in the nitrogen oxides NOx absorbent desorbed therefrom.

Figure 20A:
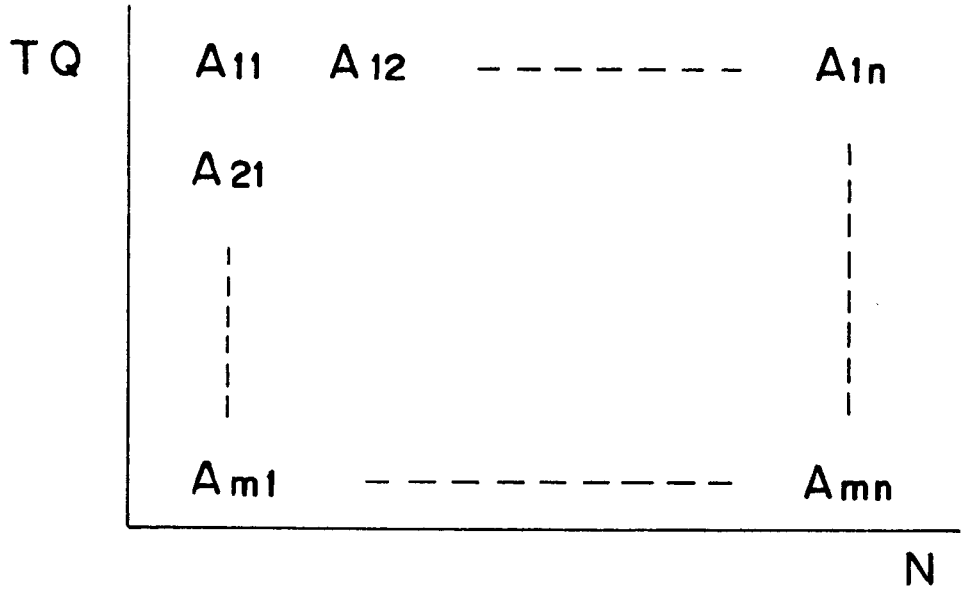
FIG. 20A is a map of a nitrogen oxide absorption amount per a unit time for the first combustion.
Figure 20B:
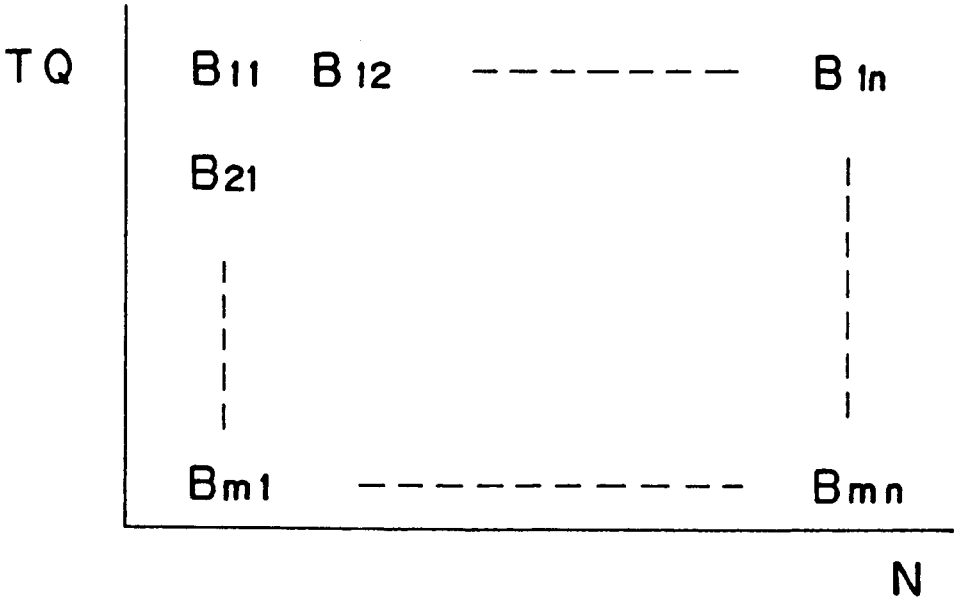
FIG. 20B is a map of a nitrogen oxide absorption amount per a unit time for the second combustion.

Since the nitrogen oxides NOx absorbing capacity of the nitrogen oxides NOx absorbent is limited, it is necessary to have nitrogen oxides NOx desorbed from the nitrogen oxides NOx absorbent before the nitrogen oxides NOx absorbing capacity of the nitrogen oxides NOx absorbent is saturated. For this, it is necessary to estimate the nitrogen oxides NOx amount absorbed in the nitrogen oxides NOx absorbent. Then, in accordance with the first embodiment of the invention, the nitrogen oxides NOx absorbed amount ΣNOX in the nitrogen oxides NOx absorbent is estimated by previously determining an amount of nitrogen oxides NOx absorbed A per a unit time when the first combustion is performed as a function of the required torque TQ and the engine speed N in the form of a map shown in FIG. 20A, previously determining an nitrogen oxides NOx absorbed amount B per a unit time when the second combustion is performed as a function of the required torque TQ and the engine speed N in the form of a map shown in FIG. 20B, and integrating the nitrogen oxides NOx absorbed amounts A and B per a unit time.

In accordance with the first embodiment of the invention, the structure can be made to have nitrogen oxides NOx desorbed from the nitrogen oxides NOx absorbent when the nitrogen oxides NOx absorbed amount ΣNOX exceeds a predetermined allowable maximum value. Next, this matter will be described below with reference to FIG. 21.

Figure 21:
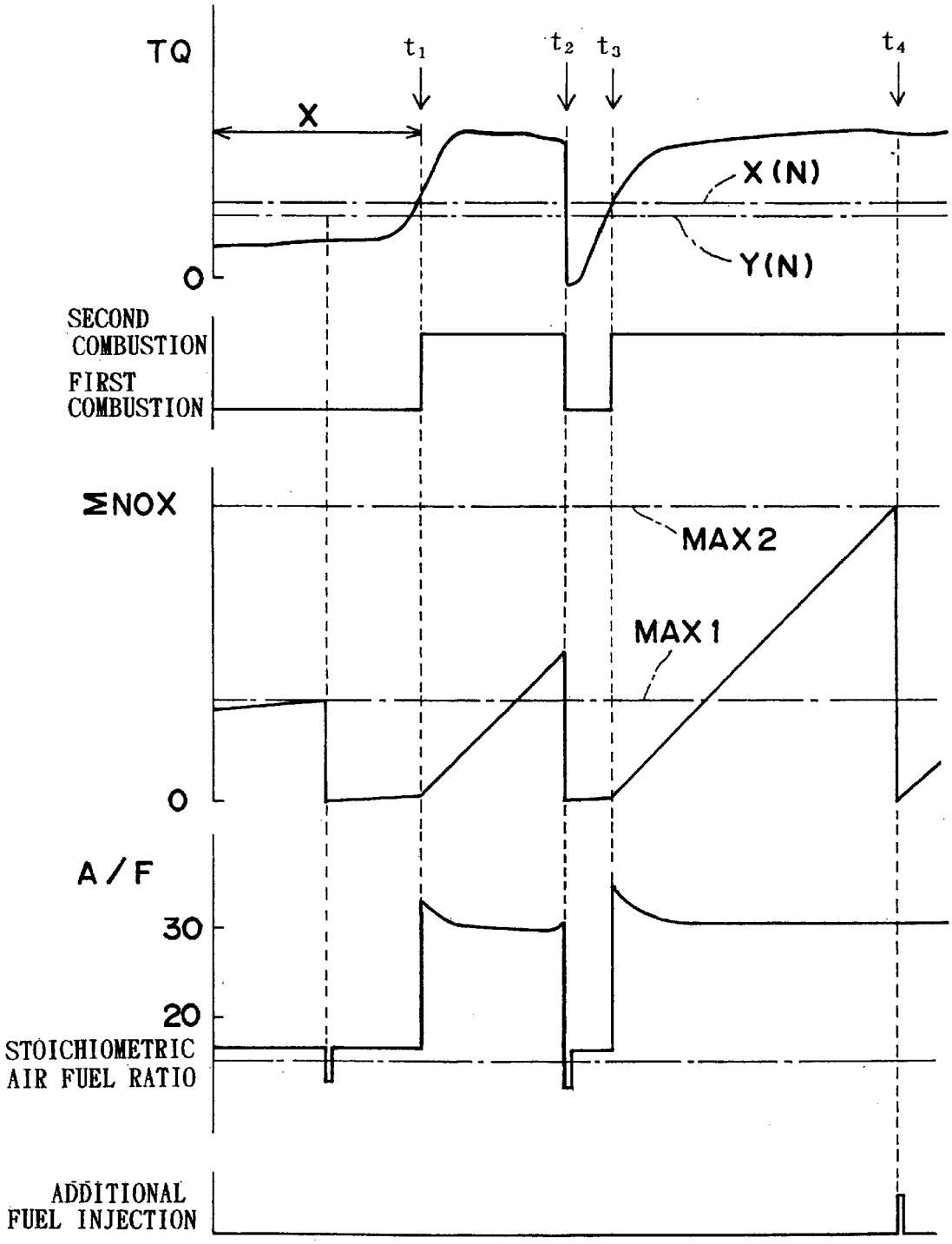
FIG. 21 is a graph illustrating desorption control of nitrogen oxides.

With reference to FIG. 21, in the first embodiment of the invention, two allowable maximum values, that is, an allowable maximum value MAX1 and an allowable maximum value MAX2 are set. The allowable maximum value MAX1 is set to about 30% of the maximum nitrogen oxides NOx absorbing amount that can be absorbed by the nitrogen oxides NOx absorbent, and the allowable maximum value MAX2 is set to about 80% of the maximum absorbing amount that can be absorbed by the nitrogen oxides NOx absorbent. When the nitrogen oxides NOx absorbed amount ΣNOX the allowable maximum value MAX1 during the first combustion, the air fuel ratio is set to rich such that the nitrogen oxides NOx is desorbed from the nitrogen oxides NOx absorbent. When the nitrogen oxides NOx absorbed amount ΣNOX exceeds the allowable maximum value MAX1 during the second combustion, the air fuel ration is set to rich such that the nitrogen oxides NOx is desorbed from the nitrogen oxides NOx absorbent at a time of being switched from the second combustion to the first combustion, such as, for example, during a decelerating operation, and when the nitrogen oxides NOx absorbed amount ΣNOX exceeds the allowable maximum value MAX2 during the second combustion, an additional fuel is injected at a later half of an expansion stroke or during an exhaust stroke so as to have nitrogen oxides NOx desorbed from the nitrogen oxides NOx absorbent.

That is, in FIG. 21, a period X indicates that the required torque TQ is lower than the first boundary X(N) and the first combustion is performed. At the same time, the air fuel ratio is slightly leaner than the stoichiometric air fuel ratio. When the first combustion is performed, an amount of nitrogen oxides NOx generated is significantly small. Therefore, as shown in FIG. 21, the nitrogen oxides NOx absorbed amount ΣNOX increases at a substantially slow rate. When the nitrogen oxides NOx absorbed amount ΣNOX exceeds the allowable maximum value MAX1 during the first combustion, the air fuel ratio A/F is temporarily set to rich, whereby the nitrogen oxides NOx absorbent desorbs the nitrogen oxides NOx. At this time, the nitrogen oxides NOx absorbed amount ΣNOX is set to 0.

As mentioned above, during the first combustion, no soot is generated regardless of whether the air fuel ratio is lean, stoichiometric, or rich. Accordingly, no soot is generated even when the air fuel ratio A/F is set to rich to have the nitrogen oxides NOx desorbed from the nitrogen oxides NOx absorbent during the first combustion.

Then, when the required torque TQ is over the first boundary X(N) at the time t1, the operation is switched from the first combustion to the second combustion. When the required torque TQ exceeds the first boundary X(N) at a time t1, the first combustion is switched to the second combustion. As shown in FIG. 21, during the second combustion, the air fuel ratio A/F becomes significantly lean. When the second combustion is performed, the generation amount of nitrogen oxides NOx is more than that obtained during the first combustion. Accordingly, during the second combustion, the nitrogen oxides NOx absorbed amount ΣNOX is increased at a relatively high rate.

When setting the air fuel ratio A/F to rich during the second combustion, a large amount of soot is generated. Therefore, the air fuel ratio A/F cannot be set to rich during the second combustion. Accordingly, even when the nitrogen oxides NOx absorbed amount ΣNOX exceeds the allowable maximum value MAX1 during the second combustion, as shown in FIG. 21, the air fuel ratio A/F cannot be set to rich for the purpose of having the nitrogen oxides NOx desorbed from the nitrogen oxides NOx absorbent. In this case, after the required torque TQ is lower than the second boundary Y(N) so as to switch the combustion from the second to the first combustion, the air fuel ratio A/F is temporarily set to rich so that the nitrogen oxides NOx absorbent desorbs the nitrogen oxides NOx.

Here, the time t2 in FIG. 21 indicates that deceleration is performed and the combustion is switched from the first combustion to the second combustion. When the deceleration is performed, the required torque TQ becomes negative. As a result, whether the air fuel ratio can be set to rich is governed by the position of the low load side limit Z2(N) of the third operation area Z, as is understood from FIG. 18.

Then, when the air fuel ratio is required to be rich, it is determined whether the engine operation state is within the third operation area Z. If it is determined that the engine operation state is within the third operation area Z, the air fuel ratio A/F is temporarily set to rich such that the nitrogen oxides NOx absorbent 25 desorbs the nitrogen oxides NOx when switching from the second combustion to the first combustion.

Then, assuming the first combustion is switched to the second combustion at a time t3, the second combustion is continued for a predetermined time. At this time, it is assumed that the nitrogen oxides NOx absorbed amount ΣNOX exceeds the allowable maximum value MAX1 and further exceeds the allowable maximum value MAX2 at a time t4, at which point additional fuel is injected at the later half of the expansion stroke or during the exhaust stroke. As a result, the air fuel ratio of the exhaust gas flowing into the nitrogen oxides NOx absorbent is set to rich.

The additional fuel injected at the later half of the expansion stroke or during the exhaust stroke is not used for generating the engine output. Therefore, it is preferable to reduce the chance for injecting the additional fuel as little as possible. Accordingly, when the nitrogen oxides NOx absorbed amount ΣNOX exceeds the allowable maximum value MAX1 during the second combustion, it is structured to temporarily set the air fuel ratio A/F to rich when switching from the second to the first combustion such that the additional fuel is injected only for the special occasion where the nitrogen oxides NOx absorbed amount ΣNOX exceeds the allowable maximum value MAX2.

Figure 22:
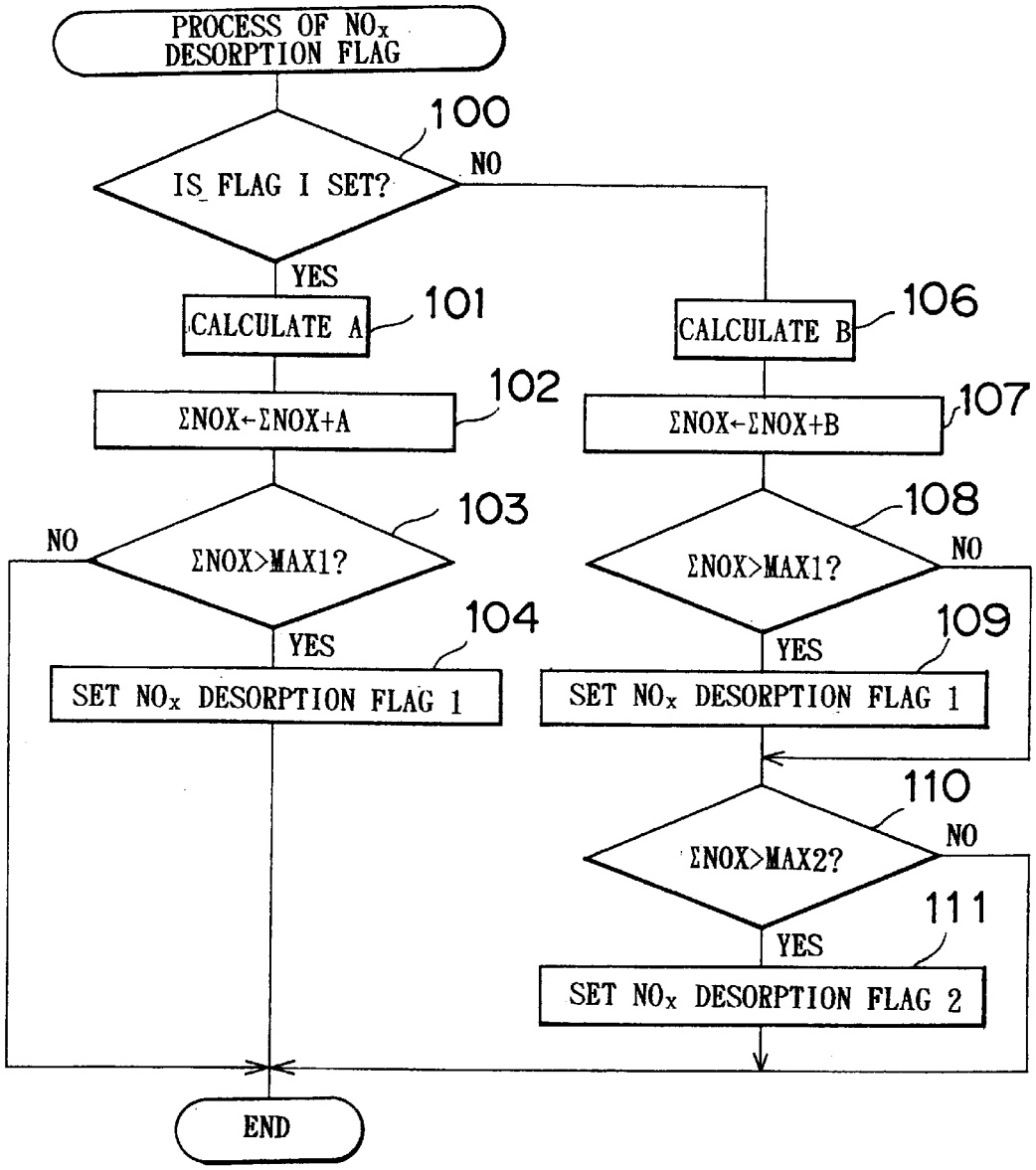
FIG. 22 is a flowchart for setting a process routine of a nitrogen oxides NOx desorption flag.

FIG. 22 shows a process routine of a nitrogen oxides NOx desorption flag set at a time when nitrogen oxides NOx should be desorbed from the nitrogen oxides NOx absorbent. The routine is executed by an interruption per a fixed time.

With reference to FIG. 22, in step 100, it is determined whether a flag I showing that the operation area of the engine is in the first operation area I. When the flag I is set, that is, the operation area of the engine is in the first operation area I, the process goes to step 101 where the nitrogen oxides NOx absorbed amount A per a unit time is calculated from a map shown in FIG. 20A. Next, in step 102, the nitrogen oxides NOx absorbed amount is added to the nitrogen oxides NOx absorbed amount ΣNOX. Next, in step 103, it is determined whether the nitrogen oxides NOx absorbed amount ΣNOX exceeds the allowable maximum value MAX1. If ΣNOX>MAX1, the process goes to step 104 where the nitrogen oxides NOx desorption flag 1 indicating that the nitrogen oxides NOx should be desorbed when the first combustion is performed is set.

Meanwhile, in step 100, when it is determined that the flag I is set, that is, when the operation area of the engine is in the second operation area II, the process goes to step 106. The nitrogen oxides NOx absorbed amount B per a unit time is calculated from a map shown in FIG. 20B. Next, in step 107, the nitrogen oxides NOx absorbed amount B is added to the nitrogen oxides NOx absorbed amount ΣNOX. Next, in step 108, it is determined whether the nitrogen oxides NOx absorbed amount ΣNOX exceeds the allowable maximum value MAX1. If ΣNOX>MAX1, the process goes to step 109 where the nitrogen oxides NOx desorption flag 1 indicating that nitrogen oxides NOx should be desorbed when the first combustion is performed is set.

In step 110, it is determined whether the nitrogen oxides NOx absorbed amount ΣNOX exceeds the allowable maximum value MAX2. If ΣNOX>MAX2, the process proceeds to step 111 where the nitrogen oxides NOx desorption flag 2 indicating that nitrogen oxides NOx should be desorbed at the latter half of the expansion stroke or the exhaust stroke is set.

Figure 23:
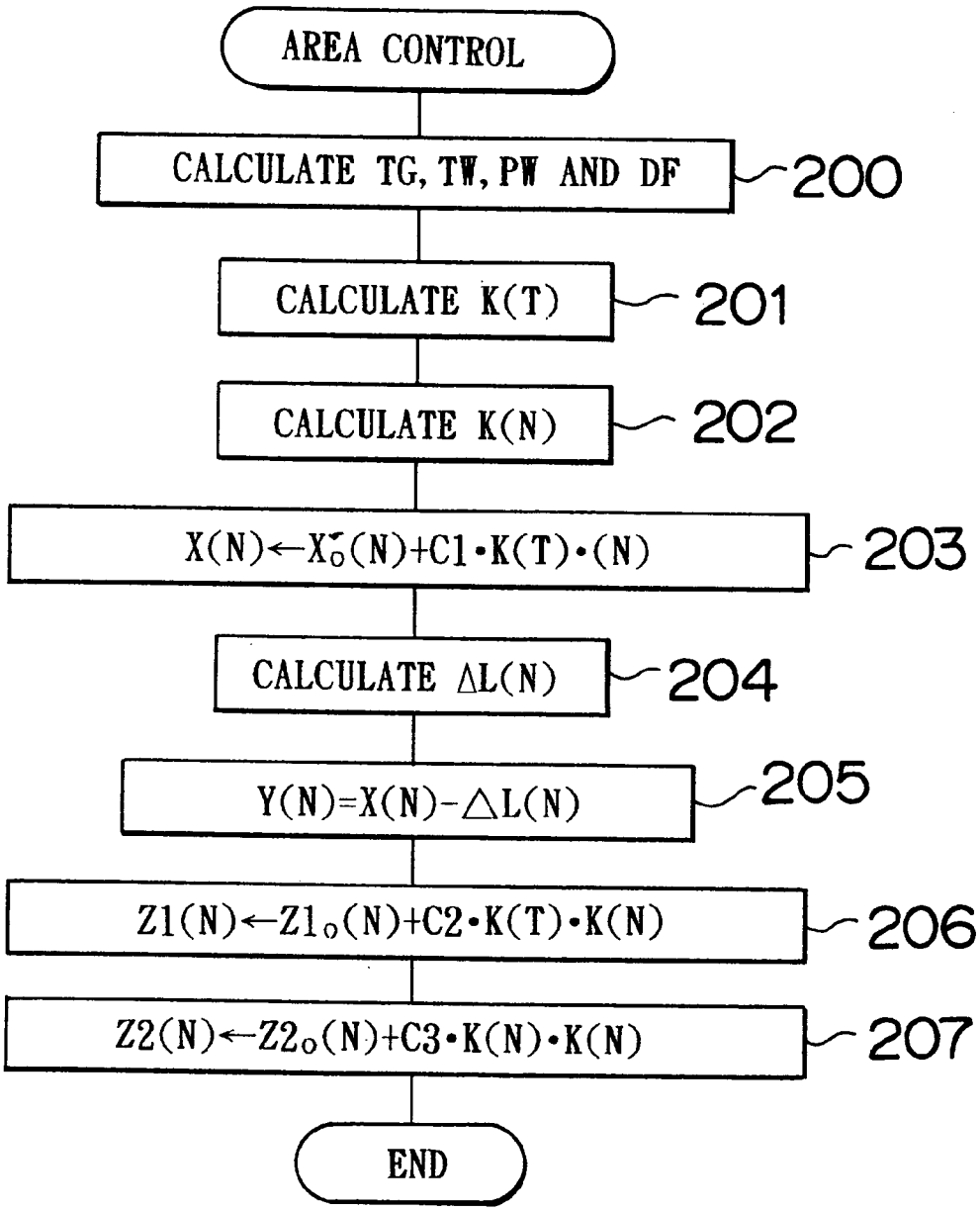
FIG. 23 is a flowchart for controlling a low temperature combustion area.

FIG. 23 shows a process routine for controlling a low temperature combustion area, that is, the first operation area I and the third operation area Z.

With reference to FIG. 23, at first, the gas temperature TG within the combustion chamber 5 at the beginning of the compression, the cylinder inner wall temperature TW, the pressure P within the surge tank 12 and the humidity DF in the intake air are calculated in step 200. Then, a temperature of a gas mixture between the intake air and the EGR gas detected by the temperature sensor 62 is set to the gas temperature TG within the combustion chamber 5 at the beginning of the compression, and an engine cooling water temperature detected by the temperature sensor 60 is set to the cylinder inner wall temperature TW. Further, the pressure PM within the surge tank 12 is detected by the pressure sensor 61, and the humidity DF is detected by the humidity sensor 63. Next, in step 201, $K(T)_1$, $K(T)_2$, $K(T)_3$ and $K(T)_4$ are calculated from the relationships shown in FIGS. 11A to 11D, and K(T) ($=K(T)_1+K(T)_2+K(T)_3+K(T)_4$) is calculated by adding the values for K(T)1 to $K(T)_4$.

Next, in step 202, K(N) is calculated from the relationship shown in FIG. 11E on the basis of the engine speed N. Then, in step 203, a value of the first boundary X(N) is calculated on the basis of the following formula by using the value of the previously stored first boundary Xo(N).

$$X(N)=Xo(N)+C1\cdot K(T)-K(N)$$

Next, in step 204, the difference L(N) between X(N) and Y(N) changing in accordance with the engine speed N is calculated. Then, in step 205, a value Y(N) (=X(N)−L(N)) of the second boundary Y(N) is calculated by subtracting L(N) from X(N). Next, in step 206, the high load side limit Z1(N) is calculated from the following formula by using the value of the previously stored high load side limit Z1o(N).

$$Z1(N)=Z1o(N)+C2\cdot K(T)\cdot K(N)$$

Then, in step 207, the low load side limit Z2(N) is calculated from the following formula by using the value of the previously stored low load side limit Z2o(N).

$$Z2(N)=Z2o(N)+C3\cdot K(T)\cdot K(N)$$

Figure 24:
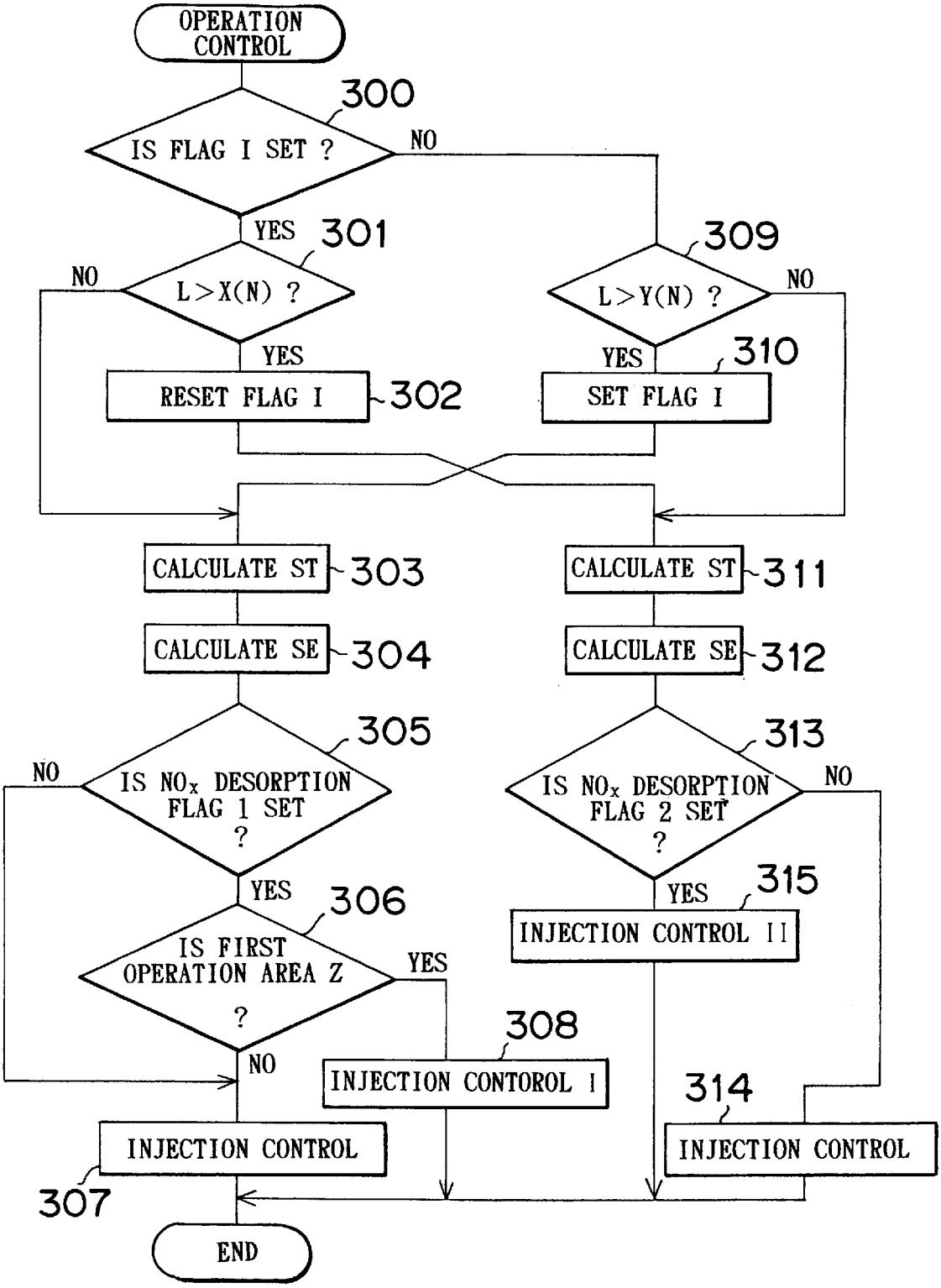
FIG. 24 is a flowchart for controlling an operation of the engine.

Next, an operation control will be described below with reference to FIG. 24.

First, in step 300, it is determined whether a flag I showing that the operation area of the engine is in the first operation area I is set. When the flag I is set, that is, the operation area of the engine is in the first operation area I, the process goes to step 301 where it is determined whether the required load L becomes greater than the first boundary X1(N). If L≦X1(N), the process goes to step 303 where the low temperature combustion is performed.

That is, in step 303, the target opening degree ST of the throttle valve 20 is calculated from a map shown in FIGS. 14A to 14D, and the opening degree of the throttle valve 20 is set to the target opening degree ST. Next, in step 304, the target opening degree of the EGR control valve 31 is calculated from a map shown in FIGS. 15A to 15D, and the opening degree of the EGR control valve 31 is set to the target opening degree SE. Next, in step 305, it is determined whether the nitrogen oxides NOx desorption flag 1 is set. When the nitrogen oxides NOx desorption flag is not set, the process goes to step 307 where the fuel injection is performed. At this time, the low temperature combustion is performed at the lean air fuel ratio.

Contrarily, if in step 305 it is determined that the nitrogen oxides NOx desorption flag 1 is set, the process goes to step 306 where it is determined whether the engine operation state is in the third operation area Z. When the engine operation state is not in the third operation area Z, the process goes to the step 307, and the low temperature combustion is performed at the lean air fuel ratio. Contrarily, when the engine operation state is in the third operation area Z, the process goes to step 308, and the air fuel ratio is made rich for a predetermined period. During this period, nitrogen oxides NOx is desorbed from the nitrogen oxides NOx absorbent. Then, the nitrogen oxides NOx desorption flag 1 is reset, and ΣNOX is cleared.

In step 301, when it is determined that L>X(N), the process goes to step 302 where the flag I is reset and further goes to step 311 where the second combustion is performed.

That is, in step 311, the target opening degree ST of the throttle valve 20 is calculated from a map shown in FIG. 17A and the opening degree of the throttle valve 20 is set to the target opening degree ST. Then, in step 312, the target opening degree SE of the EGR control valve 31 is calculated from a map shown in FIG. 17B and the opening degree of the EGR control valve 31 is set to the target opening degree SE. Next, in step 313, it is determined whether the nitrogen oxides NOx desorption flag 2 is set. When the nitrogen oxides NOx desorption flag 2 is not set, the process goes to step 314 where the fuel injection is performed so as to achieve the air fuel ratio shown in FIG. 16. At this time, the second combustion is performed at the lean air fuel ratio.

Contrarily, in step 313, when it is determined that the nitrogen oxides NOx desorption flag 2 is set, the process goes to step 315 where additional fuel is injected for a predetermined period in the latter half of the expansion stroke or during the exhaust stroke. At this time, the air fuel ratio of the exhaust gas flowing into the nitrogen oxides NOx absorbent becomes rich, and during this time, nitrogen oxides NOx is desorbed from the nitrogen oxides NOx absorbent. Then, the nitrogen oxides NOx desorption flags 1 and 2 are reset, and ΣNOX is cleared.

Figure 25:
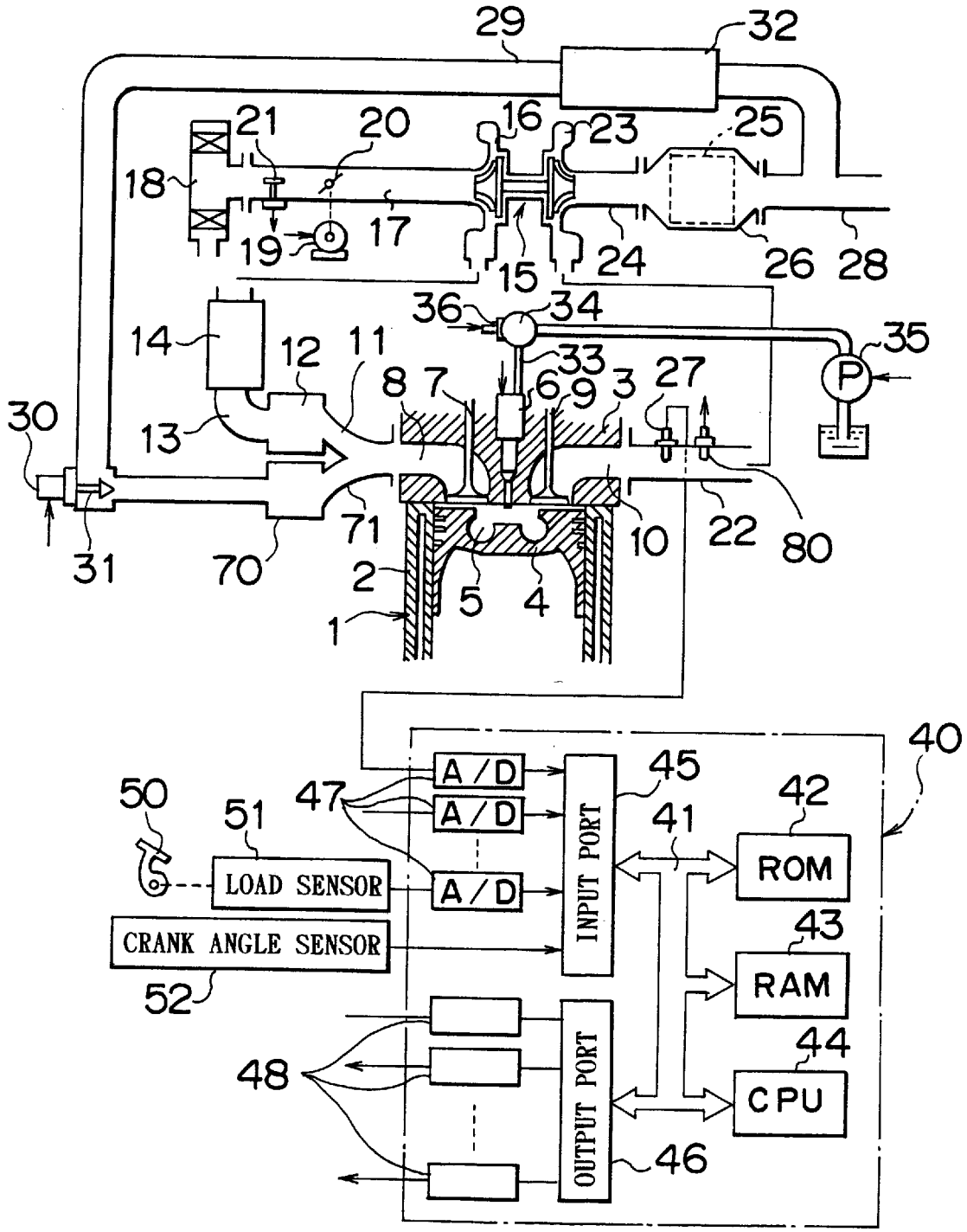
FIG. 25 is a schematic diagram of a compression ignition type internal combustion engine according to a second embodiment of the invention.

FIG. 25 shows a second embodiment of the invention having a structure for uniformly distributing the EGR gas to each of the cylinders. An explanation of the structure similar to the engine shown in FIG. 1 will be omitted.

Looking at FIG. 25, it can be seen that an exhaust gas temperature sensor 80 for detecting a temperature of an exhaust gas from each of the cylinders is arranged within each of the exhaust manifolds 22 corresponding to each of the cylinders. An average value of output values of all the exhaust gas temperature sensors 80 is calculated from the output value of each of the exhaust gas temperature sensors 80 corresponding to each of the cylinders. It is determined that the cylinder having a difference between the output value of the exhaust gas temperature sensor 80 and the calculated average value equal to or greater than a predetermined value has a dispersion of the fuel injection amount in comparison with the other cylinders. Next, in the cylinder having a dispersion in the fuel injection amount, a correction for increasing or reducing the fuel injection period is performed, and it is intended to reduce the dispersion in the fuel injection amount.

Further, an EGR surge tank 70 for preventing the EGR gas from pulsating and for accurately distributing the EGR gas into the combustion chamber 5 of the respective cylinders is arranged within the EGR passage 29 disposed upstream the joining portion between the intake branch pipe 11 and the EGR passage 29. A portion of the EGR passage 29 which is disposed downstream the EGR surge tank 70 and branched into four portions by the EGR surge tank 70 is hereinafter called an EGR branch pipe 71.

Figure 26:
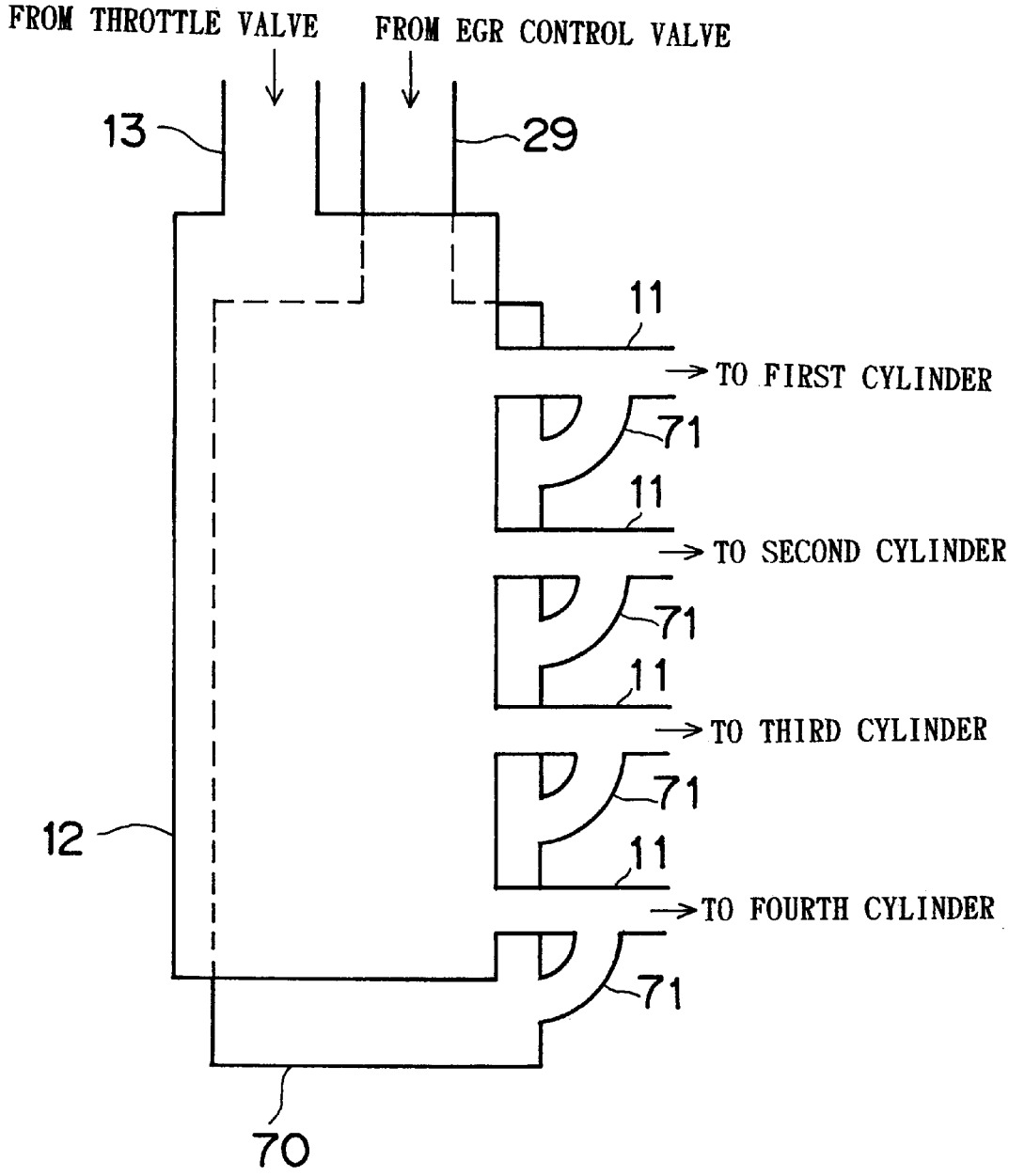
FIG. 26 is a schematic diagram of an enlarged intake surge tank and EGR surge tank.

FIG. 26 is schematic diagram illustrating an enlarged view of the intake surge tank 12 and the EGR surge tank 70. As shown in FIG. 26, intake air passing through the throttle valve 20 flows into the intake surge tank 12 via the intake duct 13. The intake air is accurately distributed into each of the cylinders by the intake surge tank 12. The intake air is then supplied into the combustion chamber 5 in each of the cylinders via each of the intake branch pipes 11. Further, the intake air passing through the EGR control valve 31 flows into the EGR surge tank 70 via the EGR passage 29. The intake air is them accurately distributed into each of the cylinders by the EGR surge tank 70 and supplied into the combustion chamber 5 in each of the cylinders via each of the EGR branch pipes 71 and the corresponding intake branch pipe 11.

Figure 27:
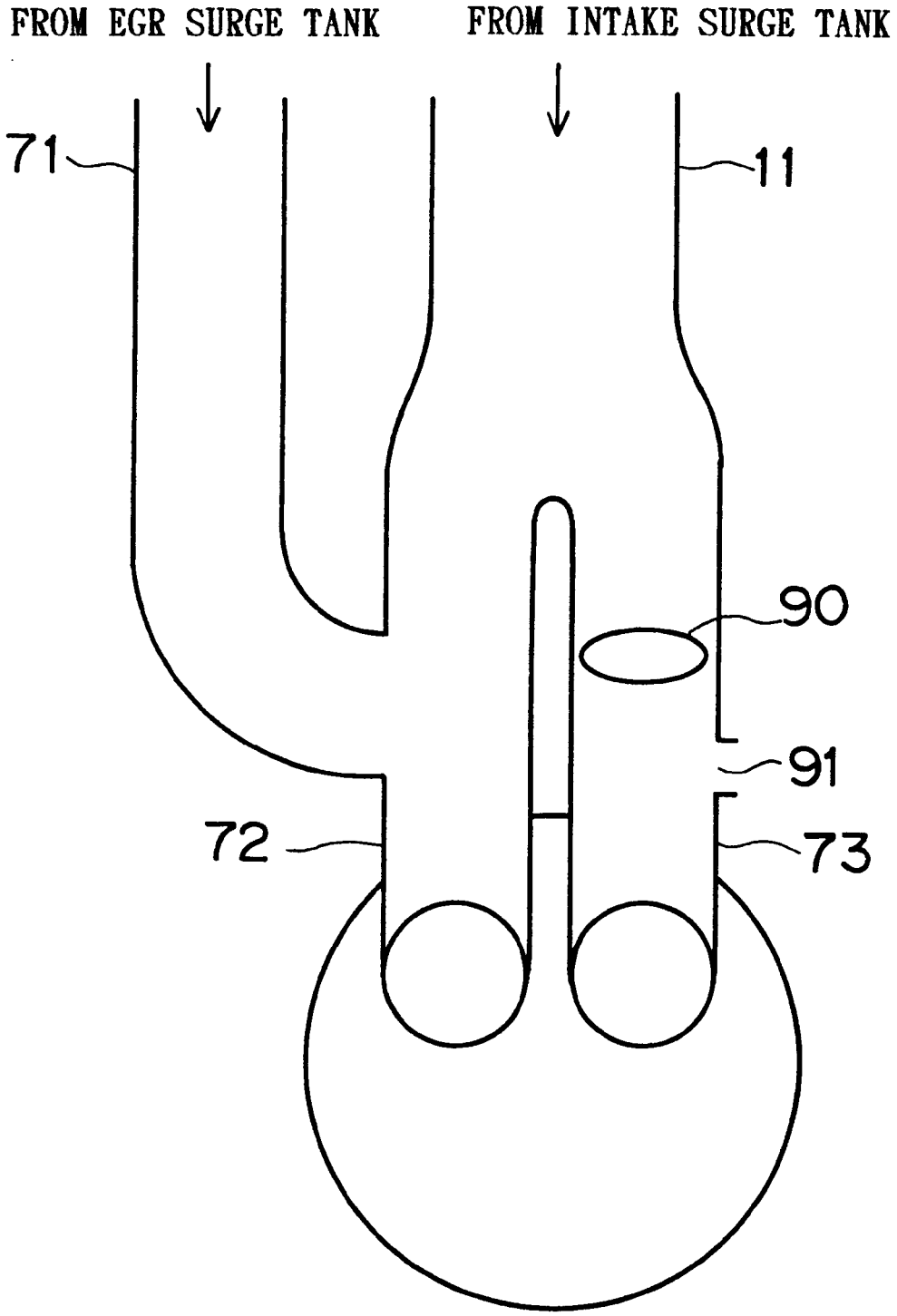
FIG. 27 is a schematic diagram of an enlarged joining portion between an intake branch pipe and an EGR branch pipe for a corresponding cylinder.

FIG. 27 is schematic diagram illustrating an enlarged, detailed view of a joining portion between the intake air branch pipe 11 and the EGR branch pipe 71 for a corresponding cylinder. As shown in FIG. 27, the intake air branch pipe 11 corresponding to the cylinder is connected to the cylinder via branched intake ports 72, 73. A blow-by discharge port 91 for recirculating a blow-by gas, a fuel gas, such as an evaporation gas, and the like into the intake port 72 so as to discharge into the combustion chamber 5 is arranged within one intake port 73 of the branched intake ports 72, 73. In this case, the blow-by gas means a gas which is discharged into the crank case from a gap of the piston ring in a compression stroke and an explosion stroke of the engine and reaches the cylinder head 3 via a gap between the inner wall and the outer wall of the cylinder block 2.

Further, the EGR branch pipe 71 extending from the EGR surge tank 70 joins with one of the branched intake ports 72, 73, i.e., the intake port 72. An intake air flow control valve 90 for forming a swirl is arranged within the intake air port, which is not joined with the EGR branch pipe 71, i.e., the intake air port 73, in which the blow-by gas discharge hole 91 is provided, and is arranged upstream of the blow-by gas discharge hole 91. A purge line (not shown) for the evaporation gas control system is also connected to the blow-by gas discharge hole 91.

In accordance with the second embodiment, the EGR surge tank 70 for the EGR gas for distributing the EGR gas into the combustion chamber 5 in each of the cylinders is arranged within the EGR passage 29 disposed upstream the joining portion between the EGR branch pipe 71 and the intake air branch pipe 11. Accordingly, it is possible to accurately distribute the EGR gas flowing into the EGR surge tank 70 into the combustion chamber 5 in each of the cylinders without being influenced by the pulsation of the intake air flowing within the engine intake air passage and the like.

Further, in accordance with the present embodiment, the intake air surge tank 12 for distributing the intake air into the combustion chamber 5 in each of the cylinders is arranged within the engine intake air passage disposed upstream the joining portion between the intake air branch pipe 11 and the EGR branch pipe 71. Accordingly, it is possible to accurately distribute the intake air flowing into the intake air surge tank 12 into the combustion chamber 5 in each of the cylinders without being influenced by the pulsation of the EGR gas flowing within the EGR passage 29 and the like.

Still further, in accordance with the present embodiment, the EGR control valve 31 for controlling an amount of the EGR gas supplied within the combustion chamber 5 is arranged within the EGR passage 29 disposed upstream the EGR surge tank 70 in an adjacent manner to the EGR surge tank 70. That is, the EGR control valve 31 is arranged within the EGR passage 29 before branching into each of the cylinders and in the portion relatively near each of the cylinders. Accordingly, it is possible to improve a response performance when controlling the EGR gas amount supplied to each of the cylinders.

Furthermore, in accordance with the present invention, the blow-by gas discharge hole 91 is provided within one intake air port 73 among the branched plural intake air ports 72, 73, and the joining portion between the intake air branch pipe 11 and the EGR branch pipe 71 is arranged within the other intake air port 72. That is, the blow-by gas and the EGR gas are not mixed within the intake air port 72 or 73. Accordingly, it is possible to prevent a deposit generated by the mixture of the blow-by gas and the EGR gas from attaching within the intake air port 72 or 73.

Moreover, in accordance with the present embodiment, the intake air flow control valve 90 for forming the swirl is arranged within the intake air port 73 having no joining portion between the intake air branch pipe. Accordingly, it is possible to prevent a deposit in the EGR gas from attaching to the intake air flow control valve 90.

Furthermore, the intake air flow control valve 90 is arranged within the intake air port 73 in which the blow-by gas discharge hole 91 is provided and upstream the blow-by gas discharge pipe 91. Accordingly, it is possible to prevent the deposit in the blow-by gas from attaching to the intake air flow control valve 90.

Figure 28A:
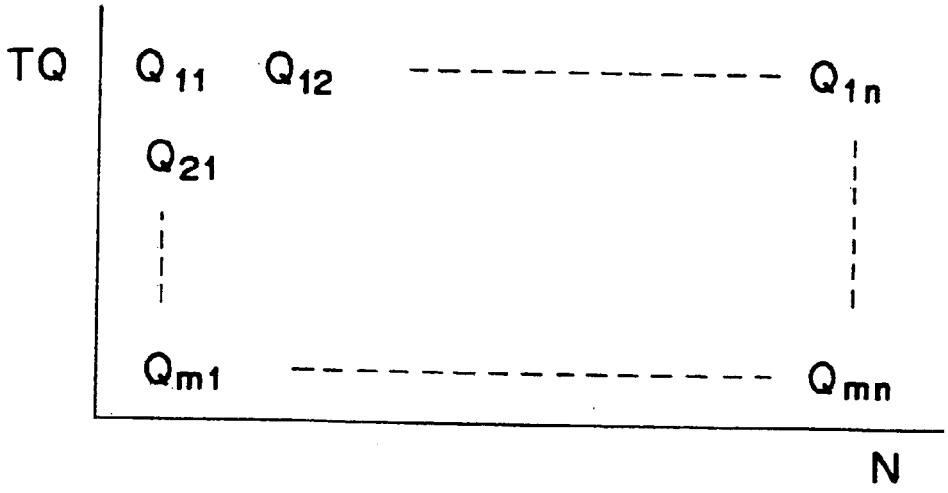
FIG. 28A is a map of the injection amount in the first operation area as a function of the required torque and engine speed.
Figure 28B:
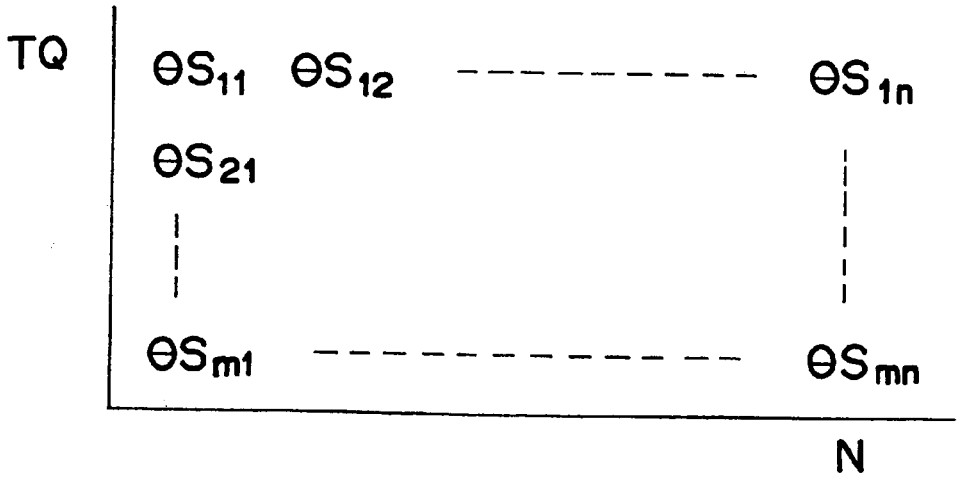
FIG. 28B is a map of the standard injection start timing in the first operation area as a function of the required torque and engine speed.

Next, in a third embodiment of the invention, contents of the control for controlling an optimum EGR rate in accordance with the engine operation state will be described below. In FIG. 28A, there is shown an injection amount Q in the first operation area I. In FIG. 28B, there is shown a standard injection start timing θS in the first operation area I. As shown in FIG. 28A, the injection amount Q in the first operation area I is previously stored in the ROM 42 in the form of a map as a function of the required torque Q and the engine speed N, and as shown in FIG. 28B, the standard injection start timing S in the first operation area I is also previously stored in the ROM 42 in the form of a map as a function of the required torque TQ and the engine speed N.

Figure 29A:
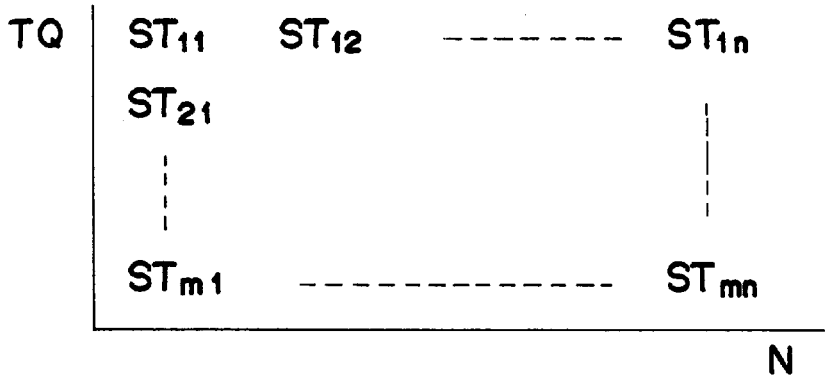
FIG. 29A is a map of the target opening degree of the throttle valve as a function of the required torque and engine speed.
Figure 29B:
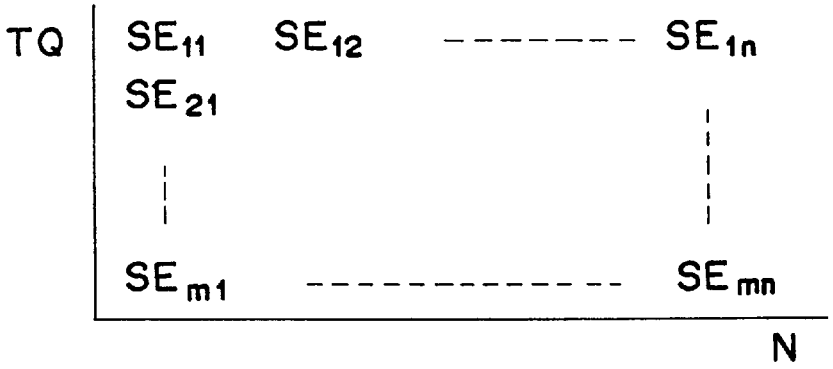
FIG. 29B is a map of the target opening degree of the EGR control valve as a function of the required torque and engine speed.

Further, the target opening degree ST of the throttle valve 20 necessary for setting the air fuel ratio to an air fuel ratio corresponding to the engine operation state, for example, the target air fuel ratio A/F shown in FIG. 12, and setting the EGR rate to the target EGR rate corresponding to the engine operation state, is previously stored in the ROM 42 in the form of a map as a function of the required torque TQ and the engine speed N, as shown in FIG. 29A. The target opening degree SE of the EGR control valve 31 necessary for setting the air fuel ratio to an air fuel ratio corresponding to the engine operation state, for example, the target air fuel ratio A/F shown in FIG. 12, and setting the EGR rate to the target EGR rate corresponding to the engine operation state, is previously stored in the ROM 42 in the form of a map as a function of the required torque TQ and the engine speed N, as shown in FIG. 29B.

Figure 29C:
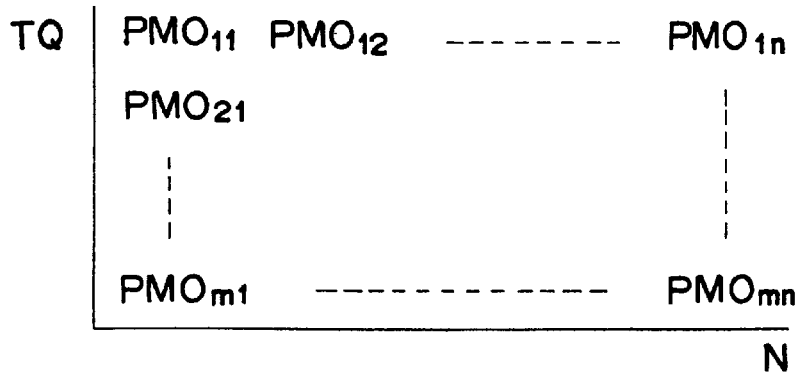
FIG. 29C is a map of the pressure within the air intake pipe as a function of the required torque and engine speed.

Still further, in accordance with the present invention, the pressure PM0 within the air intake pipe 17 disposed downstream the throttle valve 20 at a time when the air fuel ratio is set to an air fuel ratio corresponding to the engine operation state, for example, the target air fuel ratio A/F shown in FIG. 12, and the EGR rate is set to the target EGR rate corresponding to the engine operation state, is previously stored in the ROM 42 in the form of a map as a function of the required torque TQ and the engine speed N, as shown in FIG. 29C.

Figure 30A:
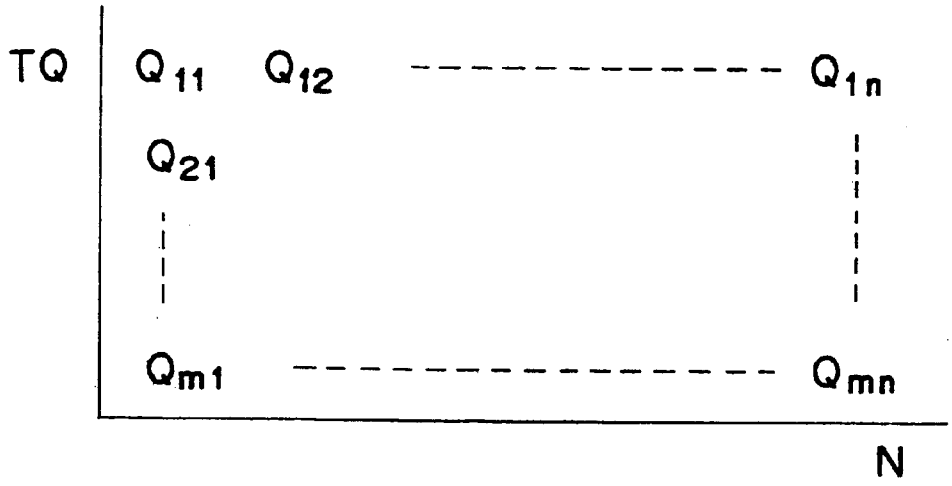
FIG. 30A is a map of the injection amount as a function of the required torque and engine speed.
Figure 30B:
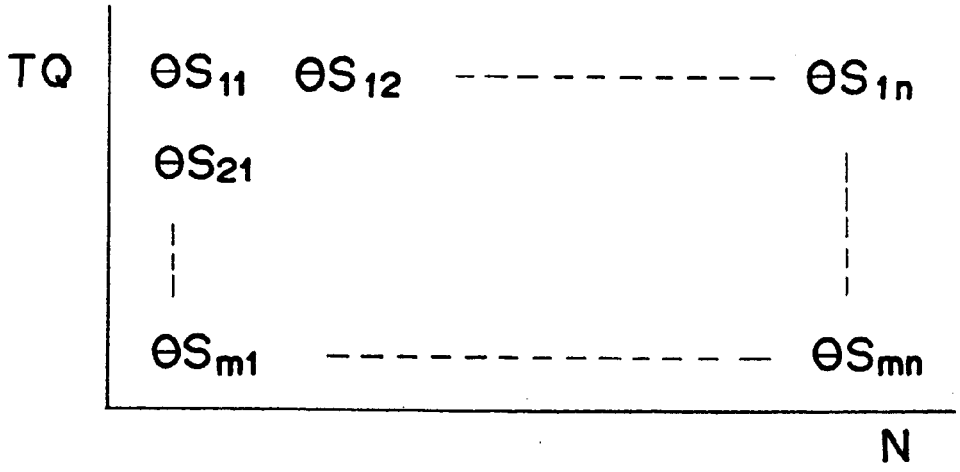
FIG. 30B is a map of the injection start timing as a function of the required torque and engine speed.

FIG. 30A shows an injection amount Q in the second operation area II. FIG. 30B shows an injection start timing θS in the second operation area II. As shown in FIG. 30A, the injection amount Q in the second operation area II is previously stored in the ROM 42 in the form of a map as a function of the required torque TQ and the engine speed N. As shown in FIG. 30B, the injection start timing θS in the second operation area II is previously stored in the ROM 42 in the form of a map as a function of the required torque TQ and the engine speed N.

Figure 31A:
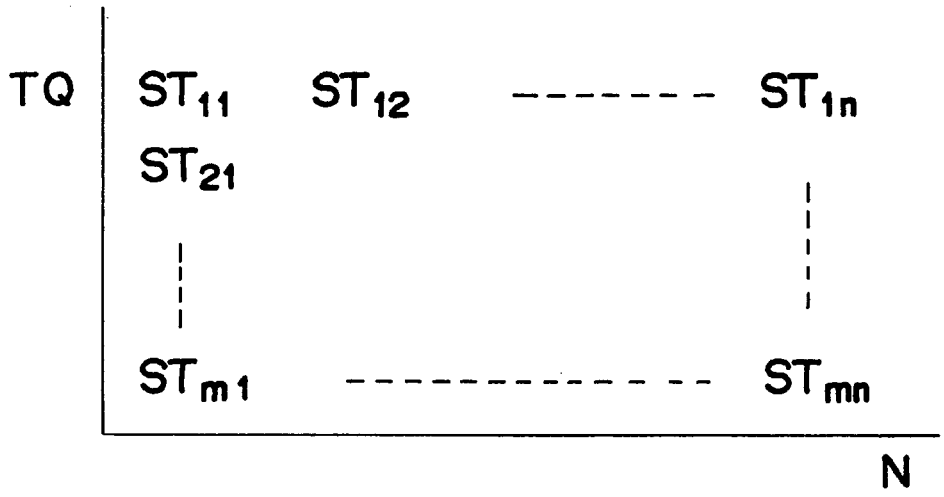
FIG. 31A is a map of the target opening degree of the throttle valve as a function of the required torque and engine speed.
Figure 31B:
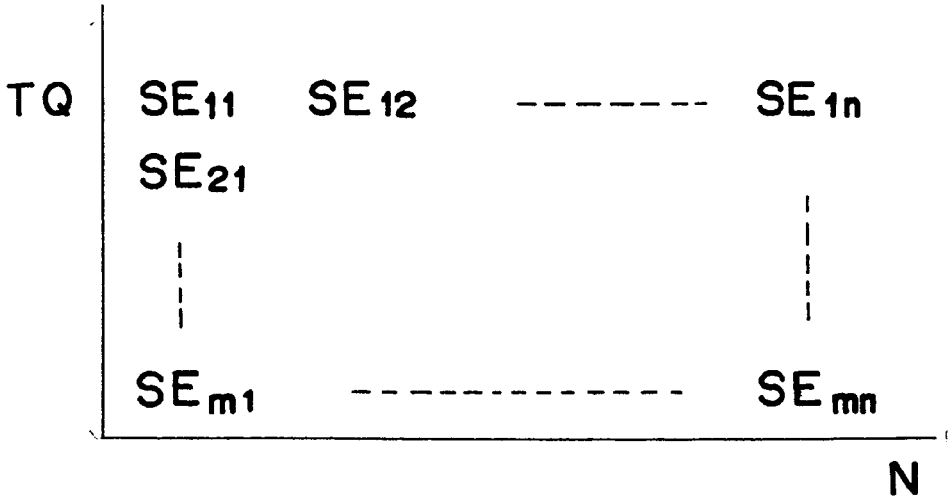
FIG. 31B is a map of the target opening degree of the EGR control valve as a function of the required torque and engine speed.

Furthermore, the target opening degree ST of the throttle valve 20 necessary for setting the air fuel ratio to the target air fuel ratio shown in FIG. 16 is previously stored in the ROM 42 in the form of a map as a function of the required torque TQ and the engine speed N, as shown in FIG. 31 A. The target opening degree SE of the EGR control valve 31 necessary for setting the air fuel ratio to the target air fuel ratio shown in FIG. 16 is previously stored in the ROM 42 in the form of a map as a function of the required torque TQ and the engine speed N, as shown in FIG. 31B.

In this case, in the first operation area I, when setting the injection amount to the injection amount Q calculated from the map shown in FIG. 28A, setting the opening degree of the throttle valve 20 to the target opening degree ST shown in FIG. 29A and setting the opening degree of the EGR control valve 31 to the target opening degree SE shown in FIG. 29B, the air fuel ratio substantially becomes the target air fuel ratio A/F shown in FIG. 12, and the EGR rate becomes the target EGR rate corresponding to the required torque TQ and the engine speed N at that time. Additionally, since the air fuel ratio is set to the target air fuel ratio A/F shown in FIG. 12 in the state that the injection amount is set to the injection amount Q shown in FIG. 28A, the intake air amount at this time becomes the target intake air amount corresponding to the required torque TQ and the engine speed N at this time. Further, the EGR gas amount at this time becomes the target EGR gas amount corresponding to the required torque TQ and the engine speed N at this time.

In this case, the pressure within the air intake pipe 17 disposed downstream the throttle valve 20 is defined by the intake air amount flowing into the air intake pipe 17 disposed downstream the throttle valve 20 and the EGR gas amount. Accordingly, when the intake air amount and the EGR gas amount are respectively set to the target values, as mentioned above, the pressure within the air intake pipe 17 disposed downstream the throttle valve 20 becomes a pressure corresponding to the target values, and the pressure at this time coincides with the target pressure PM0 shown in FIG. 29C corresponding to the required torque TQ and the engine speed N.

However, when defining the injection amount, the opening degree of the throttle valve 20, and the opening degree of the EGR control valve 31 on the basis of the corresponding maps, the air fuel ratio does not coincide with the air fuel ratio shown in FIG. 12 due to dispersion of the size of the parts, an aged deterioration, and a clogging of the throttle valve 20 or the EGR control valve 31, and the EGR rate is shifted from the target EGR rate. Then, in accordance with the third embodiment of the invention, the engine is designed to calculate the target intake air amount necessary for setting the air fuel ratio to the target air fuel ratio A/F from the target injection amount Q, correct the opening degree of the throttle valve 20 so that the mass flow rate of the intake air detected by the mass flow rate detecting device 21 (hereinafter, simply refer to as an intake air amount) becomes the target intake air amount, and thereby accurately reconcile the air fuel ratio with the target air fuel ratio.

As mentioned above, in accordance with the third embodiment, since the engine is designed to accurately reconcile the air fuel ratio with the target air fuel ratio, that is, to accurately coincide the intake air amount with the target air fuel amount, the pressure within the air intake pipe 17 disposed downstream the throttle valve 20 is going to coincide with the target pressure PM0 shown in FIG. 29C when the EGR gas amount coincides with the target EGR gas amount. In other words, in the case where the pressure within the air intake pipe 17 disposed downstream the throttle valve 20 at this time is shifted from the target pressure PM0 shown in FIG. 29C, the EGR gas amount does not coincide with the target EGR gas amount. Accordingly, the EGR rate is not going to coincide with the target EGR rate.

Then, in accordance with the embodiment of the present invention, in the case where the pressure downstream the throttle valve 20 is shifted from the target pressure PM0 shown in FIG. 29C, the opening degree of the EGR control valve 31 is controlled such that the pressure downstream the throttle valve 20 becomes the target pressure shown in FIG. 29C, thus coinciding the EGR rate with the target EGR rate.

Further, in the third embodiment, the engine speed is controlled such that the engine speed becomes the target idling speed during an engine idling operation. In accordance with this embodiment, a control of the engine speed is performed by controlling the fuel injection amount. Even in this case, the air fuel ratio is controlled so as to become the target air fuel ratio. Furthermore, the opening degree of the EGR control valve 31 is controlled such that the pressure within the air intake pipe 17 downstream the throttle valve 20 becomes the target pressure. Accordingly, the EGR rate is controlled to become the target EGR rate.

In this case, there are at least two purposes in maintaining the pressure within the air intake pipe 17 disposed downstream the throttle valve 20 to the target pressure. One purpose is to secure good combustion at a low temperature by controlling the EGR rate to the target EGR rate. Another purpose is to restrict vibration of the engine main body 1 by restricting the pressure within the combustion chamber 5 at the beginning of the compression to a low level.

Next, an operation control will be described below with reference to FIG. 32.

Figure 32:
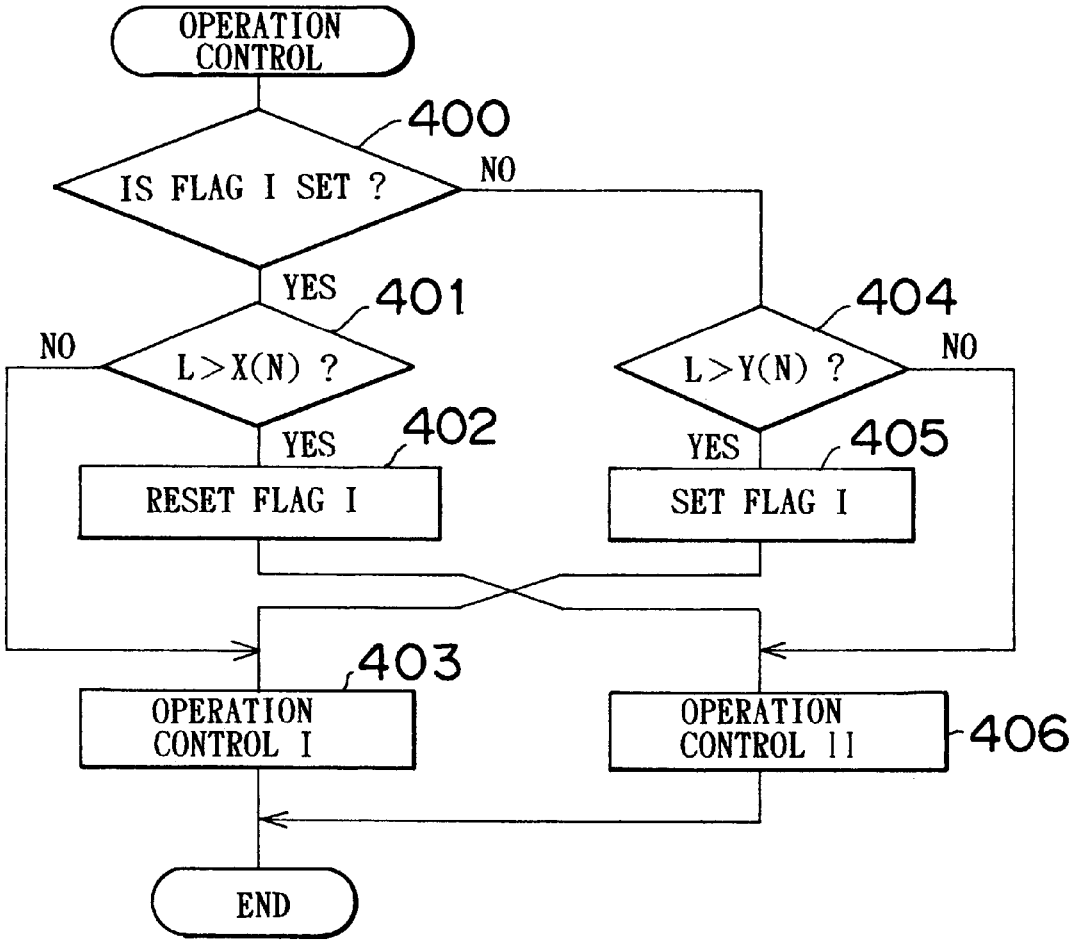
FIG. 32 is a flowchart for controlling an operation of the engine.

With reference to FIG. 32, in step 400, it is determined whether a flag I showing that the operation area of the engine in the first operation area I is set. When the flag I is set, that is, the operation area of the engine is in the first operation area I, the process goes to step 401 where it is determined whether the required load L becomes greater than the first boundary X(N). If the required load L is less than or equal to the first boundary, L≦1Z(N), the process goes to step 403 where an operation control I for executing the first combustion is performed. A routine for executing the operation control I is shown in FIGS. 33 and 34.

Figure 40:
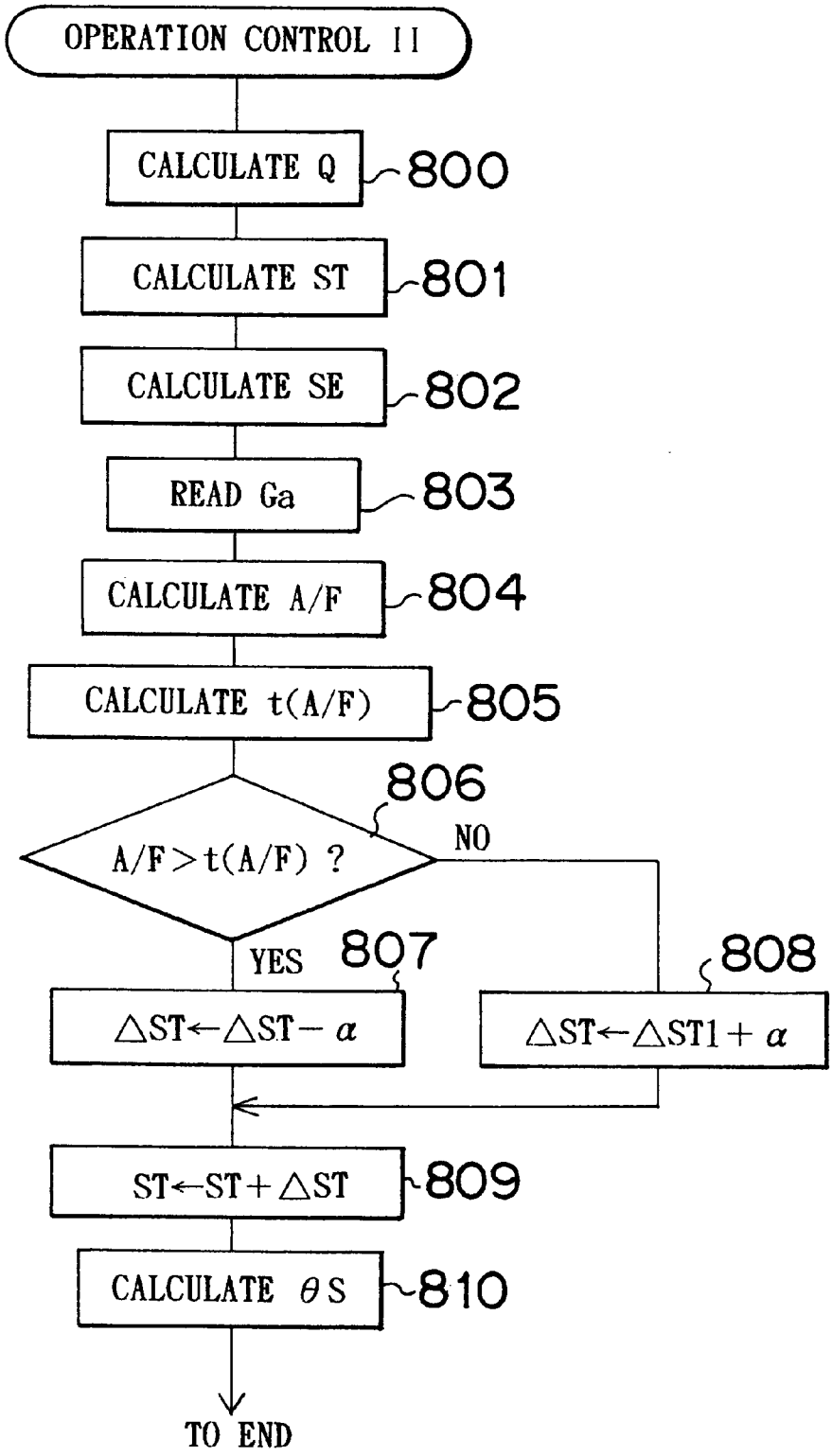
FIG. 40 is a flowchart for executing the operation control II.

Meanwhile, in step 401, when it is determined that the required load L is greater than the first boundary X(N) L>X(N), the process goes to step 402 where the flag I is reset and further goes to step 406 where an operation control II for executing the second combustion is performed. A routine for executing the operation control II is shown in FIG. 40. When the flag I is reset, in the next process cycle, the process goes to step 404 from step 400 where it is determined whether the required load L becomes lower than the second boundary Y(N). If the required load L is greater than or equal to the second boundary Y(N), L≧Y(N), the process goes to step 406 where the second combustion is performed. Contrarily, in step 404, when it is determined that the required load L is less than the second boundary Y(N), L<Y(N), the process goes to step 405 where the flag I is set, and further goes to step 403 where the low temperature combustion is performed.

Next, the operation control I for executing the low temperature combustion will be described below with reference to FIGS. 33 and 34.

Figure 33:
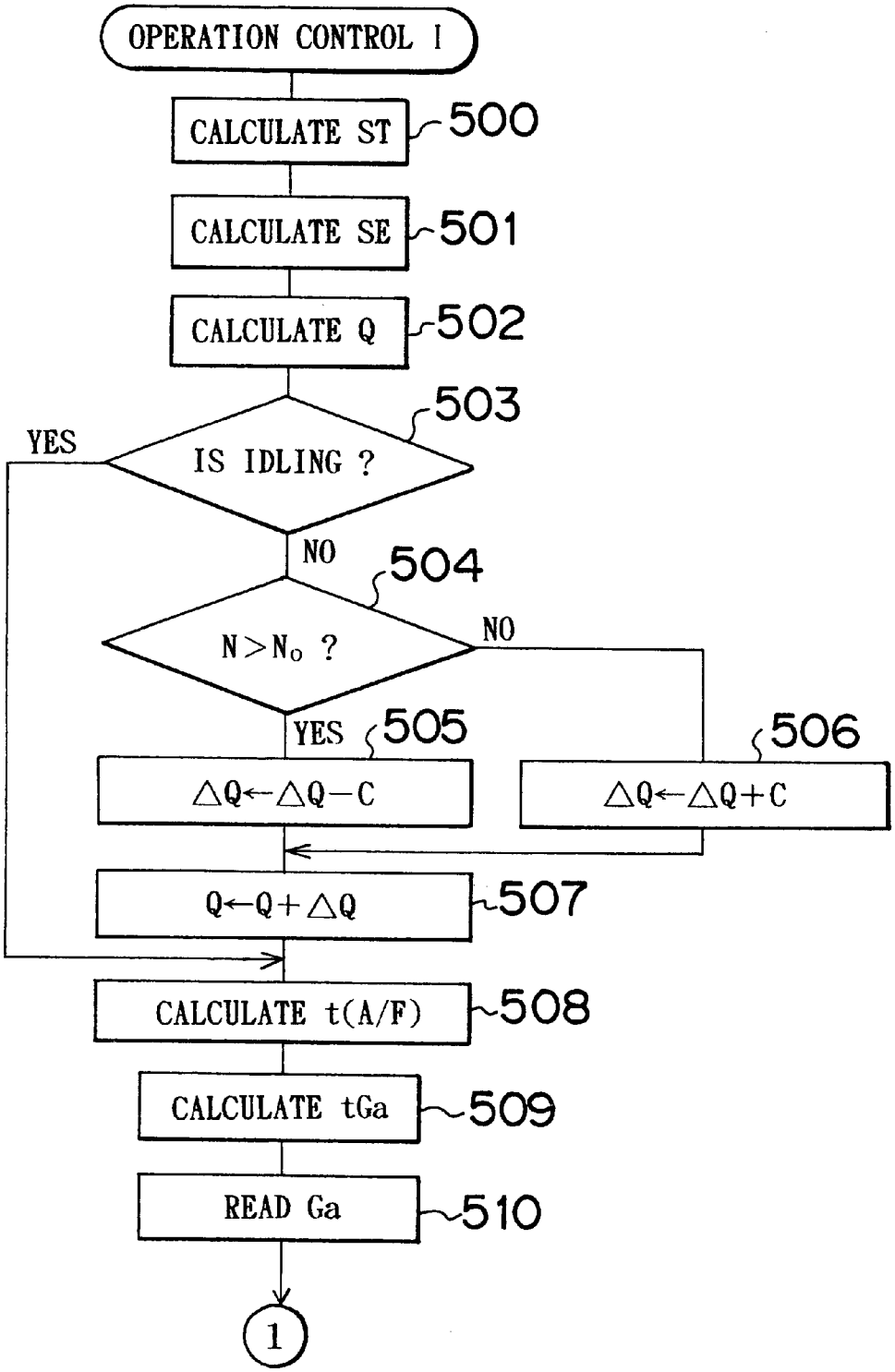
FIG. 33 is a flowchart for executing operation control I of the low temperature execution.
Figure 34:
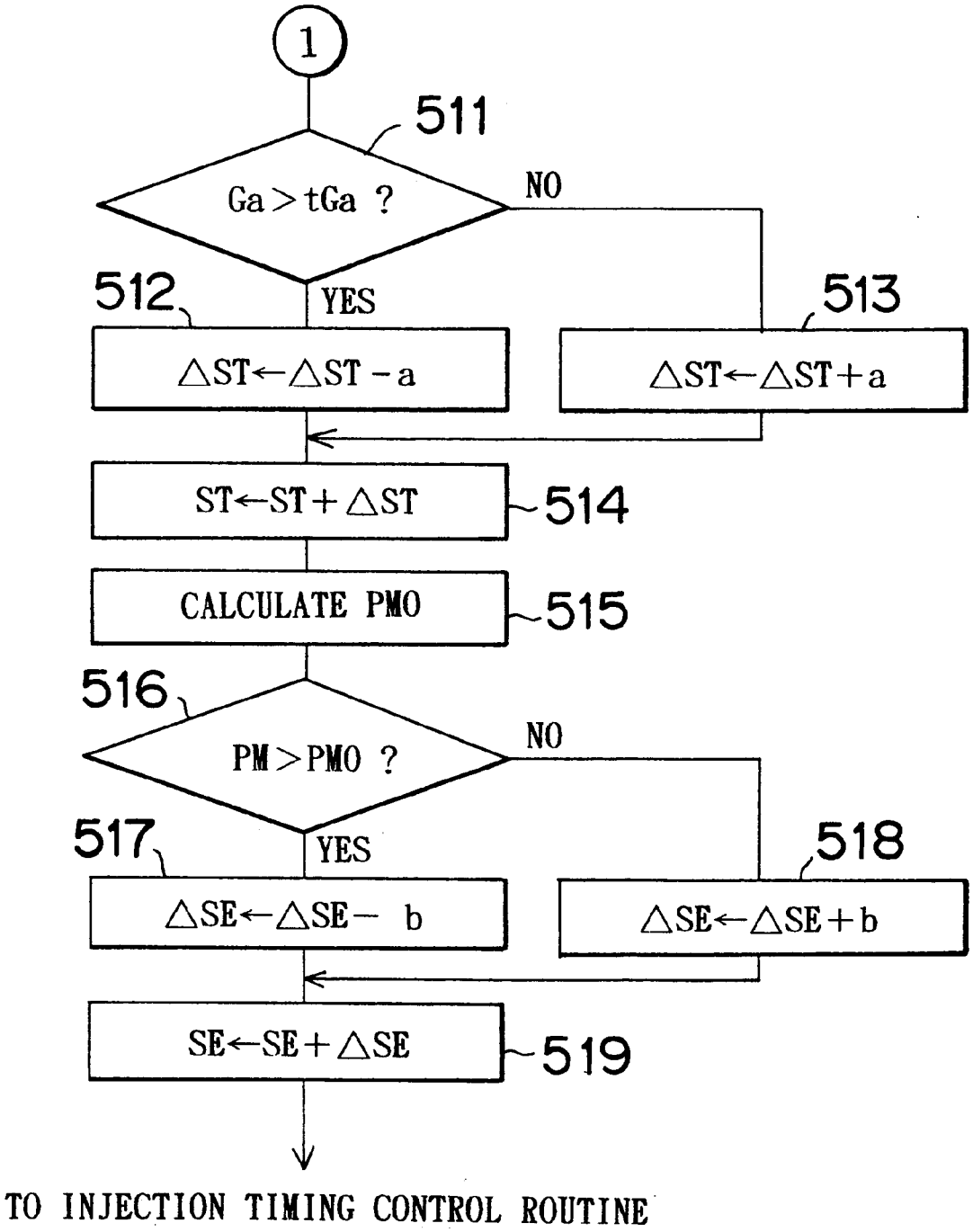
FIG. 34 is a flowchart for executing an operation control I of the low temperature execution.

With reference to FIG. 33, in step 500, the target opening degree ST of the throttle valve 20 is calculated from the map shown in FIG. 29A. In step 501, the target opening degree SE of the EGR control valve 31 is calculated from the map shown in FIG. 29B. Then, in step 502, the injection amount Q is calculated from the map shown in FIG. 28A. Next, in step 503, it is determined whether the engine idling operation is performed. For example, when the depression amount of the acceleration pedal 50 is 0 and the vehicle speed is 0, it is determined that the engine idling operation is performed.

When the engine idling operation is not performed, the process goes to step 508 where a target air fuel ratio t(A/F) shown in FIG. 12 is calculated. Next, in step 509, a target intake air amount tGa necessary for setting the air fuel ratio to the target air fuel ratio t(A/F) is calculated on the basis of the injection amount Q and the target air fuel ratio t(A/F). Then, in step 510, an actual intake air amount Ga detected by the mass flow rate detecting device 21 is introduced. Looking at FIG. 34, the process continues to step 511, where it is determined whether the actual intake air amount Ga is more than the target intake air amount tGa.

When the actual intake air amount Ga is more than the target intake air amount tGa, Ga>tGa, the process goes to step 512 where a constant value a is subtracted from a correction amount ΔST with respect to the throttle valve opening degree and the process continues to step 514. Contrarily, when the actual intake air amount Ga is less then or equal to the target intake air amount tGa, Ga<tGa, the process goes to step 513 where a constant value a is added to the correction amount ΔST and the process continues to step 214. In step 214, a value (=ST+ΔST) obtained by adding the correction value ΔST to the target opening degree ST of the throttle valve 20 is set to a final opening degree ST of the throttle valve 20. Accordingly, when the actual intake air amount Ga is more than the target intake air amount tGa, Ga>tGa, the opening degree of the throttle valve 20 is reduced, and when Ga≦tGa, the opening degree of the throttle valve 20 is increased, such that the actual intake air amount Ga is set to the target intake air amount tGa and the air fuel ratio is set to the target air fuel ratio t(A/F).

In step 515, the target pressure PM0 within the air intake pipe 17 disposed downstream the throttle valve 20 is calculated from the map shown in FIG. 29C. Next, in step 516, it is determined whether the pressure PM within the air intake pipe 17 detected by the pressure sensor 37 is higher than the target pressure PM0. When the pressure PM within the air intake pipe 17 is higher than the target pressure PM0, PM>PM0, the process goes to step 517 where a constant value b is subtracted from the correction value ΔSE with respect to the EGR control valve 31 and the process continues to step 519. Contrarily, when the pressure PM within the air intake pipe 17 is less than or equal to the target pressure PM0, PM≦PM0, the process goes to step 518 where the constant value b is added to the correction value ΔSE and the process continues to step 519.

In step 519, a value (=SE+ΔSE) obtained by adding the correction value ΔSE to the target opening degree SE of the EGR control valve 31 is set to a final opening degree SE of the EGR control valve 31. Accordingly, when the pressure PM within the air intake pipe 17 is higher than the target pressure PM0, PM>PM0, the opening degree of the EGR control valve 31 is reduced, and when the pressure PM within the air intake pipe 17 is less than or equal to the target pressure PM0, PM≦PM0, the opening degree of the EGR control valve 31 is increased, whereby the EGR rate is set to the target EGR rate. Then, the process goes to an injection timing control routine shown in FIG. 38.

Meanwhile returning to FIG. 33, in step 503, when it is determined that engine idling operation is performed, the process continues to step 504 where it is determined whether the engine speed N is higher than the target idling speed N0. When the engine speed N is higher than the target idling speed N0, N>N0, the process goes to step 505 where a constant value C is subtracted from the correction value ΔQ with respect to the injection amount and the process continues to step 507. Meanwhile, when the engine speed N is less than or equal to the target idling speed N0, N≦N0, the process goes to step 506 where the constant value C is added to the correction value ΔQ and the process continues to step 507.

In step 507, a value (=Q+ΔQ) obtained by adding the correction value Q to the injection amount ΔQ calculated from the map is set to a final injection amount Q. Accordingly, when the engine speed N is higher than the target engine speed N0, N>N0, the injection amount is reduced, and when the engine speed N is less than or equal to the target idling speed N0, N≦N0, the injection amount is increased, whereby the engine speed N is set to the target idling speed N0. Next, in steps from 508 to 514, the intake air amount is set to the target intake air amount and the air fuel ratio is set to the target air fuel ratio t(A/F). Then, in steps from 516 to 519, the pressure PM downstream the throttle valve 20 is set to the target pressure PM0. At this time, the EGR rate becomes the target EGR rate.

Next, before explaining an injection timing control routine shown in FIG. 38, a method of controlling an injection timing will be described below with reference to FIG. 35.

In accordance with the embodiment of the present invention, on the basis of the pressure within the combustion chamber 5 detected by the combustion pressure sensor 37, it is determined whether a combustion at a low temperature is performed in a good condition. That is, when a combustion at a low temperature is performed in a good condition, the combustion pressure is slowly changed, as shown in FIG. 35. In particular, the combustion pressure temporarily becomes a peak at the top dead center TDC, as shown by P0, and after the top dead center TDC, as shown by P1. The peak pressure P1 is generated by the combustion pressure, and when a good combustion at a low temperature is performed, a rising amount of the peak pressure P1 with respect to the peak pressure P0, that is, a pressure difference ΔP (=P1−P0) between the peak pressures P0 and the P1 becomes relatively small.

Meanwhile, for example, when an area high in a density of the fuel particles is locally formed, and the pressure rising amount after ignition becomes great, a combustion temperature is increased. At this time, the low temperature combustion is not performed, thus a large amount of soot is generated. Then, the engine is designed whereby the injection timing is delayed such that the pressure difference ΔP becomes small when the pressure difference ΔP (=P1−P0) exceeds a predetermined upper limit α.

Figure 36A:
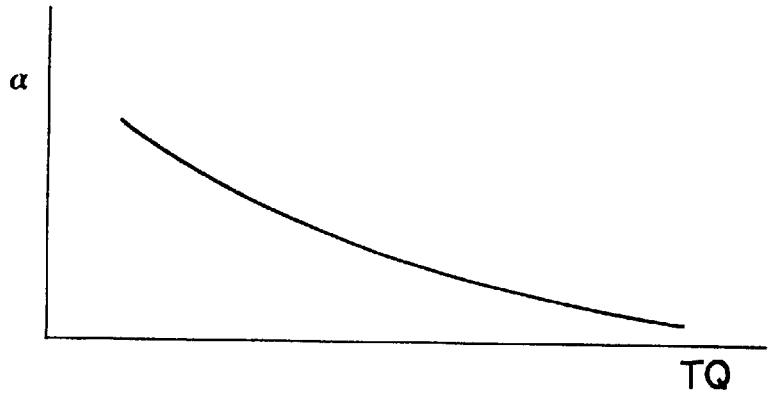
FIG. 36A is a graph illustrating the predetermined upper limit of the pressure difference relative to the required torque.
Figure 36B:
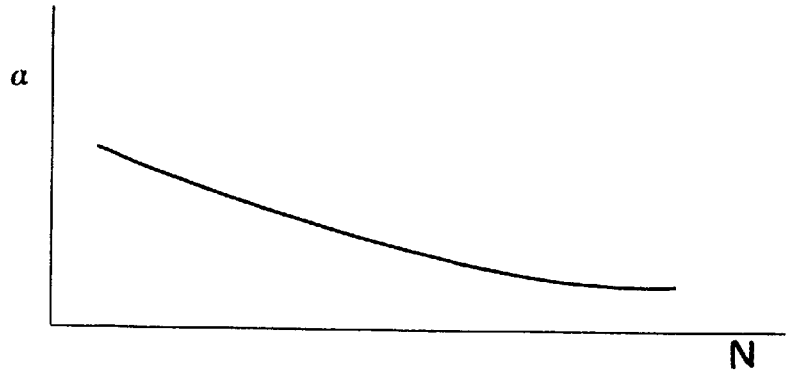
FIG. 36B is a graph illustrating the predetermined upper limit of the pressure difference relative to the engine speed.
Figure 36C:
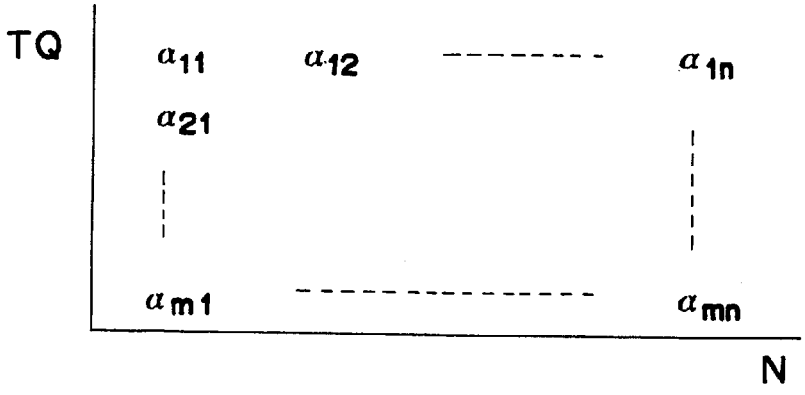
FIG. 36C is a map of the predetermined upper limit of the pressure difference as a function of the required torque and engine speed.

As shown in FIG. 36A, the upper limit becomes smaller as the required torque TQ becomes greater. As shown in FIG. 36B, the upper limit α becomes smaller as the engine speed N becomes higher. The upper limit value α is previously stored in the ROM 42 in the form of a map as a function of the required torque TQ and the engine speed N, as shown in FIG. 36C.

Furthermore, when a good combustion at a low temperature is not performed and the combustion is performed in a bad condition, the peak pressure P1 becomes lower than the peak pressure P0. Accordingly, the engine is designed such that when the pressure difference ΔP (=P1−P0) becomes negative, the injection timing is quickened so as to perform a good combustion at a low temperature.

Figure 37:
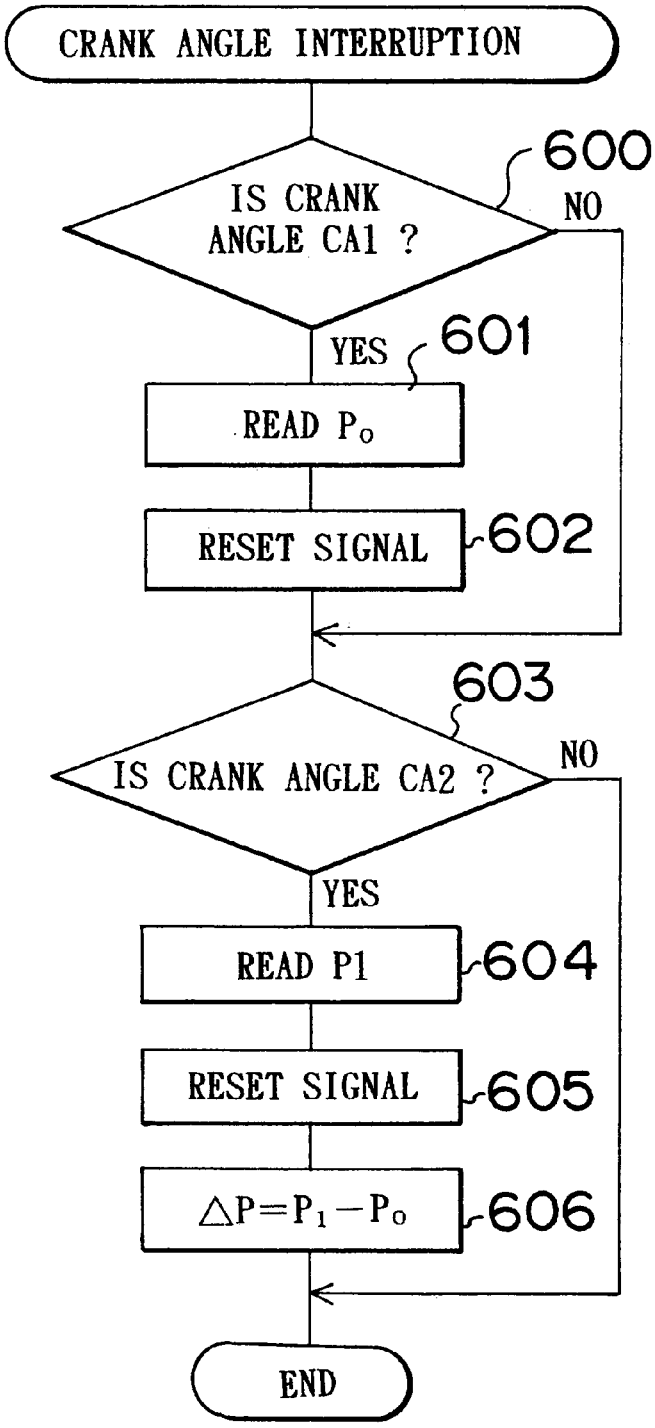
FIG. 37 is a flowchart showing a crank angle interruption routine.

Next, a method of detecting the pressure difference ΔP will be described. FIG. 37 shows a crank angle interruption routine. In step 600, it is determined whether a current crank angle is CA1 (FIG. 35). When the crank angle is CA1, the process goes to step 601 where an output voltage of the peak hold circuit 49 is read. At this time, the output voltage of the peak hold circuit 49 expresses the peak pressure P0, therefore, in step 601, the peak pressure P0 is read. Next, in step 602, a reset signal is input to a reset input terminal R in the peak hold circuit 49 to reset the peak hold circuit 49.

Figure 35:
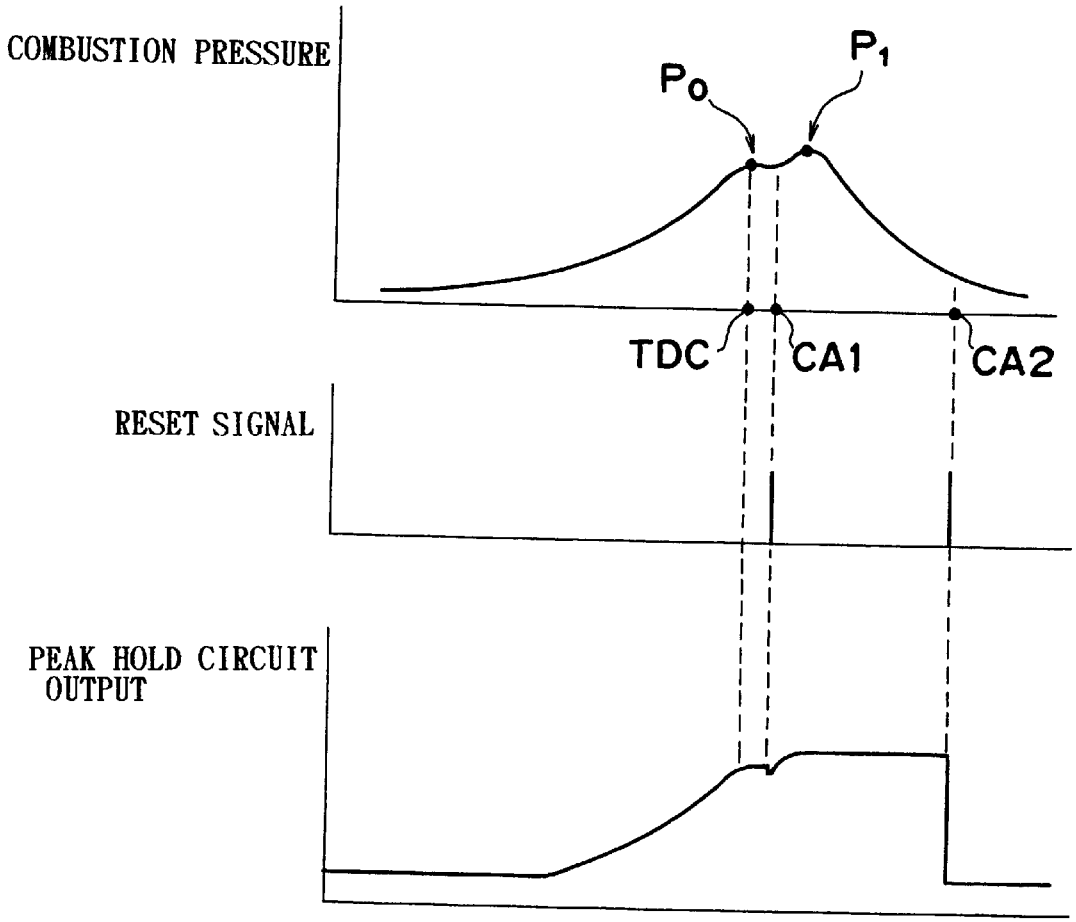
FIG. 35 is a graph illustrating a combustion pressure, a reset signal, and a peak hold circuit output.

Then, in step 603, it is determined whether the current crank angle is CA2 (FIG. 35). When the crank angle is CA2, the process goes to step 604 where an output voltage of the peak hold circuit 49 is read. At this time, the output voltage of the peak hold circuit 49 expresses the peak pressure P1, thus in step 604, the peak pressure P1 is read. Next, in step 605, a reset signal is input to a reset input terminal R in the peak hold circuit 49 to reset the peak hold circuit 49. Then, in step 606, a pressure difference ΔP (=P1−P0) between the peak pressure P0 and the peak pressure P1 is calculated.

Next, the injection timing control routine shown in FIG. 38 will be described below.

Figure 38:
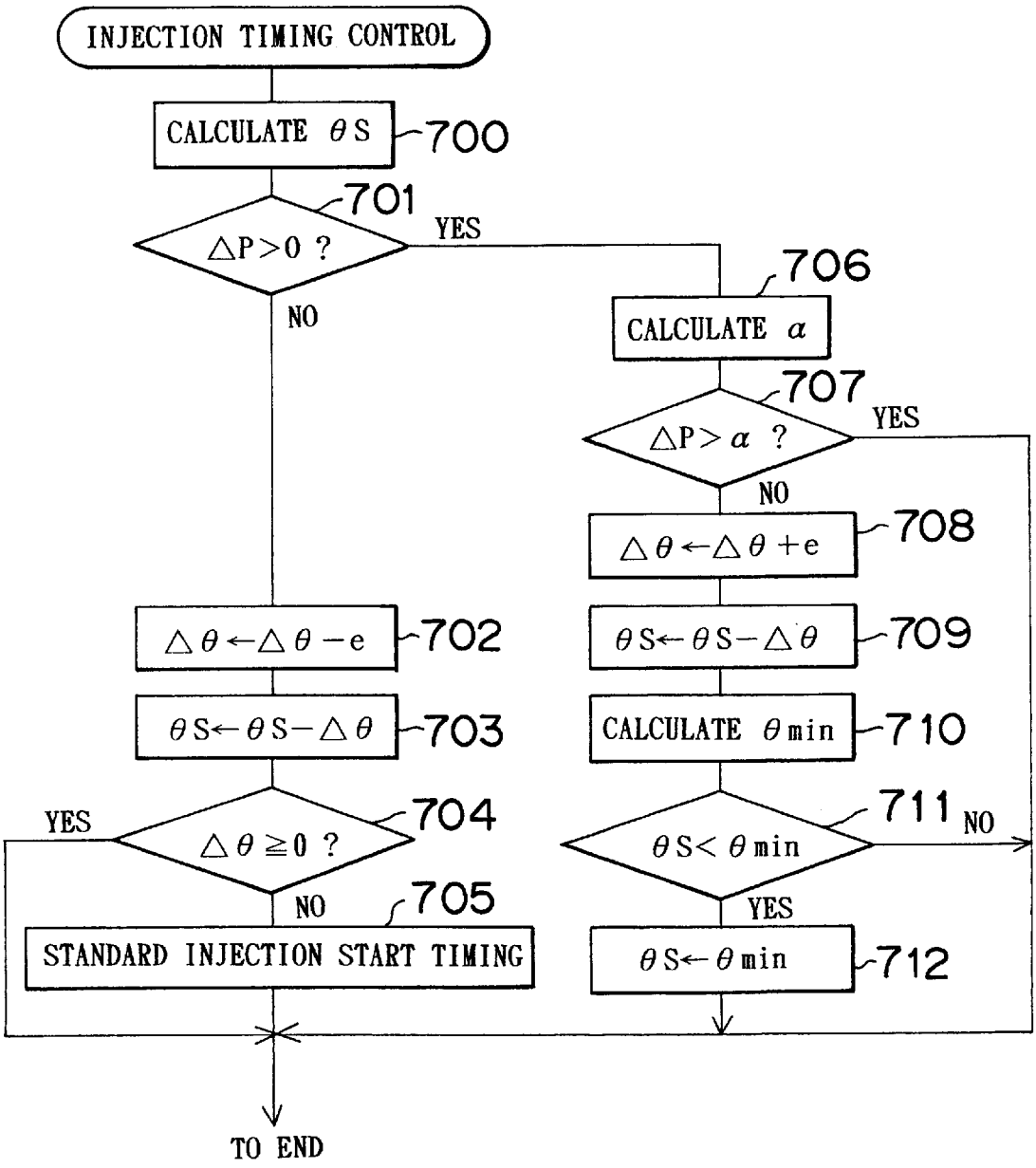
FIG. 38 is a flowchart for controlling an injection timing.

With reference to FIG. 38, in step 700, a standard injection start timing θS is calculated from the map shown in FIG. 28B. Next, in step 701, it is determined whether a pressure difference ΔP (=P1−P0) is greater than 0. When ΔP≧0, the process continues to step 406 and the upper limit α is calculated from the map shown in FIG. 36C. Then, in step 707, it is determined whether the pressure difference ΔP is smaller than the upper limit α. When the pressure difference ΔP is less than the upper limit α, ΔP<α, the process cycle is completed. In other words, the process cycle is completed when the pressure difference ΔP is less than the upper limit α and greater than or equal to 0, 0≦ΔP<α.

Meanwhile, in step 707, when it is determined that the pressure difference ΔP is greater than or equal to 0, ΔP≧α, the process continues to step 708 where a constant value e is added to the correction value Δθ with respect to the standard injection start timing θS. Next, in step 709, the correction value Δθ is subtracted from the standard ignition start timing θS, thus delaying the injection start timing θS. Then, in step 710, an allowable maximum lag angle timing θmin is calculated. The allowable maximum lag angle timing θmin is previously stored in the ROM 42 as a function of the required torque TQ and the engine speed N, as shown in FIG. 39. Next, in step 711, it is determined whether the injection start timing θS is delayed with respect to the allowable maximum retard angle timing θmin, that is, whether the injection start timing θS is less than the allowable maximum lag angle timing θmin, θS<θmin. When the injection start timing θS is greater than or equal to the allowable maximum lag angle timing θmin, θS≧θmin, the process cycle is completed. Meanwhile, when the injection start timing θS is less than the allowable maximum lag angle timing θmin, θS<θmin, the process goes to step 712 where the injection start timing θS is set to the allowable maximum retard angle timing θmin.

Meanwhile, in step 701, when it is determined that the pressure difference ΔP is negative, the process continues to step 702 where the constant value e is subtracted from the correction value Δθ. Next, in step 703, the correction value Δis subtracted from the standard injection start timing θS, and at this time, the injection start timing θS is quickened. Then, in step 704, it is determined whether the correction value Δθ is greater than 0. When the correction value Δθ is greater than or equal to 0, Δθ≧0, the process cycle is completed. Meanwhile, when the correction value Δθ is less than 0, Δθ<0, the process continues to step 705 where the injection start timing θS is set to the reference injection start timing calculated from the map shown in FIG. 28B.

As mentioned above, if the pressure difference ΔP becomes greater than the upper limit α when the opening degree of the throttle valve 20 and the opening degree of the EGR control valve 31 are controlled to perform the low temperature combustion, the injection start timing is gradually delayed. When the pressure difference ΔP becomes negative, the injection start timing is gradually quickened. Accordingly, a good combustion at a low temperature can be always performed.

Next, a routine of an operation control II for executing a second combustion performed in step 406 in FIG. 32 will be described below with reference to FIG. 40.

With reference to FIG. 40, in step 800, the target fuel injection amount Q is calculated from the map shown in FIG. 30A and the fuel injection amount is set to the target fuel injection amount Q. Next, in step 801, the target opening degree ST of the throttle valve 20 is calculated from the map shown in FIG. 31A. Then, in step 802, the target opening degree SE of the EGR control valve 31 is calculated from the map shown in FIG. 31B, and the opening degree of the EGR control valve 31 is set to the target opening degree SE.

Next, in step 803, the intake air amount Ga detected by the mass flow rate detecting device 21 is introduced. Then, in step 804, an actual air fuel ratio A/F is calculated from the fuel injection amount Q and the intake air amount Ga. Next, in step 805, the target air fuel ratio t (A/F) shown in FIG. 16 is calculated. Then, in step 806, it is determined whether the actual air fuel ratio A/F is greater than the target air fuel ratio t(A/F). When the actual air fuel ratio A/F is greater than the target air fuel ratio t(A/F), A/F>t(A/F), the process continues to step 807 where the correction value ΔST of the throttle opening degree is reduced at a constant value α and the process continues to step 809. Contrarily, when the actual air fuel ratio A/F is less than or equal to the target air fuel ration t(A/F), A/F≦t(A/F), the process continues to step 808 where the correction value ΔST is increased at the constant value α and the process goes to step 809. In step 809, the final opening degree ST can be calculated by adding the correction value ΔST to the target opening degree ST of the throttle valve 20. That is, the opening degree of the throttle valve 20 can be controlled such that the actual air fuel ratio A/F becomes the target air fuel ratio t(A/F). Next, in step 510, the injection start timing θS is calculated from the map shown in FIG. 30B.

Figure 41:
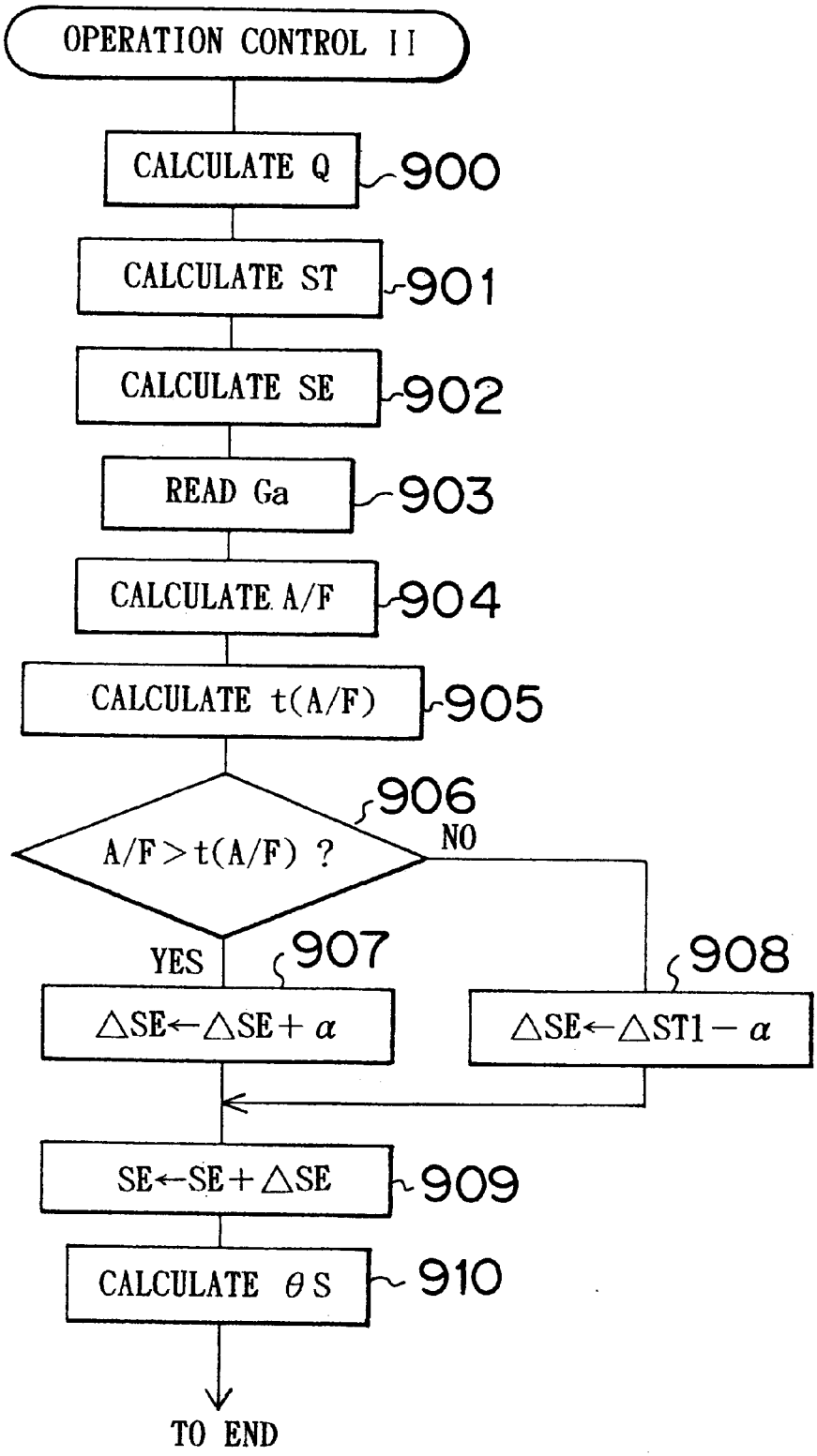
FIG. 41 is a flowchart showing another embodiment for executing the operation control II.

FIG. 41 shows another embodiment for executing the operation control II.

With reference to FIG. 41, in step 900, the target fuel injection amount Q is calculated from the map shown in FIG. 30A and the fuel injection amount is set to the target fuel injection amount Q. Next, in step 901, the target opening degree ST of the throttle valve 20 is calculated from the map shown in FIG. 31A and the opening degree of the throttle valve 20 is set to the target opening degree ST. Then, in step 902, the target opening degree SE of the EGR control valve 31 is calculated from the map shown in FIG. 31B.

Next, in step 903, the intake air amount Ga detected by the mass flow rate detecting device 21 is introduced. Then, in step 904, an actual air fuel ratio A/F is calculated from the fuel injection amount Q and the intake air amount Ga. Next, in step 905, the target air fuel ratio t (A/F) shown in FIG. 16 is calculated. Then, in step 606, it is determined whether the actual air fuel ratio A/F is greater than the target air fuel ratio t(A/F). When the actual air fuel ratio A/F is greater than the target air fuel ratio t(A/F), A/F>t(A/F), the process goes to step 907 where the correction value ΔST with respect to the opening degree of the EGR control valve is increased by the constant value α and the process continues to step 909. Contrarily, when the actual air fuel ratio A/F is less than or equal to the target air fuel ratio t(A/F), A/F≦t(A/F), the process goes to step 908 where the correction value ΔSE is reduced by the constant value α and the process continues to step 909. In step 909, the final opening degree SE can be calculated by adding the correction value ΔSE to the target opening degree SE of the EGR control valve 31. That is, the opening degree of the EGR control valve 31 can be controlled such that the actual air fuel ratio A/F becomes the target air fuel ratio t(A/F). Next, in the step 910, the injection start timing θS is calculated from the map shown in FIG. 30B.

Further, with respect to the third embodiment, the engine may be designed whereby, as shown in steps from 509 to 511 in FIG. 33, the throttle valve and the EGR control valve are controlled such that the actual air fuel ratio detected by the air fuel ratio sensor 27 becomes the target air fuel ratio at the low temperature combustion without performing the injection control on the basis of the target intake air amount tGa calculated for setting the air fuel ratio to the target air fuel ratio t(A/F) on the basis of the injection amount Q and the target air fuel ratio t(A/F), and the actual intake air amount Ga. Furthermore, the engine may be designed whereby the target air fuel ratio t(A/F) is previously determined in the form of a function of the intake air amount Ga and the engine speed N and the control is performed by the actual intake air amount Ga detected by the mass flow rate detecting device 21 and the target air fuel ratio t(A/F) calculated by the intake air amount Ga.

In the third embodiment (FIGS. 33 and 34), the injection amount Q and the target air fuel ratio t(A/F) are calculated on the basis of the required torque TQ and the engine speed N, and the intake air amount Ga is controlled on the basis of the injection amount Q and the target air fuel ratio t(A/F) such that the air fuel ratio becomes the target air fuel ratio t(A/F). Accordingly, in this case, as long as the actual injection amount coincides with the calculated injection amount Q, the intake air amount Ga becomes the target intake air amount corresponding to the required torque TQ and the engine speed N.

However, in the structure where the target air fuel is previously determined in the form of a function of the intake air amount Ga and the engine speed N and the control is performed by the actual intake air amount Ga detected by the mass flow rate detecting device 21 and the target air fuel ratio t(A/F) calculated by the intake air amount Ga, the intake air amount is controlled only on the basis of the opening degree of the throttle valve and the opening degree of the EGR control valve. Therefore, for example, when the throttle valve 20 is clogged, the actual intake air amount Ga is shifted from the target intake air amount. However, even when the actual intake air amount Ga is shifted from the target intake air amount, the target air fuel ratio t(A/F) is determined on the basis of the intake air amount Ga and the engine speed N so that the air fuel ratio becomes the target air fuel ratio t(A/F) and the EGR rate becomes the target EGR rate and the target pressure PM0 downstream the throttle valve 20 is determined on the basis of the intake air amount Ga and the engine speed N.

In this case, the structure may be made in which the throttle valve 20 is arranged downstream the compressor 16 of the exhaust turbo charger 15 and the EGR passage 29 is connected to the inner portion of the intake air passage disposed downstream the throttle valve 20. In this case, the structure may be made such that the pressure sensor 37 is arranged within the intake air passage disposed downstream the throttle valve 20 and the opening degree of the EGR control valve 31 is controlled such that the pressure within the intake air passage disposed downstream the throttle valve 20 becomes the target pressure PM0.

While the invention has been described in conjunction with specific embodiments thereof, it is evident that many alternatives, modifications and variations may be apparent to those skilled in the art. Accordingly, the preferred embodiments of the invention as set forth herein are intended to be illustrative, not limiting. Various changes may be made without departing from the spirit and scope of the invention.

What is claimed is:

1. An internal combustion engine having a combustion chamber with an amount of inert gas within the combustion chamber, the engine gradually increases an amount of soot generated by the engine to a peak amount by increasing the amount of the inert gas within the combustion chamber, the engine does not generate substantially any soot or nitrogen oxides by further increasing the amount of the inert gas within the combustion chamber so that a temperature of a fuel and a surrounding gas during combustion within the combustion chamber is lower than a generation temperature of the soot, the engine comprising:

a first combustion in which the amount of the inert gas within the combustion chamber is more that the amount of the inert gas within the combustion chamber when the amount of soot generated by the engine reaches the peak amount so as to generate substantially no soot;

a second combustion in which the amount of the inert gas within the combustion chamber is less than the amount of the inert gas within the combustion chamber when the amount of soot generated is substantially equal to the peak amount;

switching means for selectively switching between the first combustion and the second combustion; and an operation area having a first operation area and a second operation area, the first operation area having a high load side and a low load side, the first operation area being performed in a low load side of the operation area, and the second operation area being performed in a high load side of the operation area, wherein the first operation area is switched to the high load side of the operation area when an air fuel ratio of the engine decreases.

2. The internal combustion engine according to claim 1, further comprising control means for controlling the first operation area in accordance with a target air fuel ratio.

3. The internal combustion engine according to claim 1, wherein the switching means comprises an exhaust gas recirculation control valve driven by a stepper motor and arranged within an exhaust gas recirculation passage, the exhaust gas recirculation control valve being connected to an output port of a control unit.

4. The internal combustion engine according to claim 1, further comprising an exhaust gas recirculating apparatus for recirculating an exhaust gas discharged from the combustion chamber into an engine intake passage, wherein the inert gas is formed of the recirculated exhaust gas.

5. The internal combustion engine according to claim 4, wherein an exhaust gas recirculation rate during the first combustion is substantially equal to or greater than 55%.

6. The internal combustion engine according to claim 1, wherein the high load side of the first operation area has a first limit and the low load side of the first operation area has a second limit, and the second limit of the low load side of the first operation area is shifted toward the high load side of the operation area as the air fuel ratio of the engine decreases.

7. The internal combustion engine according to claim 6, wherein the second limit of the low load side of the first operation area is provided only when the air fuel ratio of the engine is less than the stoichiometric air fuel ratio.

8. The internal combustion engine according to claim 6, wherein the first operation area is shifted to the high load side of the operation area when the temperature of the fuel and the surrounding gas within the combustion chamber decrease during the first combustion.

9. The internal combustion engine according to claim 8, further comprising control means for controlling the first operation area based on a value of a parameter, which shifts the first operation area to the high load side of the operation area when the value of the parameter determines that the temperature of the fuel and the surrounding gas within the combustion chamber is decreased during the first combustion.

10. The internal combustion engine according to claim 9, wherein the parameter is at least one of a temperature of a gas flowing into the combustion chamber, a temperature of an engine cooling water, a pressure within an engine intake air passage, and a humidity of an intake air.

* * * * *